US006288483B1

(12) United States Patent
Haven et al.

(10) Patent No.: US 6,288,483 B1
(45) Date of Patent: Sep. 11, 2001

(54) LIGHT-EMITTING STRUCTURE HAVING SPECIALLY CONFIGURED DARK REGION

(75) Inventors: Duane A. Haven, Umpqua, OR (US); Arthur J. Learn, Cupertino; John D. Porter, Berkeley, both of CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/240,351

(22) Filed: Jan. 29, 1999

Related U.S. Application Data

(62) Division of application No. 08/846,522, filed on Apr. 29, 1997, now Pat. No. 6,046,539.

(51) Int. Cl.[7] ..... H01J 29/10; H01J 31/00; H01J 63/04

(52) U.S. Cl. ..... 313/461; 313/466; 313/473; 313/477 R; 313/495

(58) Field of Search ..... 313/309, 336, 313/351, 445–446, 461–462, 463, 466, 470–471, 473–474, 476, 477 R, 479, 495–497

(56) References Cited

U.S. PATENT DOCUMENTS

| | | | |
|---|---|---|---|
| 4,019,905 | 4/1977 | Tomita et al. | 96/36.1 |
| 4,928,035 | 5/1990 | Schlipf | 313/466 |
| 5,160,871 | 11/1992 | Tomii et al. | 315/366 |
| 5,418,094 | 5/1995 | Sato et al. | 430/7 |
| 5,462,467 | 10/1995 | Macaulay et al. | 445/50 |
| 5,477,105 | 12/1995 | Curtin et al. | 313/422 |
| 5,543,683 | 8/1996 | Haven et al. | 313/461 |
| 5,559,389 | 9/1996 | Spindt et al. | 313/310 |
| 5,564,959 | 10/1996 | Spindt et al. | 445/24 |
| 5,576,596 | 11/1996 | Curtin et al. . | |
| 5,578,899 | 11/1996 | Haven et al. | 313/422 |
| 5,589,731 | 12/1996 | Fahlen et al. | 313/495 |
| 5,650,690 | 7/1997 | Haven | 313/422 |
| 5,718,991 | 2/1998 | Lin et al. | 430/5 |
| 5,818,162 | 10/1998 | Drumm | 313/466 |

*Primary Examiner*—Vip Patel
*Assistant Examiner*—Mack Haynes
(74) *Attorney, Agent, or Firm*—Skjerven Morrill MacPherson LLP; Ronald J. Meetin

(57) ABSTRACT

A light-emitting structure contains a plate (20), light-emissive regions (34R, 36G, and 38B) overlying the plate, and a dark region (40DR/46DC, 40IR/56DC, 60DR/66DC, or 76DR/80DR/80DC) overlying the plate and laterally surrounding each light-emissive region. In one aspect, the dark region is formed with (a) multiple first strips (40DR, 40IR, 60DR, or 76DR) extending in one direction and (b) multiple second strips (46DC, 56DC, 66DC, or 80DC) extending in another direction and also extending further away from the plate than the first strips. In another aspect, the dark region contains trapezoidally profiled strips (86), each having a width profile shaped like an upright trapezoid.

22 Claims, 25 Drawing Sheets

LIGHT-EMITTING STRUCTURE HAVING SPECIALLY CONFIGURED DARK REGION

CROSS-REFERENCE TO RELATED APPLICATION

This is a division of U.S. patent application Ser. No. 08/846,522, filed Apr. 29, 1997, now U.S. Pat. No. 6,046,539.

FIELD OF USE

This invention relates to techniques for creating openings in a structure, especially openings that receive light-emissive material in an optical device such as a cathode-ray tube ("CRT") display of the flat-panel type. More particularly, this invention relates to the manufacture of a light-emitting structure in which certain portions emit light when struck by electrons and in which one or more other portions, commonly referred to as a "black matrix", are largely non-emissive of light when struck by electrons. This invention also relates to the configuration of such a light-emitting structure.

BACKGROUND ART

A flat-panel CRT display is conventionally formed with a baseplate (or backplate), a transparent faceplate (or frontplate) that presents a desired image in the display's active area, and an outer wall that connects the baseplate and faceplate together outside the active area. The CRT display is maintained at a very low internal pressure, typically a vacuum level of $10^{-6}$ torr or less. A group of spacers, typically in the shape of walls, are often situated between the two plates inside the outer wall. In addition to maintaining a uniform spacing between the plates, the internal spacers provide the display with strength to resist external forces, such as air pressure, that could otherwise collapse the display.

Electron-emissive elements are situated in an array along the interior surface of the baseplate. A phosphor coating divided into a corresponding array of separate phosphor regions is situated along the interior surface of the faceplate. An anode is also situated over the faceplate next to the phosphor regions. During display operation, the electron-emissive elements emit electrons that are drawn by the anode towards the phosphors. Upon being struck by the oncoming electrons, the phosphors emit light that produces an image on the exterior surface of the faceplate at the front of the display. The display is controlled so that only electrons emitted from selected electron-emissive elements strike the phosphors.

More particularly, the electrons emitted from each electron-emissive element are intended to strike only one associated phosphor region. However, some of the emitted electrons invariably impinge on portions of the faceplate outside the target phosphor region. To improve the image contrast at the faceplate, a matrix of dark, largely black, non-reflective material that emits substantially no light upon being struck by electrons is suitably situated around the phosphor regions. In a color flat-panel display, this black matrix inhibits undesired mixing of colors and improves the color purity.

The black matrix can be formed in various ways. Commonly, a layer of very dark material, such as black chromium, is deposited over the interior surface of the faceplate. The dark material is typically converted into the black matrix by patterning the material using a suitable mask provided over the outer surface of the material.

It is usually desirable that the above-mentioned internal spacers not be visible on the front of the display. Accordingly, the spacers commonly overlie portions of the black matrix and thus are outside the specific portions of the active area that present the image. When the internal spacers are in the shape of walls, mechanisms such as wall grippers can be employed to hold the spacer walls in the desired locations.

U.S. Pat. No. 5,543,683 discloses a process for fabricating a black matrix and wall grippers over a faceplate of a flat-panel CRT display that utilizes internal spacer walls. In U.S. Pat. No. 5,543,683, black chromium is deposited on the faceplate and patterned using a photoresist mask to provide a black matrix function. The wall grippers are created from photo-polymerizable polyimide material formed over the black chromium. The polyimide is patterned by exposing certain polyimide portions to ultraviolet ("UV") light through a photomask placed over the outer polymide surface—i.e., the polyimide surface furthest from the black chromium—and removing the unexposed polyimide with a developer. The UV light enters the polyimide through its outer surface and causes polymerization to occur in the exposed polyimide to a specified exposure depth. The extent of polymerization is greatest at the outer polyimide surface and decreases with increasing distance from the outer polyimide surface.

Unfortunately, the polyimide thickness in U.S. Pat. No. 5,543,683 inevitably varies from point to point. At locations where the polyimide is thickest, the polyimide furthest from the outer polyimide surface—i.e., the polyimide directly along the black chromium—may be at a distance exceeding the exposure depth of the UV light and therefore may not undergo significant polymerization despite being in the line of sight of the UV light. During the development operation, the polymerized polyimide overlying the unpolymerized polyimide can be washed away, resulting in a damaged wall-gripping capability. The variation in polyimide thickness can also result in non-uniformity in display brightness.

Even if all the polyimide within the line of sight of the UV light undergoes polymerization, including all the polyimide at the locations of thickest polyimide, the polyimide furthest from the outer polyimide surface does not polymerize as greatly as the polyimide closer to the outer polyimide surface. As a result, wall grippers formed at the locations of the thickest polyimide are normally weaker than wall grippers formed at the locations of thinnest polyimide. Compared to strong wall grippers, weak wall grippers do not maintain the desired wall positions as well. Use of the technique described in U.S. Pat. No. 5,543,683 to form the black matrix and wall grippers can lead to a damaged display and/or poor display performance.

Some electrons that impinge on the phosphor regions in a conventional flat-panel CRT display are scattered rather than being collected by the anode. Part of the scattered electrons harmlessly strike the black matrix. However, others degrade display performance by striking unintended phosphor regions or charging the spacer walls. Increasing the height of the black matrix increases the percentage of scattered electrons that strike the black matrix, thereby reducing the percentage that degrade display performance. The net result is improved display. performance.

In fabricating a flat-panel display, it would be desirable to have a technique for creating a black matrix from photo-polymerizable material in such a way that the black matrix is tall and adheres well to the structure on which the black matrix is formed. It would also be desirable to provide the black matrix with features for constraining the movement of spacers such as spacer walls. The spacer-constraining features should be of largely the same strength despite variations in the thickness of the photo-polymerizable material used to make the black matrix and spacer-constraining features.

GENERAL DISCLOSURE OF THE INVENTION

The present invention employs a backside exposure technique in creating a pattern of openings in actinic material. The technique entails selectively exposing an actinic layer to backside actinic radiation through a mask formed with portions of a sacrificial masking layer and then removing the unexposed material. The actinic radiation is termed "backside" because it enters the actinic layer through a body that underlies the actinic layer. The remaining exposed material of the original actinic layer forms a patterned layer. The thickness of the patterned layer can readily be made relatively uniform even though there may have been substantial variation in the thickness of the original actinic layer.

The patterned layer of exposed actinic material is typically processed so that the exposed actinic material is dark, largely black. Terms such as "exposed actinic material" are used here to clearly identify material exposed to actinic radiation even though, subsequent to the exposure, the exposed material is typically no longer actinic. Material that emits light upon being struck by electrons is typically introduced into openings in the black material constituted with the exposed actinic material. The black remainder of the original actinic layer can thereby perform a black matrix function for a light-emitting device such as that used in a flat-panel CRT display.

The pattern for the black material can readily be chosen to enable the black material to constrain the movement of spacers used in the device. Use of the backside exposure technique for defining the pattern in the black material enables the black material to extend relatively far away from the underlying body. In other words, the black material can be made quite tall. This enhances the ability of the black material to constrain spacer movement. Furthermore, the tall nature of the black material enhances its ability to collect scattered electrons, thereby enhancing device performance.

More particularly, in accordance with the invention, a patterned sacrificial masking layer is formed over a first surface of a plate in such a manner that multiple laterally separated mask portions overlie the plate. The masking layer is "sacrificial" in that segments of the masking layer are later removed. A primary layer of actinic material is provided over the masking layer and in space between the mask portions. After undergoing suitable processing, part of the primary layer typically later constitutes at least part of a black matrix. The plate has a second surface opposite the first surface. Material of the primary layer not shadowed by a mask formed with the mask portions is exposed to backside actinic radiation—i.e., actinic radiation that passes through the plate traveling from the second surface of the plate to its first surface.

The unexposed material of the primary layer is removed. This includes any material which, although not shadowed by the mask formed with the mask portions, is located at a greater distance from the first surface of the plate than the exposure depth of the backside radiation, the exposure depth being measured from the plate's first surface into the primary layer. The minimum thickness of the primary layer prior to the exposure step can be greater than the radiation's exposure depth. In that case, the height of the profile of the exposed material remaining after the removing step is normally relatively uniform despite variations in the original thickness of the primary layer.

The exposed material of the primary layer normally changes chemical structure by undergoing polymerization. By exposing the primary layer to the backside radiation, the greatest extent of polymerization occurs in the actinic material closest to the first surface of the plate and therefore furthest from the outer surface of the primary layer. In particular, the density of polymer cross-links is highest directly along the plate's first surface. This is true regardless of whether the minimum thickness of the primary layer is, or is not, greater than the exposure depth of the actinic radiation.

By having the highest density of polymer cross-links at the plate's first surface, the exposed material of the primary layer normally adheres strongly to the plate. Contrary to what occurs in U.S. Pat. No. 5,543,683 where the presence of unexposed (non-polymerized) polyimide below the exposed polyimide can lead to poor adherence and a damaged display, it is highly-unlikely that unexposed actinic material will underlie exposed actinic material in a device fabricated according to the invention. During the removal of the unexposed actinic material in the present fabrication process, the likelihood of unintentionally removing any exposed actinic material due to the presence of underlying unexposed actinic material is therefore likewise very low. Consequently, the likelihood of producing a damaged black matrix and, when the pattern created in the primary layer is also suitable to provide a spacer-constraining function, producing damaged or weak spacer-constraining features is very low in the invention.

The exposed actinic material is typically blackened. Segments of the masking layer not covered by the exposed actinic material are removed. As a result, openings extend substantially fully through the exposed actinic material. Light-emissive material is typically introduced into these openings. With the exposed actinic material being largely black, the exposed actinic material forms a black matrix for a light-emitting device, typically one used in a flat-panel CRT display.

The pattern of exposed actinic material can be arranged in various ways to establish features that receive and constrain spacers such as spacer walls. For example, the primary layer can be patterned so that portions of the exposed actinic material laterally separated along each spacer wall serve to constrain movement of the spacer walls. The exposed actinic portions which constrain spacer walls in this manner typically extend longitudinally at an angle, normally perpendicular, to the spacer walls. The area of the black matrix portions extending along the spacer walls and in front of them so as to prevent the spacer walls from being visible on the front of the light-emitting device can thereby be held to an amount just sufficient to perform the wall-hiding function. This advantageously enables the device to achieve a relatively high ratio of light-emitting area to total active area. Alternatively, the actinic layer can se patterned in such a manner that channels which serve to securely hold the spacer walls in place are formed with exposed actinic material that extends in a largely continuous manner along the spacer walls.

Incorporation of the spacer-constraining function into the pattern of exposed actinic material typically entails forming an auxiliary patterned layer over the first surface of the plate before providing the primary layer over the plate's first surface. The auxiliary patterned layer is divided into multiple laterally separated portions. The auxiliary layer can be formed before or after forming the masking layer, depending on the desired configuration of the spacer-constraining mechanisms. In either case, the mask formed with the above-mentioned portions of the masking layer also includes portions of the auxiliary patterned layer.

The auxiliary patterned layer typically consists of actinic material. However, the auxiliary layer is normally thinner than the primary layer of actinic material and typically underlies the spacers. Accordingly, the auxiliary patterned layer can be formed by a technique involving frontside exposure in which actinic radiation enters the auxiliary layer through its outer surface. Upon being processed so as to be dark, largely black, the exposed actinic material of the auxiliary layer forms part of the black matrix. In this way, the black matrix function is integrally combined with the spacer-constraining function.

In one light-emitting structure configured according to the invention, a plurality of laterally separated light-emissive regions are situated over a first surface of a plate having a second surface opposite the first surface. A patterned dark, largely black, region is situated over the plate's first surface so as to laterally surround each light-emissive region. The dark region is formed with multiple first strips extending laterally generally in one direction and multiple second strips extending laterally generally in another direction. The second strips extend further away from the plate's first surface than the first strips. Each second strip is divided into plural strip segments. The second strips cross the first strips in such a way that one segment of each second strip lies between each consecutive pair of first strips. Since the dark region is largely black, it serves as a black matrix for the light-emissive regions.

The light-emitting structure typically contains multiple spacers in the form of spacer walls. Each spacer wall is situated over a different one of the first strips. With the second strips extending further away from the plate's first surface than the first strips, the segments of the second strips laterally constrain the spacer walls. This can occur through an intermediate layer situated over the second strips and under the spacer walls. When the light-emitting structure contains a cathode that emits electrons which strike the light-emissive regions and cause them to emit light that produces an image on the plate's second surface, the intermediate layer is typically an anode layer that attracts so-emitted electrons to the light-emissive regions.

The second strips are typically created from an actinic layer selectively exposed to backside radiation in the inventive manner described above. An artifact of the backside exposure is that the segments of the second strips typically have length profiles roughly in the shape of upright trapezoids. Shrinkage that occurs during a blackening procedure in which the exposed actinic material is converted into the second strips can also cause the length profiles of the segments of the second strips to be roughly shaped like upright trapezoids.

Any spacer wall waviness, placement variation, and/or tilting which, in combination with this upward trapezoidal length profile, might possibly cause the spacer walls to be visible on the plate's second surface can be overcome by providing the first strips with slots into which the second strips extend. With a suitable depth being chosen for the slots, the extension of the segments of the second strips into the slots enables the second strips to constrain the lateral movement of the spacer walls to regions shadowed by the first strips and thereby prevents the spacer walls from being readily seen on the plate's second surface.

An important feature of the invention is that certain, sometimes all, of the strips of a black matrix of a light-emitting structure configured according to the invention have width profiles generally in the shape of upright trapezoids. As with the upright trapezoidal shape for the length profiles of the segments of the second strips in the light-emitting structure described in the previous four paragraphs, the upright trapezoidal shape for the strip width profiles is typically an artifact of the backside exposure and/or shrinkage during the strip blackening procedure. The upright trapezoidal shape for the strip width profile in the invention leads to a reduction in undesirable effects such as tenting in which the anode layer is displaced at certain locations from the black matrix. By reducing such effects, the display brightness is increased.

In short, the invention furnishes a black matrix that is unlikely to be formed in a damaged condition due to the presence of unexposed actinic material at undesired locations. Portions of the black matrix can also provide a spacer-constraining function. Due to the usage of backside exposure in creating the spacer-constraining features in the black matrix, the spacer-constraining features are all of largely the same strength. Importantly, the spacer-constraining mechanisms are relatively strong with the greatest strength occurring, as is highly desirable, where the spacer-constraining features are attached to the underlying body. The likelihood of producing damaged or weak spacer-constraining features is very low in the invention.

The black matrix is normally fabricated in a way that leads to enhanced brightness. The invention thus provides a substantial advance over the prior art.

BRIEF DESCRIPTION OF THE DRAWINGS

FIGS. 3*e*–3*k* represent steps in the remainder of this process variation.

Like reference symbols are employed in the drawings and in the description of the preferred embodiments to represent the same, or very similar, item or items.

DESCRIPTION OF THE PREFERRED EMBODIMENTS

Figure 1A:
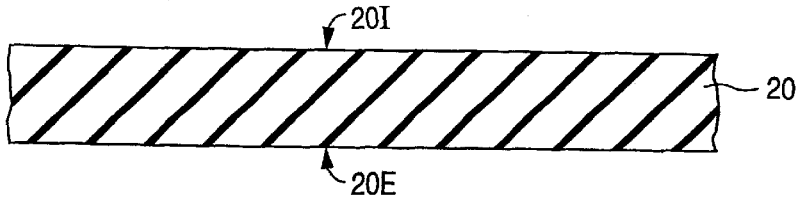
FIGS. 1*a*–1*n* are cross-sectional side views representing steps in a process that follows the invention's teachings for manufacturing a black matrix and light-emissive elements of a faceplate structure for a flat-panel CRT display.

The present invention combines a backside exposure lithographic technique with the use of a sacrificial, typically opaque, masking layer in producing a pattern of openings in a layer of actinic material. In lithographic terminology, a layer of material is "actinic" when the layer can be patterned by selectively exposing part of the layer to radiation that causes the exposed material to change chemical structure, typically by polymerization, and then developing the layer to remove either the exposed material or the unexposed material. The present invention normally employs negative-tone actinic material in which the material that remains after the development step is the exposed actinic material. Radiation, typically ultraviolet light, is referred to as "actinic" radiation to indicate that the radiation causes a change in the chemical structure of the exposed actinic material. The depth of exposure means the distance into the actinic material to which the actinic radiation causes the change in chemical structure, the depth of exposure being measured from the location where the radiation enters the actinic material.

As used here, the "profile" of a region means a vertical cross section through the region. The "height" of the profile is the maximum distance from the bottom of the profile to the top. The "width" profile of a strip-like region is a profile through a plane extending perpendicular to the length of the strip-like region and thus parallel to its width. The "length" profile of a strip-like is a profile taken through a plane extending along the strip-like region's length at a location passing through the mid-point of the bottom of the region's width.

Backside-exposed actinic material in the present invention is typically processed to form at least part of a black matrix for a faceplate structure of a flat-panel display such as a flat-panel television or a flat-panel video monitor for a personal computer, a lap-top computer, or a work station. The faceplate structure contains a plurality of light-emissive regions formed in conjunction with the black matrix. The light-emissive regions, normally phosphors, emit light upon being struck by electrons emitted from electron-emissive elements in the flat-panel display. The electron-emissive elements typically operate according to field-emission principles. Accordingly, the teachings of the invention are particularly useful in making a faceplate structure for a flat-panel CRT display of the field-emission type.

In the following description, the term "electrically insulating" (or "dielectric") generally applies to materials having a resistivity greater than $10^{10}$ ohm-cm. The term "electrically non-insulating"thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/pm.

Examples of electrically conductive materials (or electrical conductors) are metals, metal-semiconductor compounds (such as metal suicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

Figure 1B:
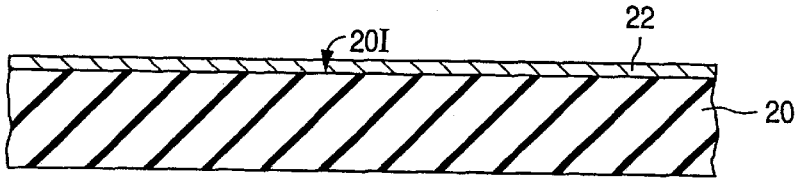
Figure 1C:
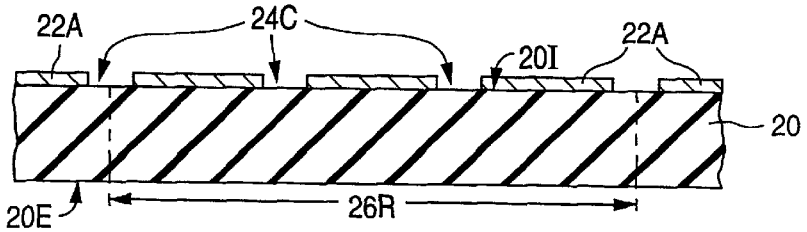
Figure 1D:
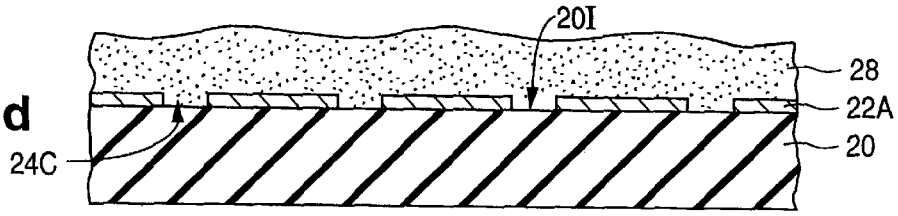
Figure 1E:
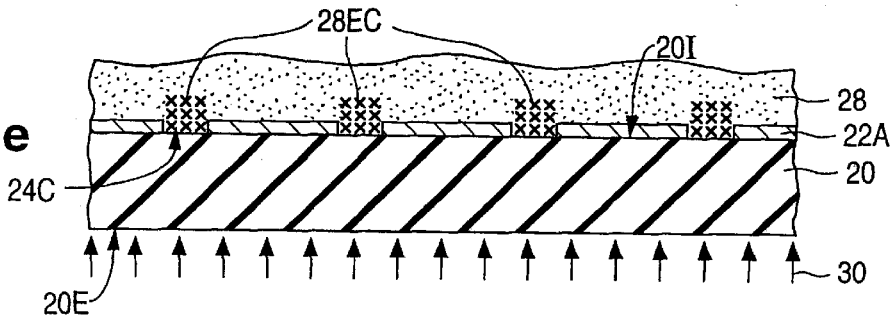
Figure 1F:
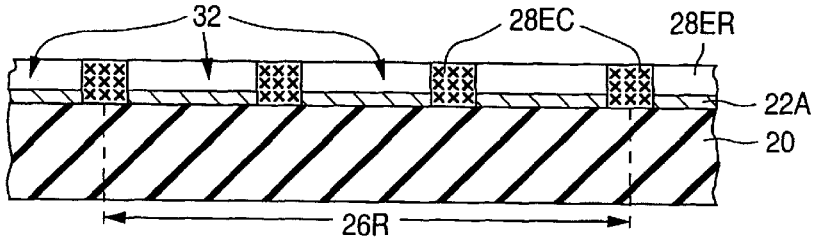
Figure 1G:
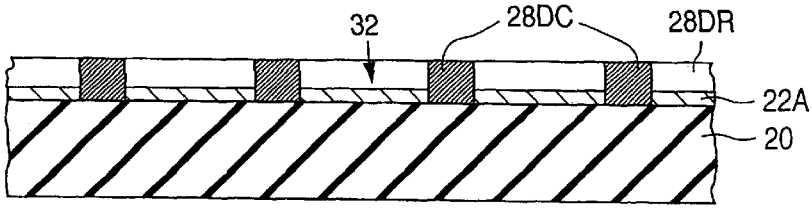
Figure 1H:
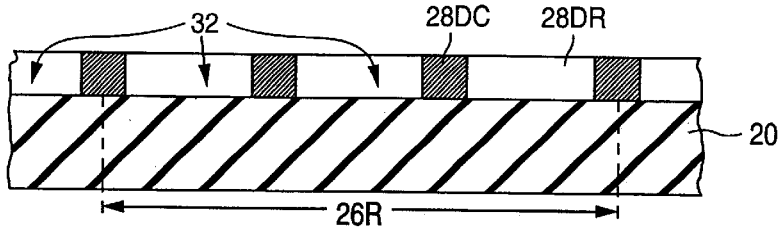
Figure 1I:
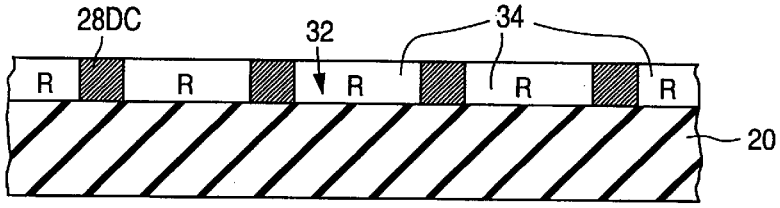
Figure 1J:
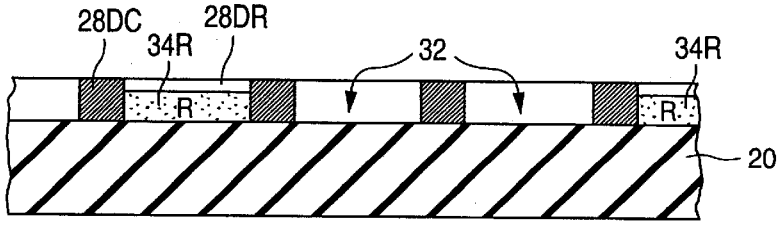
Figure 1K:
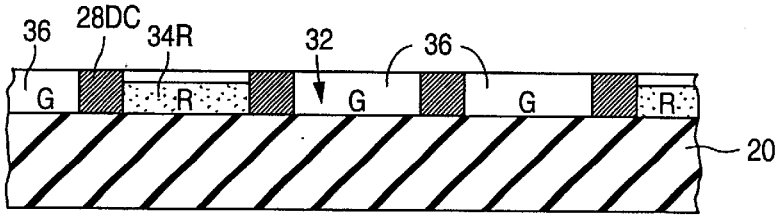
Figure 1L:
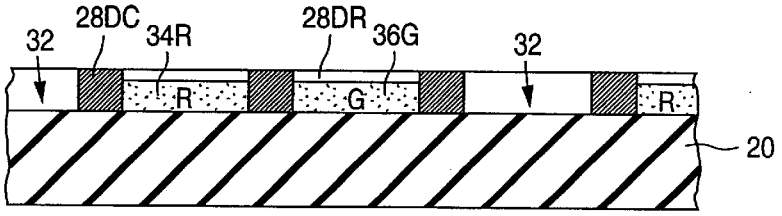
Figure 1M:
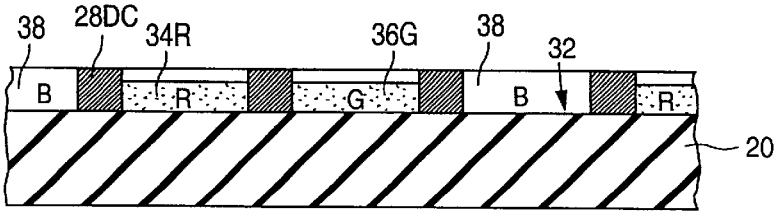
Figure 1N:
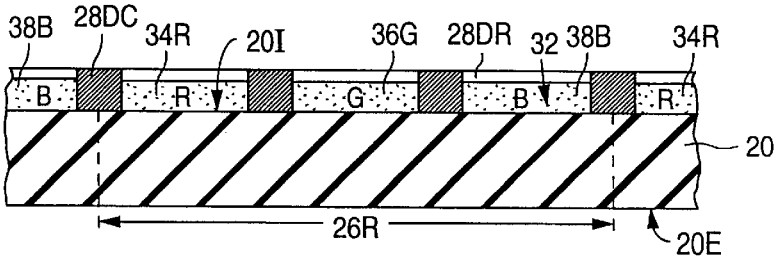

Referring to the drawings, FIGS. 1*a*–1*n* (collectively "FIG. 1") illustrate how a black matrix and light-emissive elements for a faceplate structure of a color flat-panel CRT display are fabricated in accordance with the invention. FIGS. 2*a*–2*e* (collectively "FIG. 2") illustrate the structure at certain of the stages depicted in FIG. 1.

The starting point for manufacturing the faceplate structure is a transparent electrically insulating faceplate 20 typically consisting of glass such as Schott D263 glass. See FIG. 1*a*. Faceplate 20 has a flat interior surface (or first surface) 20I and a flat exterior surface (or second surface) 20E extending largely parallel to interior surface 20I. The faceplate thickness, which is largely uniform from point to point, is in the range of 0.5–2 mm, typically 1 mm. In the final flat-panel display, exterior surface 20E provides the viewing surface on which an image is presented in the display's active area. The image can be seen directly on exterior surface 20E or through additional transparent structure formed over exterior surface 20E.

A blanket layer 22 of a patternable masking material is deposited on interior surface 20I of faceplate 20 to a substantially uniform thickness as shown in FIG. 1*b*. The masking material is of such characteristics and thickness as to block transmission of the actinic radiation later used in selectively exposing the actinic layer from which the black matrix is created. When the actinic radiation consists of UV light, the masking material is normally opaque. For this purpose, layer 22 typically consists of metal such as aluminum or chromium. For either of these metals, layer 22 is deposited to a thickness of 0.1–0.3 $\mu$m, typically 0.1 $\mu$m, according to a technique such as sputtering.

Blanket layer 22 is patterned in the manner described below. The patterned remainder of layer 22 serves as a sacrificial masking layer in defining the plan-view shape of the black matrix. The term "sacrificial" means that all, or a large portion, of the patterned remainder of layer 22 is eventually removed during the fabrication of the faceplate structure. In the fabrication process of FIGS. 1 and 2 where the black matrix is formed as a group of black row strips and a group of black column strips that intersect the row strips, layer 22 is patterned into a shape that matches the row and column strips.

Each row strip, or row guard band, of the eventual black matrix extends longitudinally in the direction along the lengths of the rows of picture elements (pixels) in the display. This direction is here termed the row direction. Each column strip, or column guard band, of the black matrix extends longitudinally perpendicular to the length of each row strip. The direction along the length of each column strip is the direction along the lengths of the columns of pixels in the display and, accordingly, is referred to here as the column direction.

The patterning of blanket layer 22 is initiated by forming a photoresist mask (not shown) on top of layer 22. The photoresist mask has an open space at the desired location of the row and column strips of the black matrix. Since the row and column strips intersect, the open space in the photoresist is one continuous opening arranged in rows and columns.

Figure 2A:
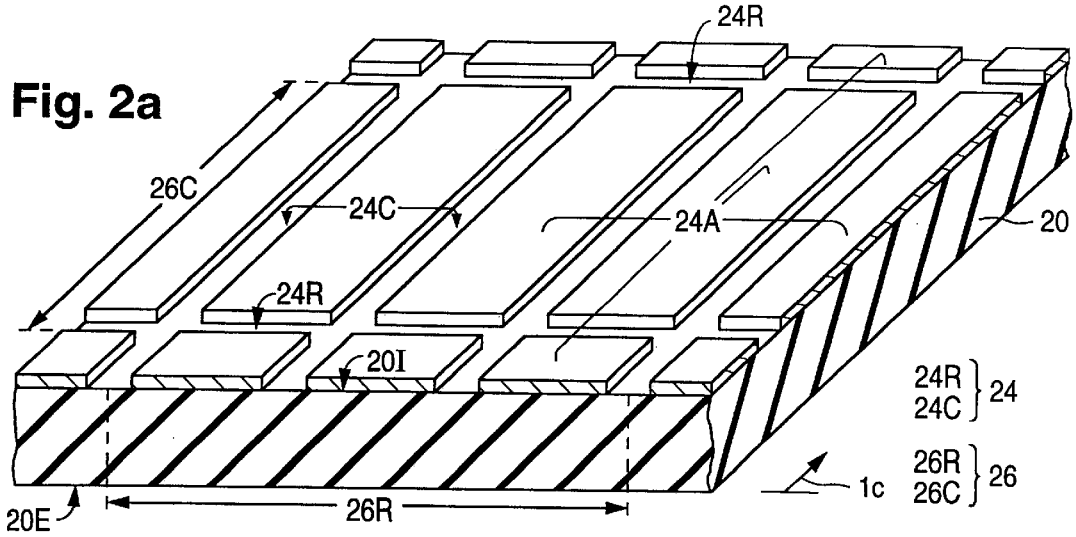
FIGS. 2*a*–2*e* are perspective views respectively corresponding to FIGS. 1*c*, 1*e*, 1*f*, 1*h*, and 1*n*. The horizontal lines from which slanted arrows 1*c*, 1*e*, 1*f*, 1*h*, and in originate in FIGS. 2*a*–2*e* respectively indicate where the cross sections of FIGS. 1*c*, 1*e*, 1*f*, 1*h*, and in are taken in FIGS. 2*a*–2*e*.

The material of blanket layer 22 exposed through the photoresist mask is removed. When layer 22 is formed-with chromium, the removal step is performed with an etchant such as a mixture of ceric ammonium nitrate, acetic acid, and water. The resultant structure appears as shown in FIGS. 1*c* and 2*a* after removal of the photoresist. The remainder of layer 22 consists of equal-width rectangular mask portions 22A laterally separated by open space 24 as particularly depicted in FIG. 2*a*. Open space 24 matches the open space in the now-removed photoresist and thus corresponds to the desired shape of the black matrix. Mask portions 22A constitute the sacrificial masking layer.

The row direction (again, the direction along the rows of pixels and thus the direction along the length of each row strip in the eventual black matrix) runs horizontally in FIGS. 1 and 2. The column direction (again, the direction along the columns of pixels and thus the direction along the length of each column strip in the black matrix) extends perpendicular to the plane of each of FIGS. 1*a*–1*n*. In FIGS. 2*a*–2*e*, the column direction is indicated by the slanted arrows in the lower right-hand corners of FIGS. 2*a*–2*e*.

With the foregoing in mind, open space 24 consists of equal-width row openings 24R and equal-width column openings 24C that intersect row openings 24R. Each row opening 24R extends in the row direction. Row openings 24R, situated at the locations of the row strips of the black matrix, each have a width of 10–100 $\mu$m, typically 50 $\mu$m. Although row openings 24R are needed in the process of FIGS. 1 and 2, openings 24R can be deleted in other processes described below for fabricating a faceplate structure of a color flat-panel CRT display. Each column opening 24C extends in the column direction. Column openings 24C, situated at the locations of the column strips of the black matrix, each have a width of 10–50 $\mu$m, typically 20 $\mu$m.

Each mask portion 22A can be longer in the column direction than in the row direction, or vice versa. FIG. 2*a* illustrates an example in which mask portions 22A are longer in the column direction than in the row direction. This arises because the pixels in the color display are largely square with each pixel being divided into three parallel rectangular sub-pixels containing phosphors that respectively emit light of three different colors, normally red, green, and blue, upon being struck by sufficiently energetic electrons. In the example of FIG. 2*a*, the sub-pixels are organized so that they are longer in the column direction than in the row direction.

Specifically, FIG. 2*a* illustrates a typical square color pixel 26 of dimension 26R in the row direction and of dimension 26C in the column direction. Each of dimensions 26R and 26C is at least 15 $\mu$m, typically 300 $\mu$m. Each pixel 26 contains three mask portions 22A for respectively defining three sub-pixels. For the above-mentioned widths of openings 24R and 24C and the above-mentioned values of pixel dimensions 26R and 26C, each mask portion 22A is typically 250 $\mu$m in length and at least 5 $\mu$m, typically 80 $\mu$m, in width.

A primary blanket layer 28 of negative-tone actinic material is formed on top of mask portions 22A and into open space 24. FIG. 1*d* illustrates the formation of primary actinic layer 28 on mask portions 22A and into column openings 24C of open space 24. Actinic layer 28 is created by depositing, spinning, and soft baking the actinic material. Actinic layer 28 typically consists of photo-polymerizable polyimide. The average thickness of layer 28 is 2–100 $\mu$m, typically 50 $\mu$m. The thickness of layer 28 can vary appreciably from point to point as indicated in FIG. 1*d*.

Primary actinic layer 28 is to be transformed into the black matrix. The transformation process is initiated with the backside exposure step depicted in FIGS. 1*e* and 2*b*. To simply the illustration, the variation in thickness of layer 28 is not shown in FIG. 2*b*.

The backside exposure consists of selectively exposing actinic layer 28 to backside actinic radiation through a mask formed with mask portions 22A. When layer 28 consists of polyimide, backside radiation 30 is typically UV light that causes the exposed polyimide to polymerize.

Backside radiation 30 impinges perpendicularly on exterior surface 20E of faceplate 20 and passes through faceplate 20 traveling from exterior surface 20E to interior surface 20I. The mask formed with mask portions 22A blocks the portions of radiation 30 that impinge on mask portions 22A. The remainder of radiation 30 passes into open space 24 and causes overlying exposed material 28E of primary actinic layer 28 to change chemical structure. Item 28P in FIG. 2*b* indicates the plan-view pattern of exposed primary material 28E. Since open space 24 consists of row openings 24R and column openings 24C, exposed primary material 28E consists of equal-width row strips 28ER and equal-width column strips 28EC that intersect row strips 28ER in the manner depicted in FIG. 2*b*.

Figure 2B:
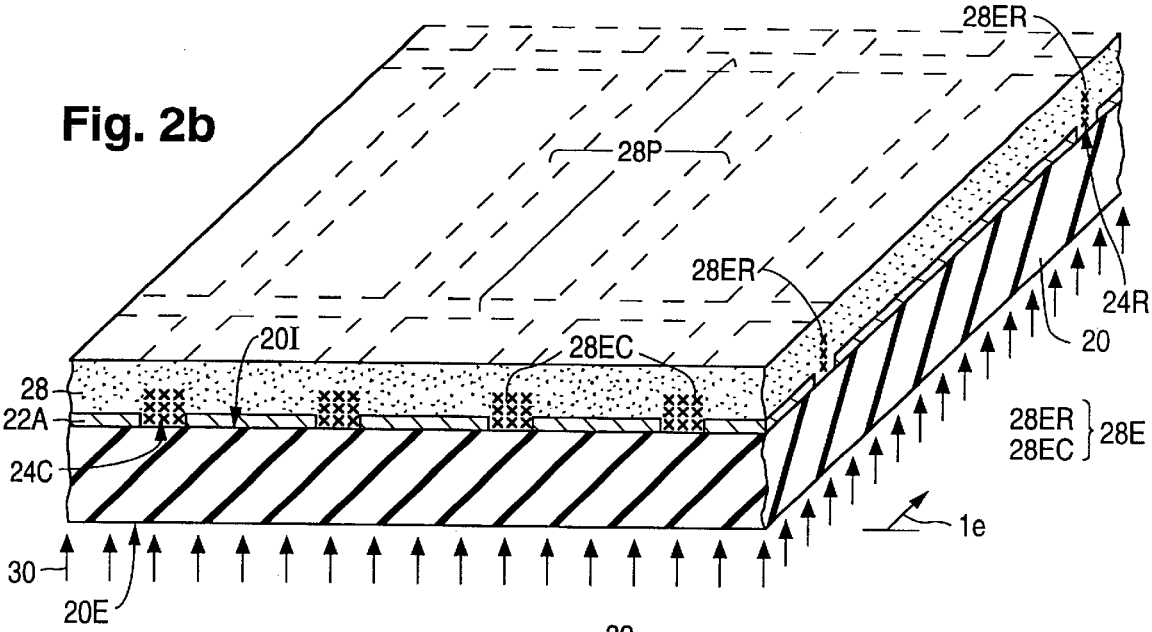

The exposure step is performed in such a way that the depth of exposure of backside radiation 30 (i.e., the vertical distance, measured from interior surface 20I into primary actinic layer 28, to which radiation 30 causes the actinic material to change chemical structure) is not significantly greater than the minimum thickness of primary actinic layer 28. Accordingly, unexposed material of primary layer 28 is normally situated at various locations above exposed primary material 28E. The distance at which this unexposed actinic material is located above interior surface 20I is greater than the exposure depth of radiation 30. The radiation's exposure depth is normally less than the minimum thickness of layer 28. FIGS. 1*e* and 2*b* illustrate this exemplary situation in which unexposed actinic material overlies all of exposed primary material 28E.

Importantly, substantially no unexposed (or underexposed) material of layer 28 lies between faceplate 20 and exposed primary material 28E. Because backside radiation 30 enters actinic layer 28 through interior faceplate surface 20I, the extent of polymerization, as measured by the density of polymer cross-links, is greatest along interior surface 20I. This enables exposed primary material 28E to adhere strongly to faceplate 20, especially since it consists of glass.

The exposure with backside radiation 30 is performed in a largely uniform manner across the area of faceplate 20. Hence, the width profile (i.e., the shape of a vertical cross section in a plane perpendicular to the length) of each column strip 28EC is largely the same along the length of that column strip 28EC and from one column strip 28EC to another column strip 28EC. For simplicity, FIGS. 1*e* and 2*b* illustrate the width profiles of column strips 28EC as being generally rectangular. The width profile of each column strip 28EC is normally roughly in the shape of an upright isosceles trapezoid—i.e., an isosceles trapezoid whose base extends parallel to, and is longer than, the trapezoid's top side. Also, the side-edge corners and the upper-edge corners of column strips 28EC are actually rounded.

Similar comments apply to row strips 28ER. The width profile of each row strip 28ER is largely the same along the length of that row strip 28ER and from one row-strip 28ER to another row strip 28ER. The width profile of row strips 28ER is normally in the rough shape of an upright isosceles trapezoid with rounded side-edge and upper-edge corners.

In any event, the height of the width profile (i.e., the maximum distance from the bottom of the profile to its top side) of each row strip 28ER is largely the same along the length of that row strip 28ER and from row strip 28ER to another. The same applies to column strips 28EC. Also, the height of the width profile of row strips 28ER is largely the same as the height of the width profile of column strips 28EC even though row strips 28ER may be of different bottom width than column strips 28EC. The uniformity in height of the width profiles of strips 28EC and 28ER is achieved despite variations in the original thickness of primary actinic layer 28.

Figure 2C:
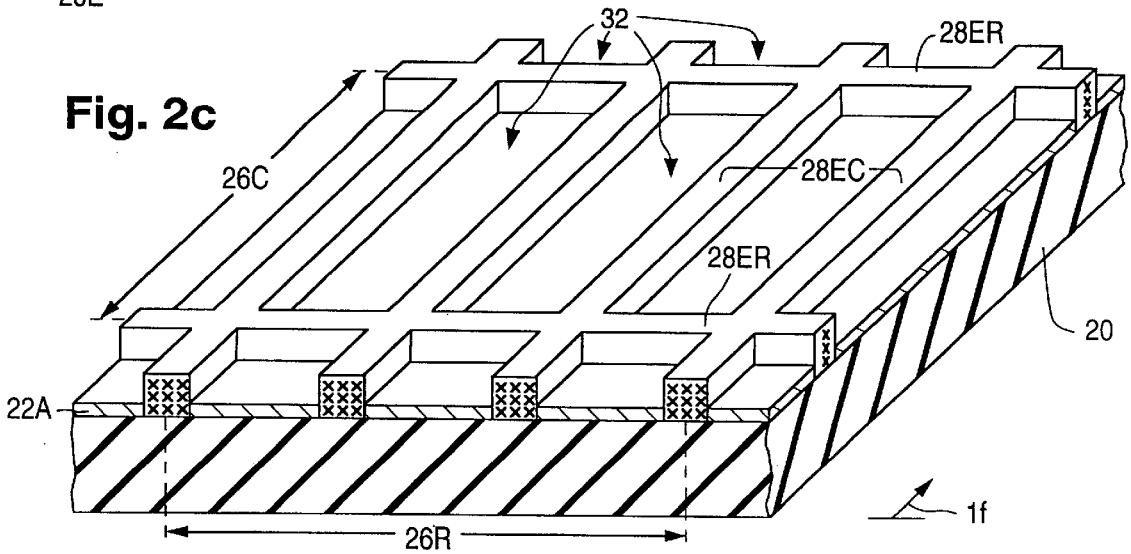

The unexposed material of primary layer 28 is removed with a developer to produce the structure generally shown in FIGS. 1*f* and 2*c*. The simplified rectangular shape of the width profiles of strips 28ER and 28EC is clearly seen in FIGS. 1*f* and 2*c*. The rounding of the side-edge and upper-edge corners has not been depicted in FIGS. 1*f* and 2*c* in order to is simplify the illustration.

Figure 2D:
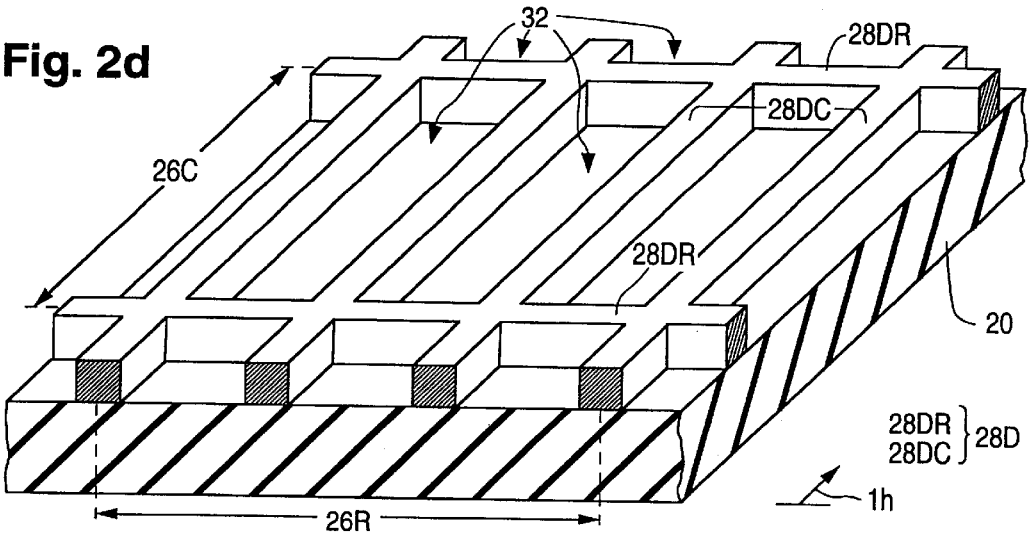
Figure 2E:
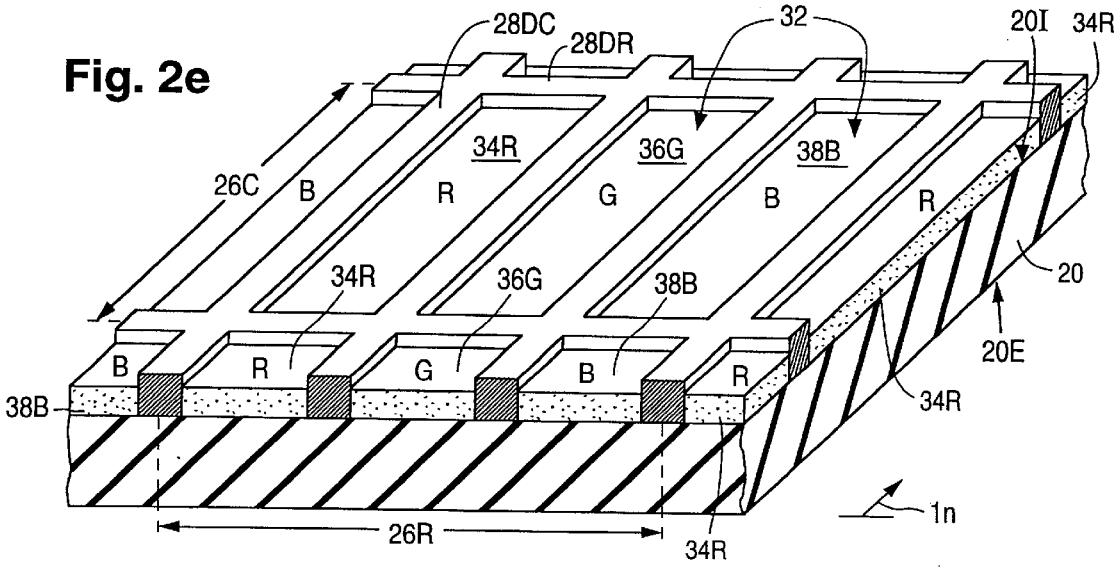

Items 32 in FIGS. 1*f* and 2*d* indicate the rectangular column openings (or channels) produced in actinic layer 28 during the development operation. Column openings 32 are thus situated to the sides of strips 28ER and 28EC. Because the backside exposure technique largely eliminates the possibility of leaving any significant amount of unexposed actinic material between exposed primary material 28E and faceplate 20, the likelihood of having any part of exposed material 28E separate from faceplate 20 during the development step is very low.

Also, the developer attacks primary layer 28 the least at locations where the changes in chemical structure caused by the exposure to backside radiation 30 are the greatest. Since the greatest changes in the chemical structure—i.e., the greatest extent of polymerization in terms of the highest density of polymer cross-links—of actinic layer 28 occur where exposed primary material 28E meets faceplate 20 due to the use of the backside exposure, the exposed material directly adjacent to faceplate 20 is eroded the least by the developer and thus is the strongest. This is precisely where it is desirable that row strips 28ER and column strips 28EC be the strongest. Hence, the combination of the backside exposure and the subsequent development step results in strips 28ER and 28EC having largely uniform width-profile heights and highly desirable strength characteristics while substantially avoiding any removal of exposed primary material 28E during the development operation.

A black matrix is dark, largely black. At the end of the development step, row strips 28ER and column strips 28EC are normally not dark enough to serve as a black matrix. Accordingly, strips 28ER and 28EC are suitably blackened to form black matrix 28D consisting of black row stripes 28DR and black column stripes 28DC that intersect row strips 28DR. See FIG. 1*g*. When primary material 28E consists of exposed (photo-polymerized) polyimide, the blackening process is performed by pyrolizing (thermally blackening) the polyimide.

Some shrinkage occurs during pyrolysis of exposed (i.e., polymerized) photo-polymerizable polyimide. In the pyrolysis employed to convert strips 28ER and 28EC into black strips 28DR and 28DC, the percent shrinkage generally increases in going from the bottoms of strips 28ER and 28EC to their top sides. Since the width profiles of strips 28ER and 28DC are actually in the rough shape of upright isosceles trapezoids, the shrinkage tends to accentuate the upright isosceles trapezoidal shape of the strip width profiles. In other words, the percentage reduction in the length of the top side of each upright isosceles trapezoid is greater than the percentage reduction in the length of the base of the trapezoid. The shrinkage includes a reduction in thickness, typically by 40–60%. For simplicity, the shrinkage is not shown in the drawings.

Mask portions 22A are removed to produce the structure shown in FIGS. 1*h* and 2*d*. In so doing, openings 32 are extended down to faceplate 20 and now extend fully along the longitudinal sides of black matrix strips 28DR and 28DC. With the removal of mask portions 22A, all of the sacrificial masking layer is removed from the structure.

Each pixel 26 contains three rectangular openings 32 that respectively define a red ("R") sub-pixel, a green ("G") sub-pixel, and a blue ("B") sub-pixel. Openings 32 are appropriately provided with light-emissive material that emits red, green, and blue light upon being struck by sufficiently energetic electrons. The light-emissive material consists of phosphor. In each pixel 26, a first specified one of openings 32 receives red-emitting phosphor, while a second specified one of openings 32 receives green-emitting phosphor. The remaining opening 32 in each pixel 26 receives blue-emitting phosphor.

In the exemplary process of FIGS. 1 and 2, the introduction of red-emitting, green-emitting, and blue-emitting phosphors into openings 32 is initiated by depositing a slurry of red-emitting phosphor material on top of the structure so as to substantially fill openings 32. Using a doctor blade, the red-emitting phosphor material that extends above black matrix 28D is removed to produce the structure depicted in FIG. 1*i*. Red-emitting phosphor material 34 now fills openings 32. Red-emitting phosphor 34 is dried.

Red-emitting phosphor 34 in the left-most opening 32 of each pixel 26 is cured by exposing that phosphor material 34 to backside UV light—i.e. UV light that passes through faceplate 20 traveling from exterior surface 20E to interior surface 20I. The backside phosphor exposure is performed through a suitable photomask (not shown) positioned under faceplate 20. Light-blocking areas in the photomask are situated opposite the two other openings 32 in each pixel 26 and prevent the UV light from entering those two openings 32. The backside UV light typically penetrates only partially through red-emitting phosphor 34 in the left-most opening 32 of each pixel 26. Some unexposed red-emitting phosphor 34 is then present at the top of the left-most opening 32.

The unexposed portions of red-emitting phosphor 34 in the remaining two openings 32 of each pixel 26 are removed with a suitable developer, typically water. Any unexposed red-emitting phosphor 34 at the top of the left-most opening 32 is simultaneously removed with the developer. This leads to the structure of FIG. 1*j* in which item 34R in the left-most opening 32 of pixel 26 is the exposed remainder of dried red-emitting phosphor 34. The thickness of red-emitting phosphor 34R depends on the backside UV exposure conditions.

The process for creating red-emitting phosphor 34R in the left-most opening 32 of each pixel 26 is now repeated with green-emitting and blue-emitting phosphor material for the center and right-most openings 32 of each pixel 26. In particular, a slurry or green-emitting phosphor material is deposited on top of the structure to substantially fill openings 32 to the extent that they do not already contain red-emitting phosphor 34R. The green-emitting phosphor extending above black matrix 28D is removed with a doctor blade to produce the structure of FIG. 1*k*. Green-emitting phosphor 36 now fills the center and right-most openings 32 in each pixel 26 and covers red-emitting phosphor 34R in the left-most opening 32. Green-emitting phosphor 36 is dried.

Green emitting phosphor 36 in the center opening 32 of each pixel 26 is cured by exposing phosphor material 36 in center opening 32 to backside UV light through a photomask (not shown) positioned below faceplate 20. The photomask has light-blocking areas situated opposite the two other openings 32 in each pixel 26. By arranging for the backside UV light to penetrate only partially through phosphor material 36 in center opening 32, some unexposed green-emitting phosphor 36 is present at the top of center opening 32.

The unexposed portions of green-emitting phosphor 36 in the left-most and right-most openings 32 in each pixel 26 are removed, along with any unexposed green-emitting phosphor 36 at the top of center opening 32. The unexposed green-emitting phosphor removal step is performed with a suitable developer, again typically water. See FIG. 1*l* in which item 36G in the center opening 32 of each pixel 26 is the exposed remainder of dried green-emitting phosphor 36.

Next, a slurry of blue-emitting phosphor is deposited on top of the structure to substantially fill openings 32 to the extent that they do not already contain red-emitting phosphor 34R and green-emitting phosphor 36G. The blue-emitting phosphor that extends above black matrix 28D is removed with a doctor blade. See FIG. 1*m*. Blue-emitting phosphor 38 now fills the right-most opening 32 in each pixel 26 and covers red-emitting phosphor 34R and green-emitting phosphor 36G in the other two openings 32 in that pixel 26. Blue-emitting phosphor 38 is dried.

Blue-emitting phosphor 38 in the right-most opening 32 of each pixel 26 is cured by exposing that phosphor material 38 to backside UV light through a photomask (not shown) positioned under faceplate 20. The photomask has light-blocking areas situated opposite the two other openings 32 in each pixel 26. By similarly arranging for the backside UV light to penetrate only partially through phosphor material 38 in the right-most opening 32, some unexposed blue-emitting phosphor 38 is present at the top of the right-most opening 32.

The unexposed portions of blue-emitting phosphor 38 in the other two openings 32 of each pixel 26 are removed, along with any unexposed blue-emitting phosphor 38 at the top of the right-most opening 32. The unexposed blue-emitting phosphor removal is performed with a developer, likewise again typically water, to produce the structure of FIGS. 1*n* and 2*e*. Item 38B in the right-most opening 32 of pixel 26 is the exposed remainder of dried blue-emitting phosphor 38.

Red-emitting phosphor region 34R, green-emitting phosphor region 36G, and blue-emitting phosphor region 38B in each pixel 26 now establish three different color sub-pixels for that pixel 26. Black matrix 28D laterally surrounds each of color sub-pixels 34R, 36G, and 38D, thereby laterally separating color sub-pixels 34R, 36G, and 38D from one another in each pixel 26 and from sub-pixels 34R, 36G, and 38D in other pixels 26.

The order in which phosphor color sub-pixels 34R, 36G, and 38B are formed can be modified. Subject to each pixel 26 having one red-emitting phosphor sub-pixel 34R, one green-emitting sub-pixel 36G, and one blue-emitting sub-pixel 38B, the allocation of red-emitting phosphor region 34R, green-emitting phosphor region 36G, and blue-emitting phosphor region 38B to the three openings 32 in each pixel 26 can be varied from what is described in the steps of FIGS. 1*i*–1*n*.

A blanket layer of light-reflective electrically non-insulating material, typically a metal such as aluminum, is formed on top of the structure so as to overlie phosphor regions 34R, 36G, and 38B. The procedure for forming the blanket light-reflective non-insulating layer is described in more detail below in conjunction with FIGS. 16*a* and 16*b*. The light-reflective non-insulating layer serves as an anode for the flat-panel display. The light-reflective anode layer is sufficiently thin that electrons emitted by electron-emissive elements in the cathode of a baseplate structure situated opposite the faceplate structure can pass through the anode layer and cause phosphor regions 34R, 36G, and 38B to emit light that produces an image on exterior surface 20E of faceplate 20. In addition to serving as the anode, the anode layer enhances the display brightness by reflecting back some of the rear-directed light emitted by sub-pixels 34R, 36G, and 38B.

Black matrix 28D does not have any features particularly suitable for laterally constraining the movement of spacers, such as spacer walls, that are inserted between the faceplate structure and the baseplate structure to resist external forces applied to the flat-panel display and to maintain a largely uniform spacing between the two plate structures. Accordingly, black matrix 28D is typically employed in a flat-panel display that does not utilize spacers to resist external forces and/or maintain a uniform faceplate-structure-to-baseplate-structure spacing. Slusarczuk et al, U.S. patent application Ser. No. 08/777,914, filed Dec. 23, 1996, now U.S. Pat. No. 5,964,630, describes an example of a flat-panel field-emission CRT display suitable for a faceplate structure containing black matrix 28D. The content's of Ser. No. 08/777,914 are incorporated by reference herein. When black matrix 28D is utilized in such a display, the image presented on exterior surface 20E of faceplate 20 is further presented on the exterior surface of a transparent support structure attached to faceplate 20 along exterior surface 20E.

Features for constraining the movement of spacers, especially spacer walls, can be incorporated into the black matrix of a flat-panel display by creating the black matrix from two actinic layers processed according to the invention's teachings. The two actinic layers are referred to here as the primary and auxiliary layers. The primary actinic layer, which generally corresponds to primary actinic layer 28 in the process of FIGS. 1 and 2, is patterned by a procedure that involves backside radiation exposure. The auxiliary actinic layer is patterned according to a procedure that typically involves frontside radiation exposure. The auxiliary layer is normally formed and patterned before forming and patterning the primary layer.

FIGS. 3*a*–3*k* (collectively "FIG. 3") illustrate how a black matrix, light-emissive elements, and a light-reflective anode for a faceplate structure of a color flat-panel CRT display are fabricated in accordance with the invention to provide the black matrix with features (or mechanisms) for constraining spacers in the form of spacer walls. FIGS. 4*a*–4*f* (collectively "FIG. 4") illustrate the structure at certain of the stages depicted in FIG. 3. In the fabrication process of FIGS. 3 and 4, the black matrix again consists of a group of black rows strips and a group of black column strips that intersect the row strips. To provide the black matrix with the capability for constraining spacer walls, the black row strips in the process of FIGS. 3 and 4 are created from a different actinic layer than the black column strips.

The starting point for the process of FIGS. 3 and 4 is the structure of FIGS. 1*c* and 2*a*. FIG. 1*c* is, for convenience, repeated here as FIG. 3*a*. Faceplate 20, mask portions 22A, and open space 24 (again consisting of row openings 24R and column openings 24C) in the process of FIGS. 3 and 4 have the characteristics described above for the process of FIGS. 1 and 2, except that row openings 24R can be deleted. That is, the lower limit for the width of openings 24R is zero. In this case, mask portions 22A become continuous parallel strips extending in the column direction fully across the display's active area.

Mask portions 22A again-form a sacrificial masking layer. As discussed below and in contrast to what occurs in the process of FIGS. 1 and 2, small segments of mask portions 22A are present in the final flat-panel display manufactured according to the process of FIGS. 3 and 4. Permitting these small segments of mask portions 22A to be present in the final display facilitates display manufacture by avoiding tight alignment tolerances that would otherwise be needed if the width of row openings 24R were to be substantially equal to the width of the later-formed black row strips so that each row strip fully extends into a corresponding one of row openings 24R. If desired, these sacrificial masking segments can be made black and non-reflective of light.

Figure 3A:
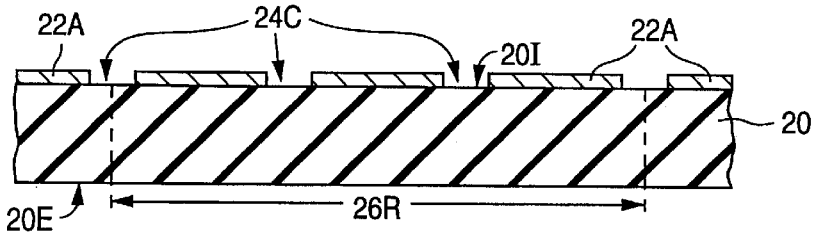
FIGS. 3*a*–3*k* are cross-sectional side views representing steps in a process that follows the invention's teachings for manufacturing a spacer-constraining black matrix, light-emissive elements, and a light-reflective anode of a faceplate structure for a flat-panel CRT display.
Figure 3B:
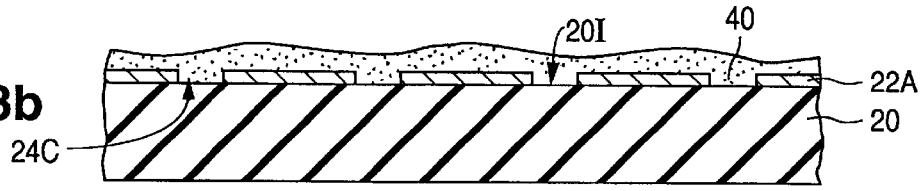

An auxiliary blanket layer 40 of negative-tone actinic material is formed on top of mask portions 22A and into open space 24 as depicted in FIG. 3*b*. The formation of auxiliary actinic layer 40 is accomplished by depositing, spinning, and soft baking the actinic material. Actinic layer 40 typically consists of photo-polymerizable polyimide. When the polyimide is Olin OCG7020 polyimide, the spinning is done at 200–500 rpm, typically 500 rpm, for 5–60 sec., typically 30 sec. The soft baking is done for 20–40 min., typically 30 min., at 70–105° C., typically 100° C.

Actinic layer 40 is sufficiently thin that the actinic radiation employed to expose portions of layer 40 can readily exceed its maximum thickness. Subject to this limitation, the average thickness of layer 40 is 40–60 $\mu$m, typically 50 $\mu$m. The thickness of layer 40 can vary somewhat from point to point as indicated in FIG. 3*b*.

Auxiliary actinic layer 40 is to be transformed into row strips of the black matrix. The transformation process is initiated with the frontside exposure step depicted in FIGS. 3*c* and 4*a*. To simplify the illustration, the variation in thickness of layer 40 is not shown in FIG. 4*a*.

Figure 4A:
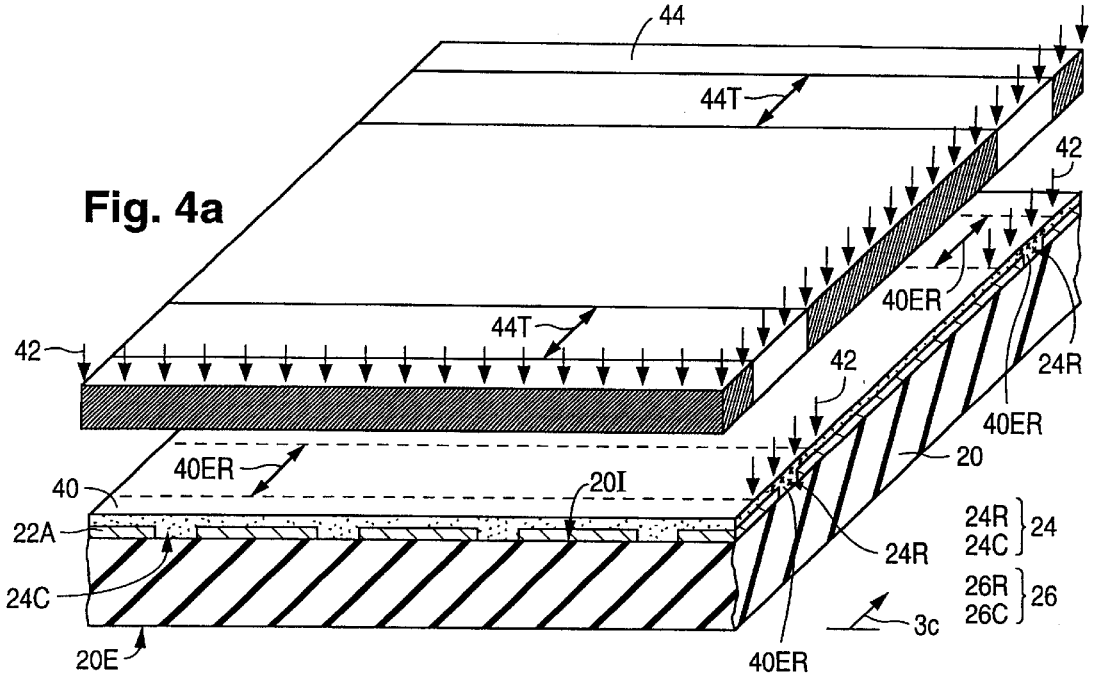
FIGS. 4*a*–4*f* are perspective views respectively corresponding to FIGS. 3*c*, 3*d*, 3*f*, 3*g*, 3*i*, and 3*j*. The horizontal lines from which slanted arrows 3*c*, 3*d*, 3*f*, 3*g*, 3*i*, and 3*j* originate in FIGS. 4*a*–4*f* respectively indicate where the cross sections of FIGS. 3*c*, 3*d*, 3*f*, 3*g*, 3*i*, and 3*j* are taken in FIGS. 3*a*–3*k*.

The frontside exposure consists of selectively exposing actinic layer 40 to frontside actinic radiation 42 through a photomask (reticle) 44. The depth of exposure of frontside radiation 42 is greater than the maximum thickness of layer 40. As indicated in FIG. 4*a*, portions of radiation 42 pass through radiation-transparent mask area 44T and cause underlying exposed equal-width row strips 40ER of actinic layer 40 to change chemical structure. When layer 40 consists of photo-polymerizable polyimide, radiation 42 is typically UV light that causes the exposed polyimide to polymerize. In the case of Olin OCG7020 polyimide, the frontside exposure is performed at an exposure energy dosage of 250 mJ/cm$^2$ with UV light having a wavelength of 405 nm.

Row strips 40ER extend in the row direction. Each row strip 40ER is centered width-wise on a corresponding one of row openings 24R. Row strips 40ER are also wider than row openings 24R. Accordingly, each-row strip 40ER fills corresponding row opening 24R and extends laterally over the directly adjacent mask portions 22A. The width of row strips 40ER is 20–120 μm, typically 70 μm.

Figure 3C:
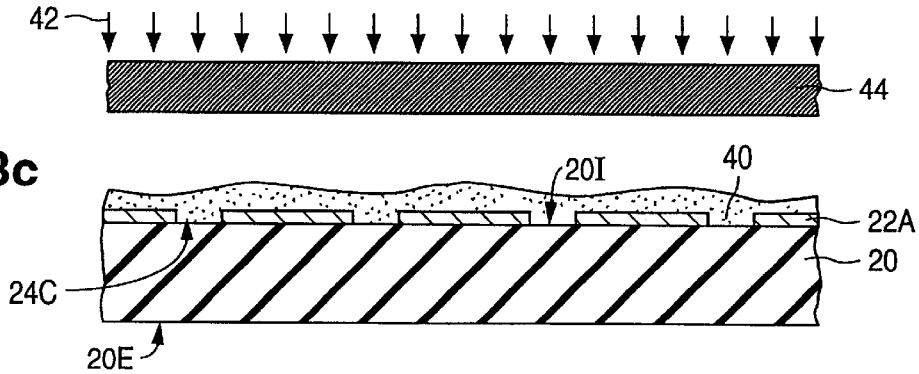
Figure 3D:
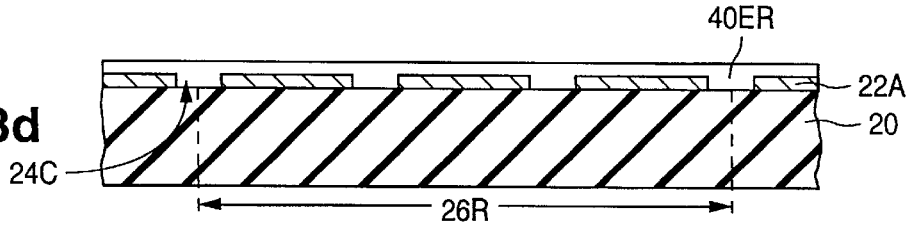
Figure 4B:
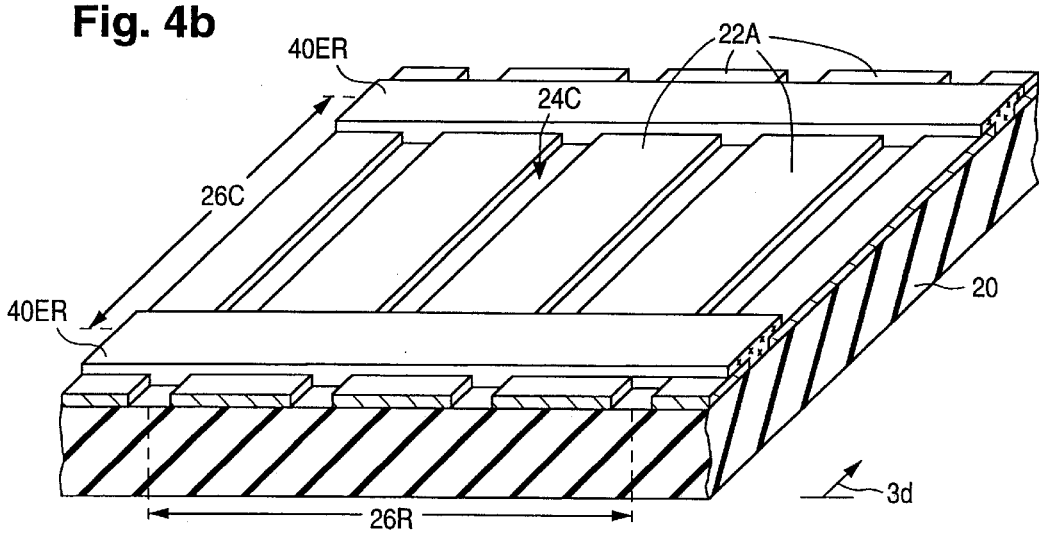
Figure 4C:
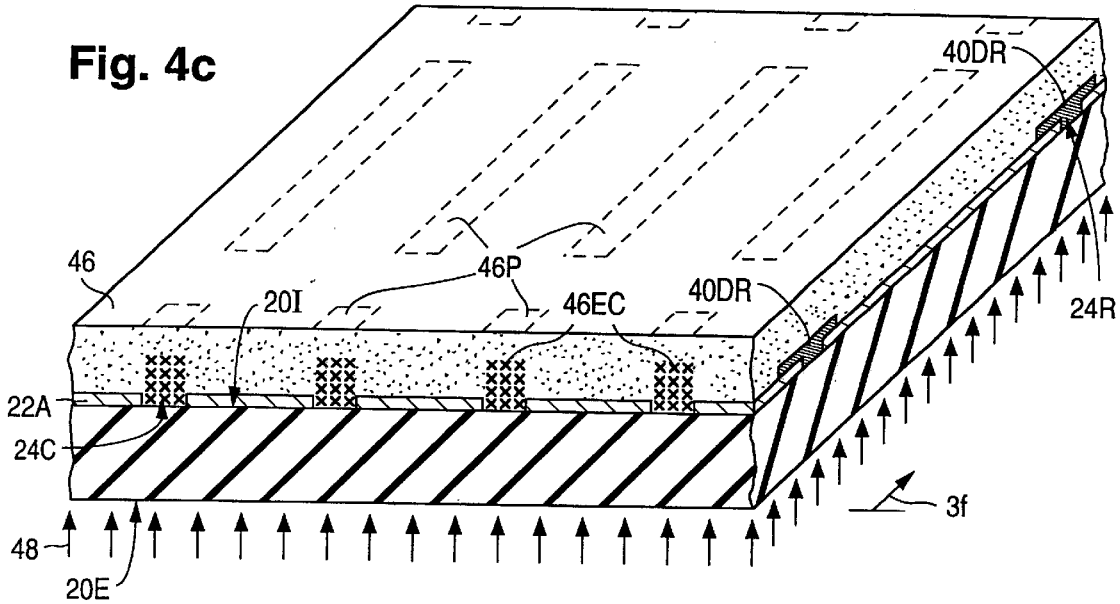

The unexposed material of auxiliary layer 40 is removed with a developer. FIGS. 3*d* and 4*b* illustrate the resulting structure, except that the variation in thickness of row strips 40ER is not shown. When layer 40 is formed with Olin OCG7020 polyimide, the developer typically consists of n-butyl acetate and xylene.

Row strips 40ER are normally not dark enough for usage in a black matrix. Hence, strips 40ER are suitably blackened to form black matrix row strips 40DR, first shown in FIG. 4*c*. When strips 40ER consist of exposed (photo-polymerized) polyimide, the blackening process is performed by pyrolizing the polyimide. In the case of Olin OCG7020 polyimide, the pyrolysis is done by baking in a nitrogen atmosphere for 1 hr. at 400° C. In addition to being suitable for black matrix usage, black row strips 40DR are capable of blocking actinic radiation in the form of UV light.

While the thickness of black row strips 40DR may vary somewhat from point to point, some or all of row strips 40DR are later to be covered by spacer walls. Also, strips 40DR are relatively thin compared to the column row strips discussed below. Accordingly, the magnitude of the thickness variation in strips 40DR is relatively small. For these reasons, the variation in thickness of strips 40DR is normally not detrimental to the operation of the flat-panel display. Inconsequential shrinkage, including thickness reduction, produced in strips 40DR during the pyrolysis is not shown in the drawings.

Figure 3E:
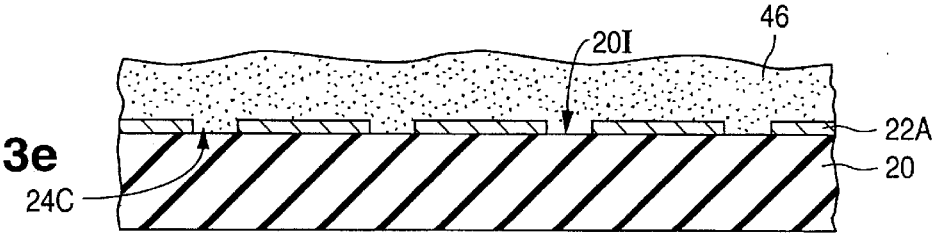
Figure 3F:
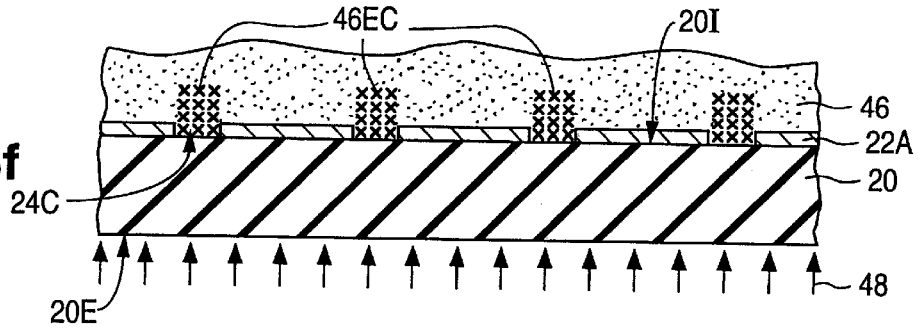

A primary blanket layer 46 of negative-tone actinic material is formed on top of the structure—i.e., on black row strips 40DR, on the uncovered segments of mask portions 22A, and into column openings 24C—as shown in FIG. 3*e*. The formation of primary actinic layer 46 is accomplished by depositing, spinning, and soft baking the actinic material. Actinic layer 46 typically consists of photo-polymerizable polyimide. When layer 46 is formed with Olin OCG7020 polyimide, the spinning is done at 250–500 rpm, typically 250 rpm, for 5–60 sec., typically 30 sec. The soft baking is done for 20–40 min., typically 30 min., at 70–105° C., typically 100° C.

The average thickness of actinic layer 46 is 50–200 μm, typically 100 μm. Consequently, primary actinic layer 46 is considerably thicker than auxiliary actinic layer 40. In particular, the thickness of layer 46 is sufficiently great that portions of layer 46 can be configured to laterally constrain spacer walls without having the walls slip out of the wall-constraining features. The thickness of layer 46 can vary appreciably from point to point as indicated in FIG. 3*e*.

Primary actinic layer 46 is to be transformed into column strips of the black matrix. The transformation process is initiated with the backside exposure step depicted in FIGS. 3*f* and 4*c*. To simplify the illustration, the variation in thickness of layer 46 is not depicted in FIG. 4*c*.

The backside exposure consists of selectively exposing actinic layer 46 to backside actinic radiation 48 through a mask formed with mask portions 22A and black row strips 40DR. Similar to backside actinic radiation 30 in the process of FIGS. 1 and 2, backside actinic radiation 48 impinges perpendicularly on exterior surface 20E of faceplate 20 and passes through faceplate 20 traveling from exterior surface 20E to interior surface 20I. The mask formed with mask portions 22A and black row strips 40DR blocks the portion of backside radiation 48 impinging on portions 22A and strips 40DR. The remainder of radiation 48 passes into column openings 24C and causes overlying exposed equal-width column strips 46EC of actinic layer 46 to change chemical structure. Item 46P in FIG. 4*c* indicates the plan-view pattern of column strips 46EC. Due to the presence of black row strips 40DR, each column strip 46EC consists of a group of column segments laterally separated in the column direction.

The backside exposure operation in the process of FIGS. 3 and 4 is performed in such a way that the depth of exposure of backside radiation 48 is not significantly greater than the minimum thickness of primary actinic layer 46. Unexposed portions of primary layer 46 are thereby situated at various locations above column strips 46EC. The distance at which this unexposed actinic material is located above interior surface 20I of faceplate 20 is greater than the exposure depth of radiation 48. The exposure depth of radiation 48 is typically less than the minimum thickness of layer 46. FIGS. 3*f* and 4*c* illustrate this exposure-depth situation in which unexposed portions of layer 46 respectively overlie all of column strips 46EC.

Substantially no unexposed (or underexposed) actinic material of primary layer 46 lies between faceplate 20 and column strips 46EC. The degree of exposure and, consequently, the extent to which a change in chemical structure occurs in column strips 46EC is greatest along interior surface 20I of faceplate 20. When original layer 46 consists of photo-polymerizable polyimide, backside radiation 48 is typically UV light that causes the exposed polyimide to polymerize. The density of polymer cross-links in strips 46EC is then highest directly along interior faceplate surface 20I. Strips 46EC thus adhere strongly to faceplate 20. In the case of Olin OCG7020 polyimide, the backside exposure with radiation 48 is performed at an exposure dosage of 200 mJ/cm$^2$ and a UV wavelength of 405 nm when layer 46 is originally 100 μm in thickness.

The backside exposure in the process of FIGS. 3 and 4 is performed in a largely uniform manner across the area of faceplate 20. Except at the ends of the segments of column strips 46EC, the width profile of the segments of each column strip 46EC is thus largely the same along the length of the segments and from strip 46EC to strip 46EC. For simplicity, FIGS. 3*f* and 4*c* illustrate the width profiles of column strips 46EC as being generally rectangular. Normally, the width profile of each column strip 46EC is roughly in the shape of an upright isosceles trapezoid with rounded side-edge and upper-edge corners. In any event, the height of the width profiles of the segments of each column strip 46EC is largely the same along the lengths of the strip segments and from one strip 46EC to another. The uniformity in the height of the width profiles is achieved despite variation in the original thickness of primary actinic layer 46.

Also, the length profile (i.e., the shape of a vertical cross section in a plane extending parallel to the length and through the mid-point of the width) of the segments of each column strip 46EC is largely the same for all of the segments of that strip 46EC and from one strip 46EC to another strip 46EC. As with the width profile of column strips 46EC, the length profile of strips 46EC is normally in roughly the shape of an upright isosceles trapezoid.

Figure 3G:
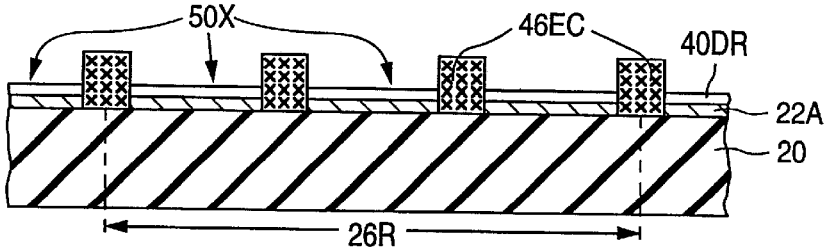
Figure 4D:
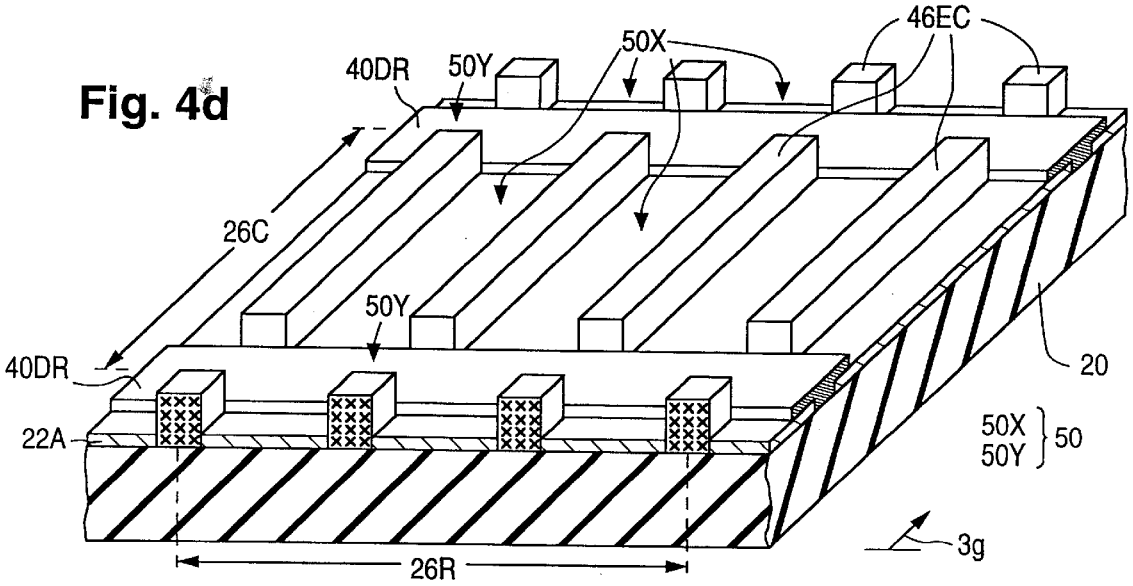

The unexposed material of primary layer 46 is removed with a developer to produce the structure generally depicted in FIGS. 3*g* and 4*d*. When original layer 46 is formed with Olin OCG7020 polyimide, the developer typically consists of n-butyl acetate and xylene. The simplified rectangular shape of column strips 46EC is clearly seen in FIGS. 3*g* and 4*d*, the rounding of the side-edge and upper-edge corners having been omitted in FIGS. 3*g* and 4*d* to simplify the illustration.

An open space 50 consisting of rectangular column openings 50X and row channels 50Y now laterally separates each segment of each column strip 46EC from each other column strip segment. Column openings 50X are situated to the longitudinal sides of column strips 46EC and uncover segments of mask portions 22A. Row channels 50Y are situated above black row strips 40DR and laterally separate the segments of column strips 46EC in the column direction.

As with strips 28EC and 28ER in the process of FIGS. 1 and 2, the likelihood of having any part of column strips 46EC separate from faceplate 20 during the development step is very low in the process of FIGS. 3 and 4. Likewise, the exposed actinic material directly adjacent to faceplate 20 in the process of FIGS. 3 and 4 is eroded the least by the developer, and therefore is stronger than exposed actinic material further away from faceplate 20. Inasmuch as it is desirable that column strips 46EC be strongest directly adjacent to faceplate 20, the combination of the backside exposure and the subsequent development step enables strips 46EC to be produced with a largely uniform width-profile height and with highly desirable strength characteristics while largely avoiding the removal of any parts of strips 46EC during the development step.

Figure 3H:
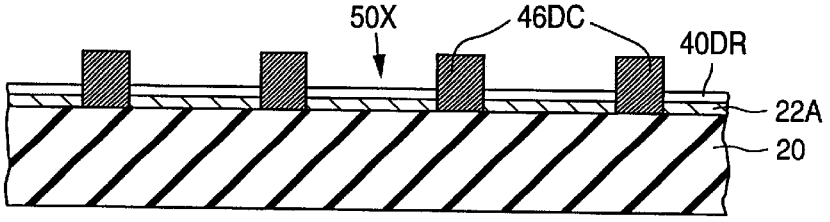

Column strips 46EC are normally not dark enough for usage in a black matrix. Accordingly, strips 46EC are appropriately blackened to form black matrix column strips 46 DC as shown in FIG. 3*h*. The blackening process is performed by pyrolizing strips 46EC when they consist of exposed (photo-polymerized) polyimide. In the case of Olin OCG7020 polyimide, the pyrolysis is done by baking in a nitrogen atmosphere for 1 hr. at 400° C. Taking note of the fact that the width profiles of column strips 46EC were actually in the shape of upright isosceles trapezoids, shrinkage during the pyrolysis causes the upright isosceles trapezoidal shape of the column-strip width profiles to be accentuated as column strips 46EC are converted into black column strips 46DC. The same occurs with the length profiles of the segments of black column strips 46DC. The shrinkage, including attendant thickness reduction, is not shown in the drawings.

Black row strips 40DR and black column strips 46DC form the black matrix here. Since primary actinic layer 46 was considerably thicker than auxiliary actinic layer 40, column strips 46DC extend considerably further away from interior surface 20I of faceplate 20 than row strips 40DR.

Figure 3I:
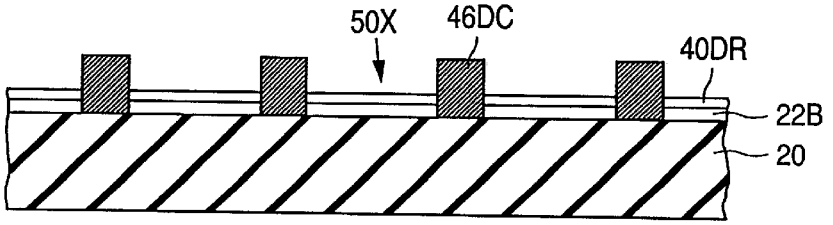
Figure 3J:
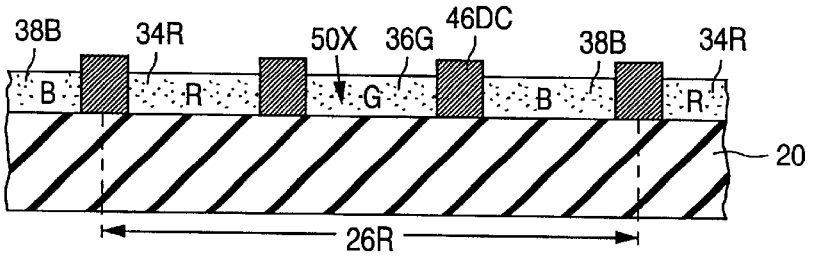
Figure 3K:
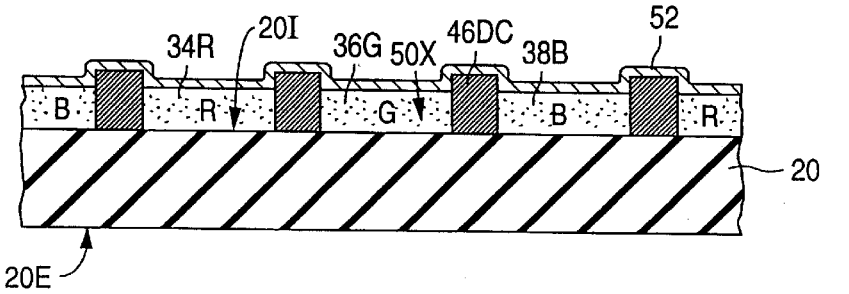
Figure 4E:
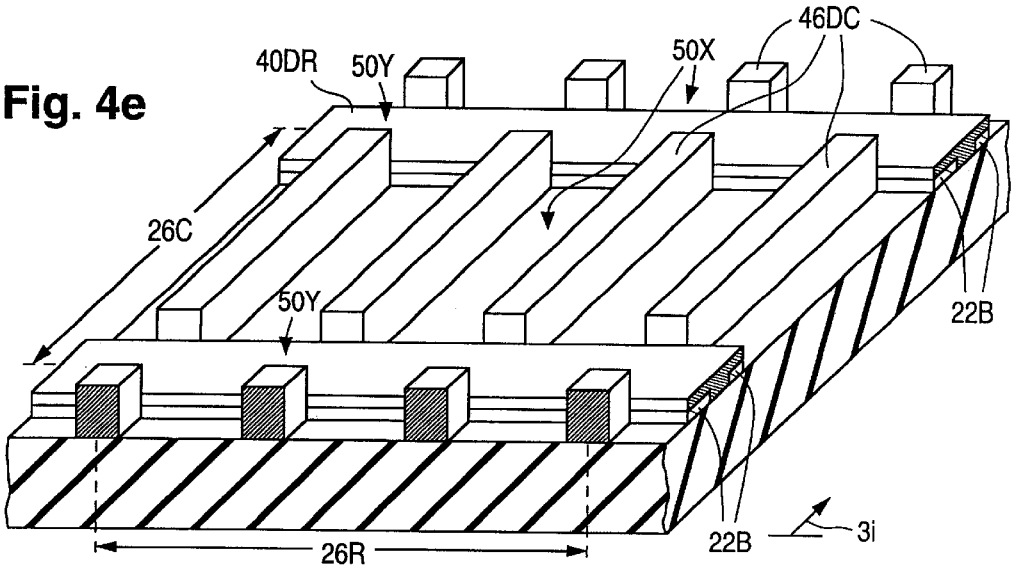

The uncovered segments of mask portions 22A are removed to produce the structure shown in FIGS. 3*i* and 4*e*. In so doing, column openings 50X are extended down to faceplate 20 and now fully extend along the longitudinal sides of the segments of column strips 46EC. Row channels 50Y continue to separate the ends of the segments of strips 46EC. Mask segments 22B underlying black row strips 40DR are the small remainders of mask portions 22A. Accordingly, a small portion of the sacrificial masking layer formed with mask portions 22A is present in the final flat-panel CRT display when it is fabricated according to the process of FIGS. 3 and 4. When mask portions 22A consist of chromium, the removal of the uncovered segments of portions 22A to produce mask segments 22B is typically done with a mixture of ceric ammonium nitrate, acetic acid, and water.

Each pixel 26 in FIG. 4*e* contains three rectangular column openings 50X corresponding respectively to the red, green, and blue sub-pixels of that pixel 26. Phosphor material that emits red, green, and blue light upon being struck by sufficiently energetic electrons is respectively provided in the three column openings 50X of each pixel 26 according to the technique utilized in the process of FIGS. 1 and 2. Inasmuch as black row strips 40DR serve as light-blocking shields during the backside exposures, substantially none of the cured phosphor material sits in row channels 50Y above strips 40DR in the final flat-panel display.

Figure 4F:
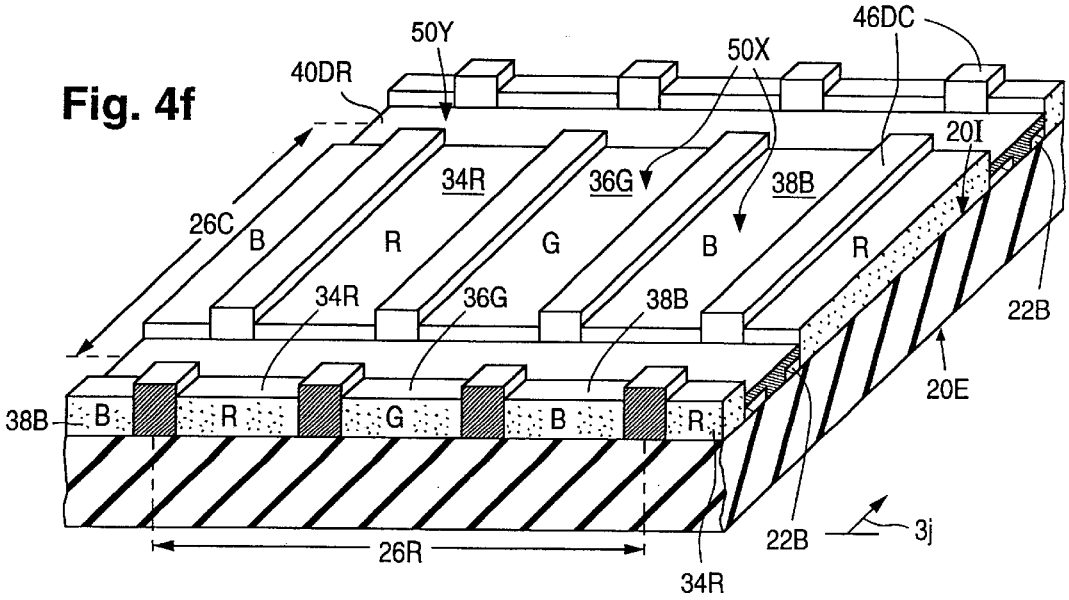

FIGS. 3*j* and 4*f* illustrate the resultant structure in which the left-most, center, and right-most column openings 50X of each pixel 26 respectively contain dried red-emitting phosphor 34R, green-emitting phosphor 36G, and blue-emitting phosphor 38B to form the three sub-pixels. The black matrix formed with row strips 40DR and column strips 46DC laterally surrounds each of sub-pixels 34R, 36G, and 38B so as to separate each sub-pixel from each other sub-pixel in pixel 26 and from sub-pixels 34R, 36G, and 38B in other pixels 26.

A blanket layer 52 of a light-reflective electrically non-insulating material, typically a metal such as aluminum, is deposited on top of the structure so as to overlie phosphor regions 34R, 36G, and 38B and the black matrix as shown in FIG. 3*k*. As with the corresponding non-insulating light-reflective layer formed over regions 34R, 36G, and 38B in the process of FIGS. 1 and 2, non-insulating light-reflective layer 52 serves as the anode for the flat-panel display and enhances the display brightness by reflecting back some of the rear-directed light emitted by phosphor regions 34R, 36G, and 38B during display operation. When anode layer 52 consists of aluminum, layer 52 is typically deposited to a thickness of 10–100 nm, typically 50 nm, by evaporation. Further details on the formation of layer 52 are given below.

Anode layer 52 is sufficiently thin that the contour of row channels 50Y is closely reflected in the upper surface of layer 52. Channels corresponding to row channels 50Y are thus produced in the upper anode surface. Thin flat equal-width spacer walls (not shown here) are inserted vertically into some or all of these row channels in anode layer 52. Black column strips 46DC protrude upward sufficiently far above black row strips 40DR that the ends of the segments of strips 46DC, as coated with anode layer 52, laterally constrain the spacer walls through layer 52.

The thickness of the spacer walls is slightly less than the width of black row strips 40DR and thus is slightly less than the bottom width of row channels 50Y that overlie strips 40DR. When strips 40DR have a bottom width of 20–120 $\mu$m, typically 70 $\mu$m, in conformity with the width given above for unblackened column strips 40ER, the spacer wall thickness is 50–60 $\mu$m, typically 55 $\mu$m. By using the backside exposure technique of the invention, the spacer walls are self-aligned to, and centered on, row strips 40DR. Consequently, the spacer walls are largely shadowed (hidden) by row strips 40DR as seen in looking at exterior surface 20E of faceplate 20 from a direction perpendicular to surface 20E. Hence, the spacer walls are largely not visible to a viewer and do not degrade the image presented on the active area of surface 20E during display operation.

Importantly, utilizing the ends of black column strips 46DC to laterally constrain the spacer walls through anode layer 52 avoids the necessity of allocating additional active display area to perform the constraining function. The ratio of black matrix area to total active area is quite low, thereby advantageously enabling the ratio of light-emitting phosphor area to total active area to be quite high in the final flat-panel display. This results in increased display brightness. Also, the backside exposure technique of the invention enables the black matrix to adhere strongly to faceplate 20.

The distance between the top sides of consecutive segments of each column strip 46DC, as coated with anode layer 52, determines how well the spacer walls are laterally constrained by the anode-coated ends of the column strip segments. Provided that the thickness of the spacer walls is less than the width of row strips 40DR so as to avoid having the spacer walls appear on exterior faceplate surface 20E due to excessive spacer wall thickness, the best lateral constraint typically occurs when the distance between the top sides of consecutive segments of each anode-coated column strip 46DC is not significantly greater than, preferably less than or approximately equal to, the width of strips 40DR.

As mentioned above, the actual length profiles of the segments of unblackened column strips 46EC are normally in the rough shape of upright isosceles trapezoids. These profiles are normally accentuated as the display fabrication process goes through the column-strip blackening operation and other steps that come after the development of primary layer 46 to form strips 46EC. In particular, shrinkage during the column-strip blackening operation causes the lengths (and widths) of the top sides of the segments of column strips 46EC to be reduced by a greater percentage than the lengths (and widths) of the bottom sides of the segments of column strips 46EC as they are transformed into black column strips 46DC. Consequently, the actual length profiles of the segments of black column strips 46DC are normally in the rough shape of upright isosceles trapezoids at the end of the fabrication of the faceplate structure. The distance between the top sides of consecutive segments of each black column strip 46DC is thus slightly greater than the width of black row strips 40DR.

The distance between the top sides of consecutive segments of each anode-coated black column strip 46DC can vary from slightly less than to slightly greater than the width of black row strips 40DR. Taking wall waviness, wall positioning tolerances, and possible wall tilting into account, the upright isosceles trapezoidal shape of the length profiles of column strips 46DC can sometimes lead to a situation in which the spacer walls are visible on exterior surface 20E.

Figure 5A:
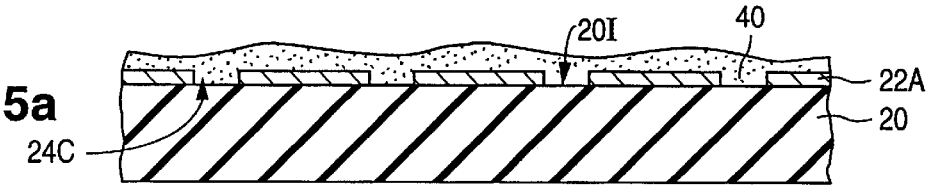
FIGS. 5*a*–5*c* are cross-sectional side views representing steps in part of a variation, according to the invention, of the manufacturing process of FIGS. 3*a*–3*k*. The stages shown in FIGS. 5*b* and 5*c* respectively replace the stages shown in FIGS. 3*c* and 3*d* after beginning the process variation with the stage of FIG. 3*b* repeated here as FIG. 5*a*. Subject to changes in certain of the reference symbols.
Figure 5B:
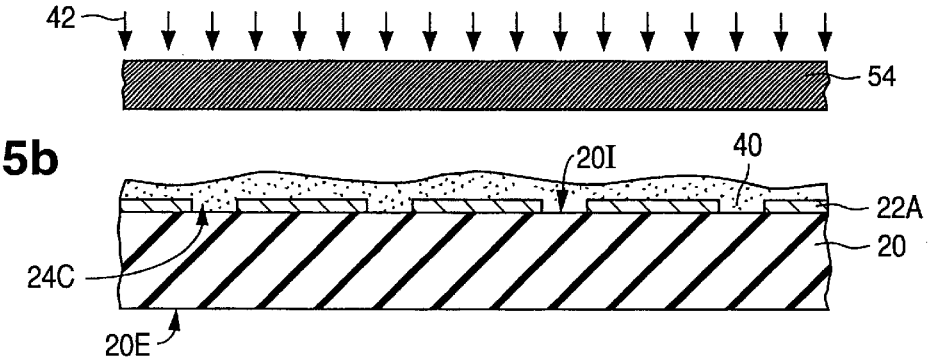
Figure 5C:
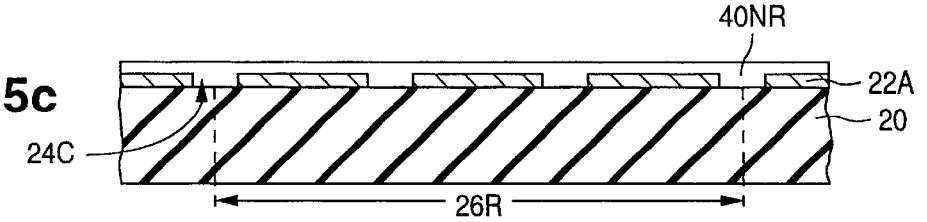
Figure 6A:
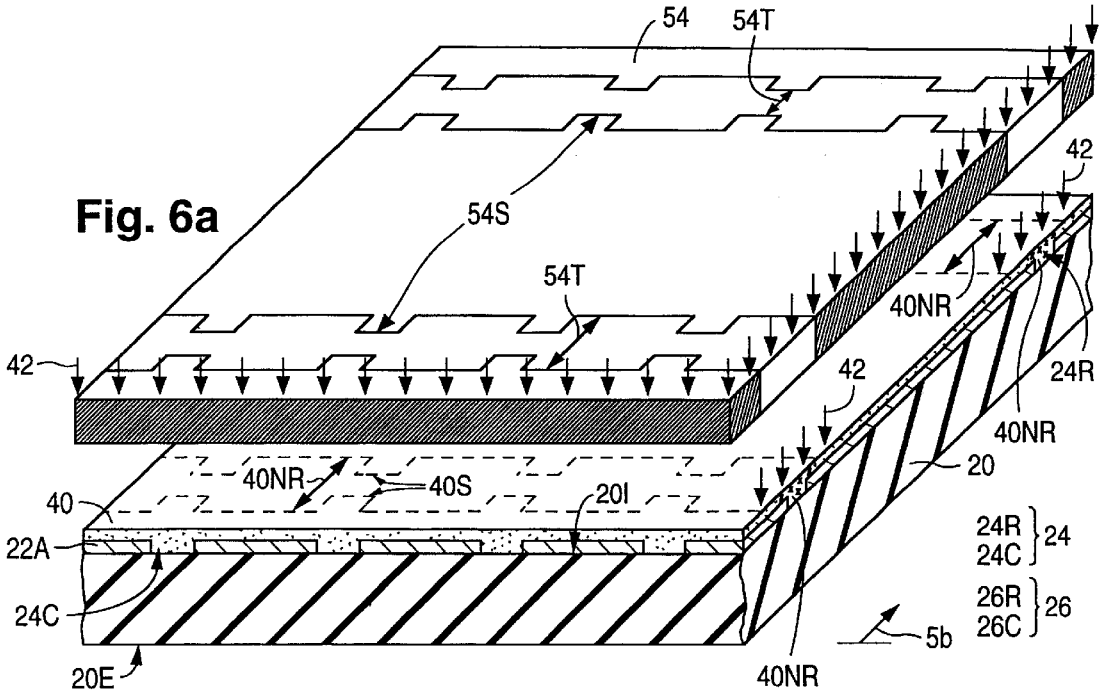
FIGS. 6*a*–6*f* are perspective views respectively corresponding to FIGS. 5*b*, 5*c*, 3*f*, 3*g*, 3*i*, and 3*j* in the process variation of FIGS. 5*a*–5*c* and 3*e*–3*k*. The correspondence between FIGS. 6*c*–6*f*, on one hand, and FIGS. 3*f*, 3*g*, 3*i*, and 3*j*, on the other hand, is subject to changes in certain of the reference symbols. The horizontal lines from which slanted arrows 5*b* and 5*c* originate in FIGS. 6*a* and 6*b* respectively indicate where the cross sections of FIGS. 5*b* and 5*c* are taken in FIGS. 6*a* and 6*b*. The horizontal lines from which slanted arrows 3*f*, 3*g*, 3*i*, and 3*j* originate in FIGS. 6*c*–6*f* indicate where the cross sections of FIGS. 3*f*, 3*g*, 3*i*, and 3*j* are taken in FIGS. 6*c*–6*f* subject to the specified reference symbol changes as indicated by the approximate signs before slanted arrows 3*f*, 3*g*, 3*i*, and 3*j*.
Figure 6B:
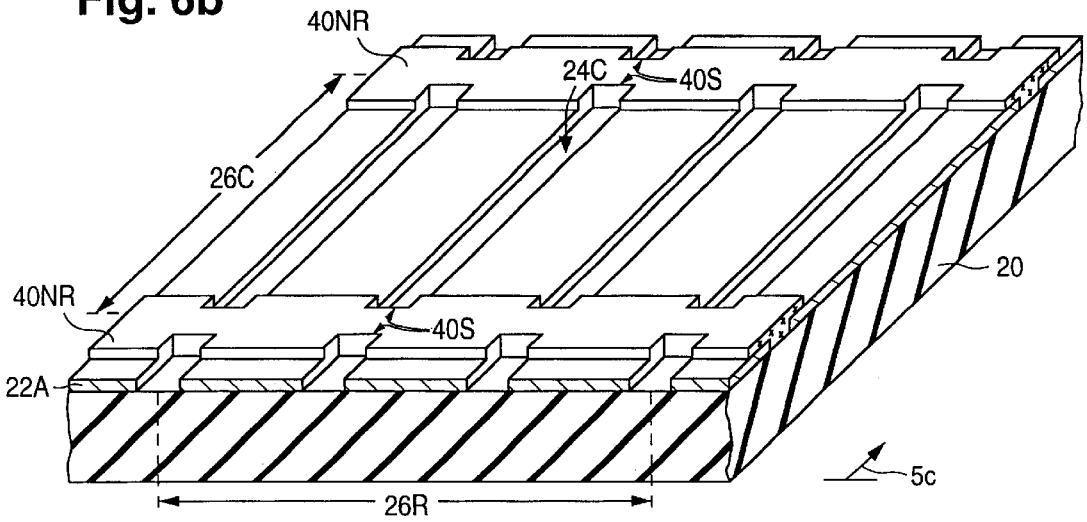
Figure 6C:
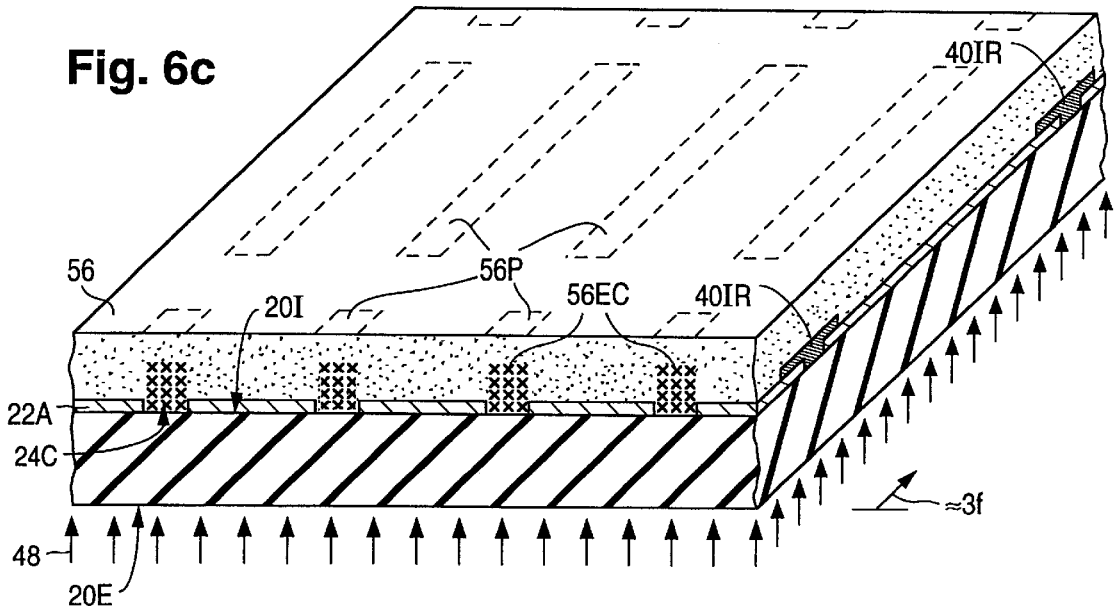

FIGS. 5*a*–5*c* (collectively "FIG. 5") and FIGS. 6*a*–6*f* (collectively "FIG. 6") illustrate how the invention's teachings are utilized in fabricating a black matrix, light-emissive elements, and a light-reflective anode for a faceplate structure of a color flat-panel CRT display according to a variation of the fabrication process of FIGS. 3 and 4 in order to substantially reduce the likelihood of spacer walls being visible on exterior surface 20E of faceplate 20. FIG. 6*a* and 6*b* illustrate the structure at the stages respectively shown in FIGS. 5*b* and 5*c*. Subject to changes in certain of the reference symbols, FIGS. 3*a*–3*k* are employed in conjunction with FIGS. 6*c*–6*f* to illustrate the process of FIGS. 5 and 6. In so utilizing FIGS. 3*a*–3*k*, the reference symbol changes for one of FIGS. 3*e*–3*k* carry over to each later one of FIGS. 3*e*–3*k* even though the particular reference symbol changes are not further mentioned in the discussion below. FIGS. 6*c*–6*f* illustrate the structure at the stages respectively shown in FIGS. 3*f*, 3*g*, 3*i*, and 3*j* subject to the indicated reference symbol changes.

The variation of FIGS. 5 and 6 begins at the stage of FIG. 3*b* repeated here, for convenience, as FIG. 5*a*. Auxiliary actinic layer 40 in FIG. 5*a* is to be transformed into row strips of the black matrix. The transformation process is initiated with the frontside exposure step depicted in FIGS. 5*b* and 6*a*. To simplify the illustration, the variation in thickness of actinic layer 40 is not depicted in FIG. 6*a*.

In the process variation of FIGS. 5 and 6, auxiliary actinic layer 40 is selectively exposed to frontside actinic radiation 42 through a photomask (again, reticle) 54. As indicated in FIG. 6*a*, a portion of frontside radiation 42 passes through radiation-transparent mask area 54T and causes underlying equal-width exposed row strips 4 ONR of actinic layer 40 to change chemical structure. Mask area 54T is provided with rectangular slotted (or notched) areas 54S such that multiple pairs of equal-size oppositely located rectangular slots (or notches) 40S are situated along the longitudinal sides of each row strip 40NR.

Each slot 40S has a pair of opposite sides that are respectively in line with the longitudinal sides of a corresponding one of column openings 24C. Accordingly, the lateral width of slots 40S is 10–50 $\mu$m, typically 20 pm. The lateral depth of slots 40S is set at such a value that, when the spacer walls are placed in the wall-constraining features of the black matrix, the spacer walls will not be visible on exterior surface 20E of baseplate 20 due to wall waviness, wall placement tolerances, wall tilting, other wall-related factors, and/or the fact that column strips of the black matrix are later created with height profiles in the rough shape of upright isosceles trapezoids. The depth of slots 40S is 5–50 $\mu$m, typically 15–20 $\mu$m. Aside from providing slots 40S in row strips 40NR, the exposure of actinic layer 40 to frontside actinic radiation 42 in the variation of FIGS. 5 and 6 is performed in the same way as in the process of FIGS. 3 and 4.

From this point on, the structure of FIGS. 5*b* and 6*a* is processed in the same manner as the structure of FIGS. 3*c* and 4*a* in the process of FIGS. 3 and 4. Firstly, the unexposed material of primary layer 40 in the process of FIGS. 5 and 6 is removed with a developer. FIGS. 5*c* and 6*b* illustrate the resultant structure, except that the variation in thickness of row strips 40NR is not shown. With strips 40NR not being dark enough for black matrix usage, strips 40NR are blackened to convert them into black matrix row strips 40IR. The blackening process is performed by pyrolysis when row strips 40NR consists of photo-polymerizable polyimide.

A primary blanket layer 56 of negative-tone actinic material is formed on top of the structure. Primary actinic layer 56 corresponds to primary actinic layer 46 in the process of FIGS. 3 and 4, typically consists of photo-polymerizable polymide, and is of similar thickness to actinic layer 46. At this stage, the structure in the process of FIGS. 5 and 6 appears as shown in FIG. 3*e* subject to changing reference symbol "46" to "56".

Primary actinic layer 56 is to be transformed into column strips of the black matrix. The transformation process is initiated with the backside exposure step depicted in FIGS. 6*c* and 3*f* subject to changing reference symbol "46EC" to "56EC" in FIG. 3*f*. To simplify the illustration, the variation in thickness of actinic layer 56 is not shown in FIG. 6*c*.

Actinic layer 56 is selectively exposed to backside actinic radiation 48 through a mask formed with mask portions 22A and black row strips 40IR. The portion of backside radiation 48 not blocked by mask portions 22A and strips 40IR passes into column openings 24C and causes overlying exposed equal-width column strips 56EC of actinic layer 56 to change chemical structure. Item 56P of FIG. 6*c* indicates the plan-view pattern of column strips 56EC. Due to the presence of row strips 40IR, each column strip 56EC consists of a group of column segments laterally separated in the column direction.

Figure 6D:
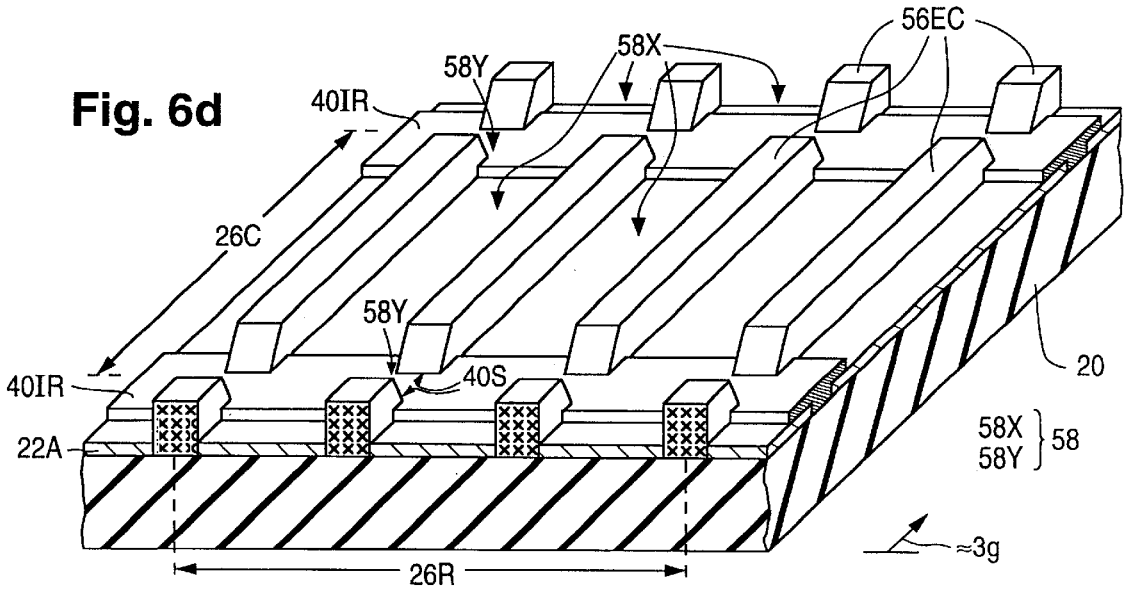

The unexposed material of primary layer 56 is removed with a developer. See FIGS. 6*d* and 3*g* subject to changing reference symbol "50X" to "58X" (and making the other indicated reference symbol changes) in FIG. 3*g*. FIG. 6*d* illustrates the length profiles of the segments of column strips 56EC as being roughly in the shape of upright isosceles trapezoids. Although not shown in FIG. 6*d*, the width profile of each strip 56EC is also roughly in the shape of an upright isosceles trapezoid. The rounding of the side-edge and upper-edge corners of strips 56EC is, for simplicity in illustration, not shown in FIG. 6*d*. Since rectangular slots 40S are aligned to column openings 24C, the ends of the segments of column strips 56EC extend into slots 40S.

Open space 58, corresponding to open space 50 in the process of FIGS. 3 and 4, laterally separates each segment of column strip 56EC from each other segment of that column strip 56EC. Open space 58 consists of rectangular column openings 58X and row channels 58Y respectively corresponding to column openings 50X and row channels 50Y in the process of FIGS. 3 and 4 except that the presence of slots 40S causes row channels 58Y to be shaped slightly different than row channels 50Y. Column openings 58X are situated to the sides of column strips 56EC and uncover segments of mask portions 22A. Row channels 58Y are situated above row strips 40IR and separate the segments of column strips 56EC in the column direction.

Figure 6E:
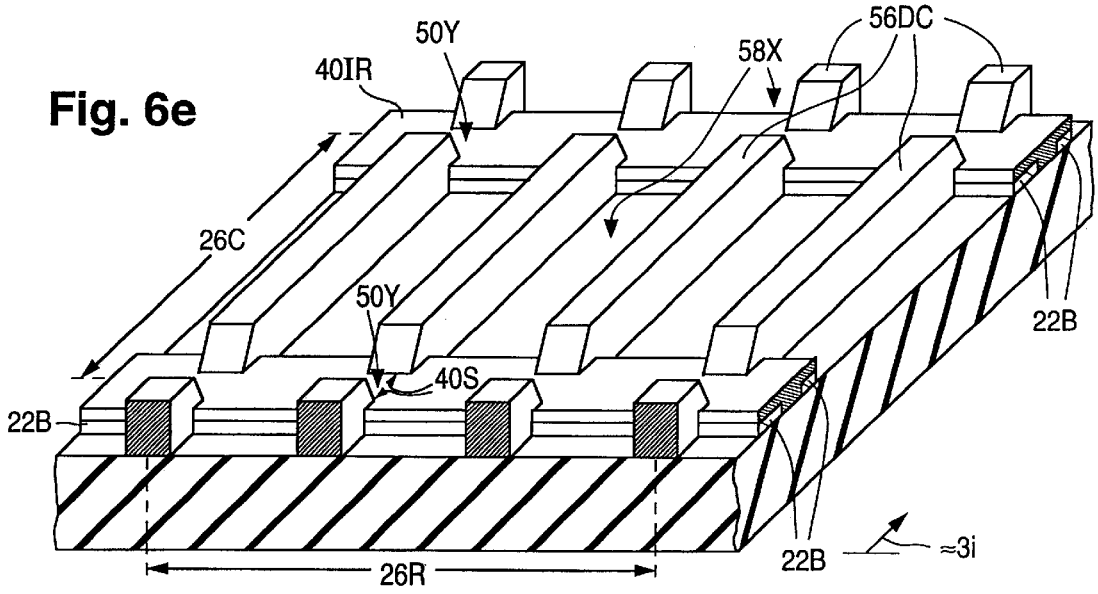

Column strips 56EC are blackened to convert then into black matrix column strips 56DC, first illustrated in FIG. 6*e*. The blackening step, performed by pyrolysis when strips 56EC consist of exposed (photo-polymerized) polymide, is shown in FIG. 3*h* (subject to the preceding reference-symbol changes). Shrinkage during the pyrolysis causes the upright isosceles trapezoidal shape of the length profiles of the segments of column strips 56EC to be accentuated as they are transformed into black column strips 56DC. Inasmuch as the width profiles of column strips 56EC were actually in the rough shape of upright isosceles trapezoid, the same occurs with the width profiles of strips 56EC. The shrinkage, including attendant thickness reduction, is not shown in the drawings.

Slotted black row strips 40IR and black column strips 56DC that extend into slots 40S in row strips 40IR now form the black matrix. Since primary actinic layer 56 was considerably thicker than auxiliary actinic layer 40, column strips 56DC extend considerably further above faceplate interior surface 20I than row strips 40IR.

The uncovered segments of mask portions 22A are removed to produce the structure shown in FIGS. 6*e* and 3*i*. Items 22B again are the small remainders of mask portions 22A and thus constitute a small remainder of the sacrificial masking layer. In removing the uncovered segments of mask portions 22A to produce mask segments 22B, column openings 56X are extended down to faceplate 20 so as to extend fully along the lateral sides of the segments of column strips 56EC.

Figure 6F:
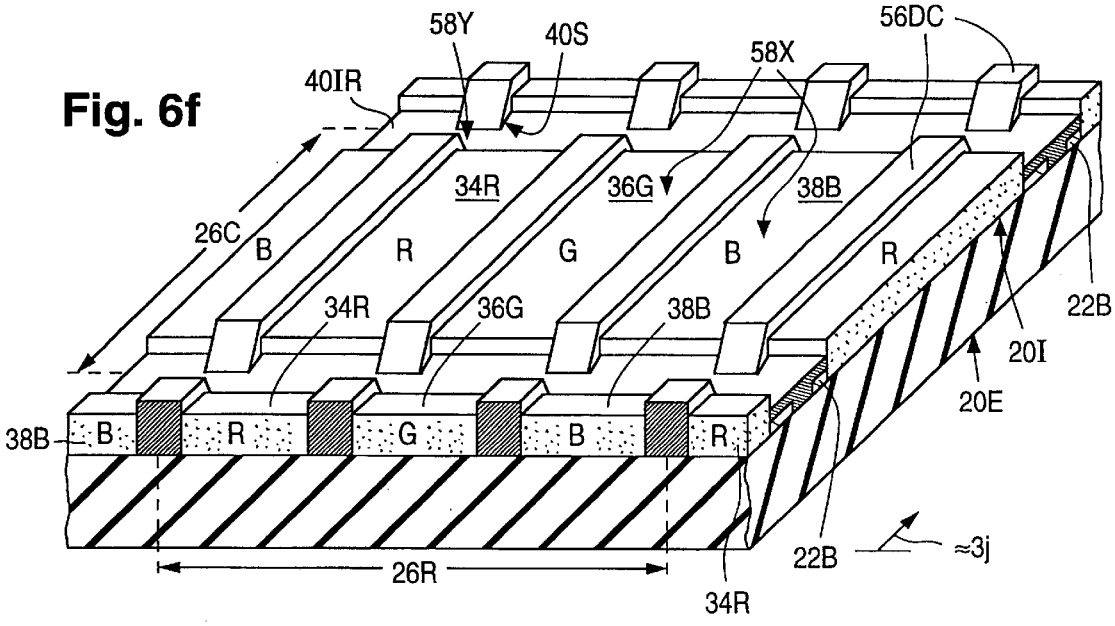

Each pixel 56 in FIG. 6*e* contains three rectangular column openings 58X. Using the phosphor introduction technique employed in the process of FIGS. 1 and 2, red-emitting phosphor 34R, green-emitting phosphor 36G, and blue-emitting phosphor 38B are respectively introduced into the three column openings 58X of each pixel 26 as shown in FIGS. 6*f* and 3*j*. Black row strips 40IR serve as light-blocking shields that prevent cured phosphor from overlying strips 40IR in the final flat-panel display.

The black matrix formed with row strips 40IR and column strips 56DC laterally separates sub-pixels 34R, 36G, and 38B from one another in each pixel 26 and from other sub-pixels 34R, 36G, and 38B in other pixels 26. In addition, each row channel 58Y is now a slotted (or notched) channel extending in the row direction. The structure appears as shown in FIG. 3*k* (subject to the preceding reference symbol changes) after deposition of light-reflective anode layer 52.

Slotted row channels closely reflecting the contour of slotted row channels 58Y are present in the upper surface of anode layer 52. Thin flat equal-width spacer walls (not shown here) are inserted vertically into some or all of the slotted channels in anode layer 52. The segments of column strips 56DC protrude sufficiently far above row strips 40IR that the ends of the column strip segments, as coated with anode layer 52, laterally constrain the spacer walls through the anode layer 52.

The spacer walls utilized in the process of FIGS. 5 and 6 normally have the same width, self-alignment, and centering characteristics with respect to row strips 40IR and row channels 58Y that the spacer walls in the process of FIGS. 3 and 4 have with respect to row strips 40DR and row channels 50Y. Importantly, the presence of slots 40S in rows strips 40IR enables the distance between the top sides of consecutive segments of each column strip 56DC to be controlled independently of the width of row strips 40IR. This provides a means to prevent the spacer walls from being visible on exterior faceplate surface 20E.

In particular, the lateral depth of slots 40S is chosen so that the distance between the top sides of consecutive segments of each column strip 56DC is no greater than, normally slightly less than, the width of row strips 40IR. When inserted into the channels present in anode layer 52, the spacer walls thus are normally fully shadowed by black row strips 40IR and are not visible on exterior faceplate surface 20E due to factors such as wall waviness, wall placement tolerances, wall tilting, other wall-related factors, and the upright isosceles trapezoidal shape of the length profiles of the segments of column strips 56OC.

Because the segments of black column strips 56DC have length profiles roughly in the shape of upright isosceles trapezoids, the open regions which lie between consecutive segments of each column strip 56DC and which are available for receiving spacer walls through anode layer 52 each have a length profile roughly in the shape of an inverted isosceles trapezoid—i.e., an isosceles trapezoid whose base extends parallel to, and is shorter than, the trapezoid's top side. The inverted isosceles trapezoidal shape for the open regions between the segments of strips 56DC is reflected in anode layer 52. This facilitates insertion of the spacer walls into the wall-constraining features present in layer 52.

By utilizing the ends of black column strips 56DC to constrain spacer wall movement through anode layer 52, a necessity to allocate additional display active area to constrain spacer walls is avoided. As in the flat-panel display fabricated according to the process of FIGS. 3 and 4, the flat-panel display manufactured according to the process of FIGS. 5 and 6 advantageously achieves a high ratio of light-emitting area to total active area and therefore increased display brightness. Furthermore, use of the back-side exposure step enables the black matrix to strongly adhere to faceplate 20.

FIGS. 7*a*–7*k* (collectively "FIG. 7") illustrate another process for manufacturing a black matrix and light-emissive elements for a faceplate structure of a color flat-panel display according to the invention so as to provide the black matrix with features for constraining spacer walls. FIGS. 8*a*–8*f* (collectively "FIG. 8") illustrate the structure at certain of the stages shown in FIG. 7. In the fabrication process of FIGS. 7 and 8, the steps for forming the sacrificial masking layer and the black matrix row strips are performed in the opposite order utilized in the process of FIGS. 3 and 4. Aside from this, the fabrication steps in the process of FIGS. 7 and 8 are typically performed the same as in the process of FIGS. 3 and 4.

Figure 7A:
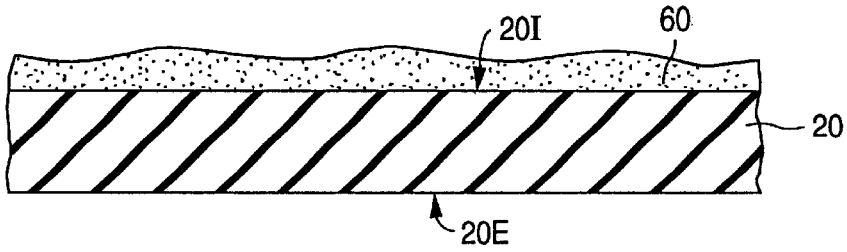
FIGS. 7*a*–7*k* are cross-sectional side views representing steps in another process that follows the invention's teachings for manufacturing a spacer-constraining black matrix and light-emissive elements of a faceplate structure for a flat-panel CRT display.
Figure 7A:
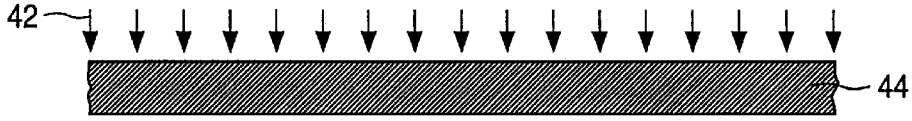
Figure 7B:
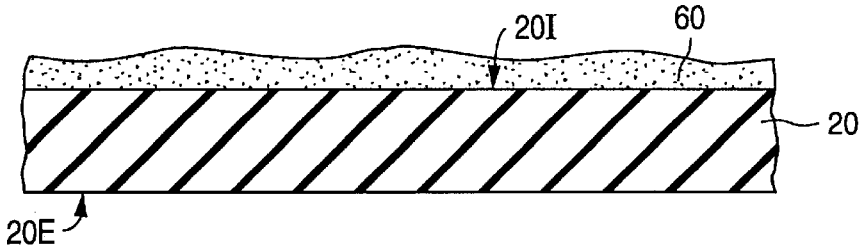
Figure 7C:
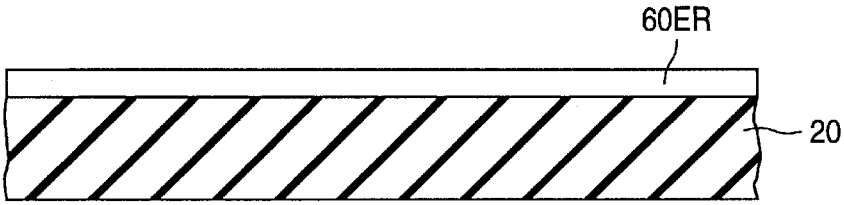

In beginning the process of FIGS. 7 and 8, an auxiliary blanket layer 60 of negative-tone actinic material is formed on top of faceplate 20 as shown in FIG. 7*a*. Auxiliary actinic layer 60 has the same general characteristics, including thickness, as auxiliary actinic layer 40 in the process of FIGS. 3 and 4 and typically consists of photo-polymerizable polyimide processed in the same way as the photo-polymerizable polyimide typically used for actinic layer 40. The thickness of actinic layer 60 can vary somewhat from point to point as indicated in FIG. 7*a*.

Auxiliary actinic layer 60 is to be transformed into row strips of the black matrix. The transformation process is initiated with the frontside exposure step depicted in FIG. 7*b*. Using photomask 44, layer 60 is selectively exposed to frontside actinic radiation 42. The frontside exposure with frontside radiation is performed in the manner described above for the process of FIGS. 3 and 4.

Figure 8A:
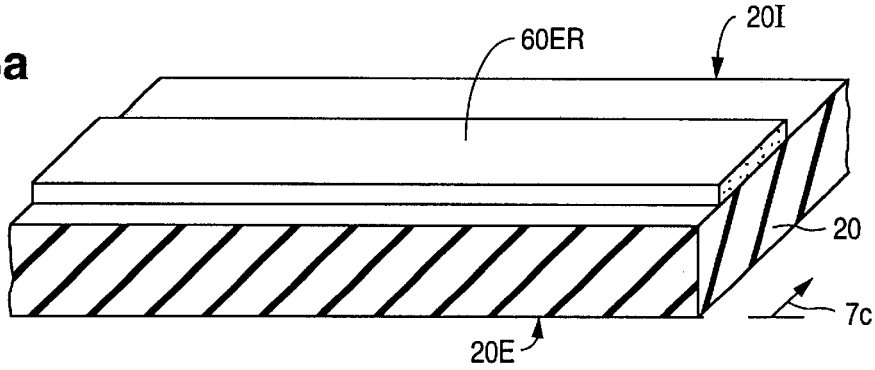
FIGS. 8*a*–8*f* are perspective views respectively corresponding to FIGS. 7*c*, 7*e*, 7*g*, 7*h*, 7*j*, and 7*k*. The horizontal lines from which slanted arrows 7*c*, 7*e*, 7*g*, 7*h*, 7*j*, and 7*k* originate in FIGS. 8*a*–8*f* respectively indicate where the cross sections of FIGS. 7*c*, 7*e*, 7*g*, 7*h*, 7*j*, and 7*k* are taken in FIGS. 8*a*–8*f*.

The unexposed material of auxiliary layer 60 is removed with a developer. See FIGS. 7*c* and 8*a*. Row strips 60ER, one of which is shown in FIG. 8*a*, constitute the exposed remainder of layer 60. The development process is performed in the way described above for developing auxiliary layer 40 in the process of FIGS. 3 and 4. For simplicity, the variation in thickness of row strips 60ER is not depicted in FIGS. 7*c* and 8*a*.

Figure 8B:
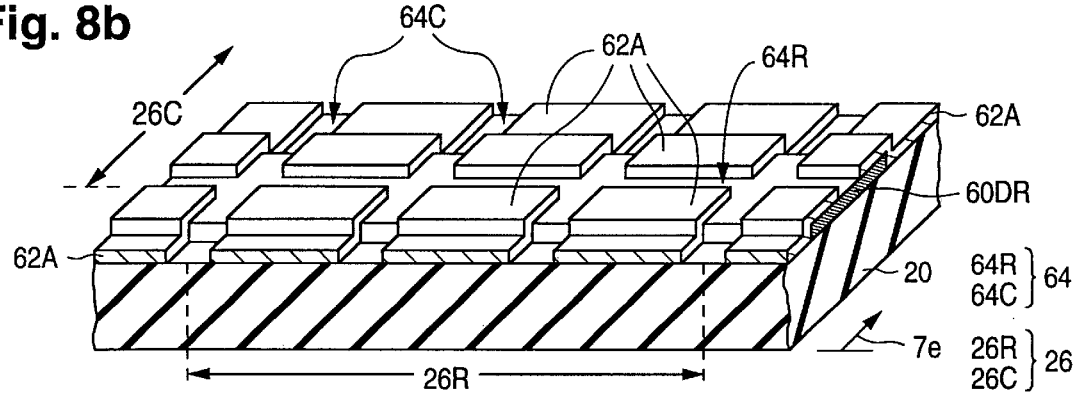
Figure 8C:
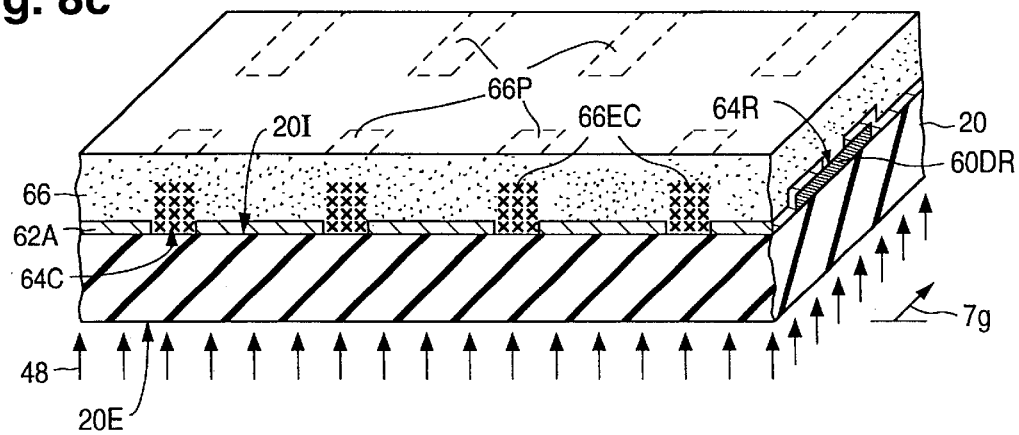

Row strips 60ER are normally suitably blackened to form black matrix row strips 60DR, first shown in FIG. 8*b*. When strips 60ER consist of exposed (photo-polymerized) polyimide, the blackening process is performed by pyrolysis in the way described above for converting row strips 40ER to black row strips 40DR in the process of FIGS. 3 and 4. Black row strips 60DR are capable of blocking actinic radiation in the form of UV light.

Figure 7D:
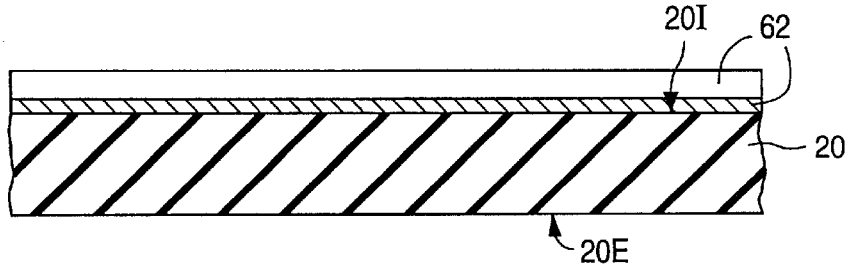
Figure 7E:
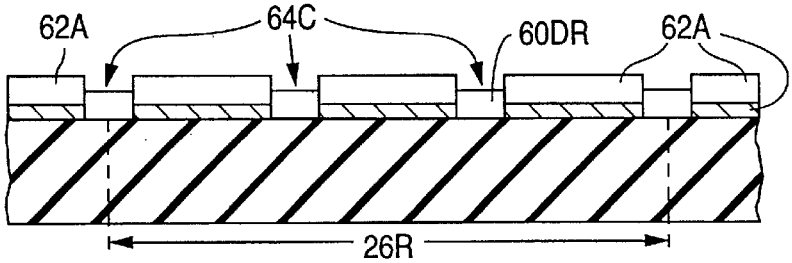
Figure 8D:
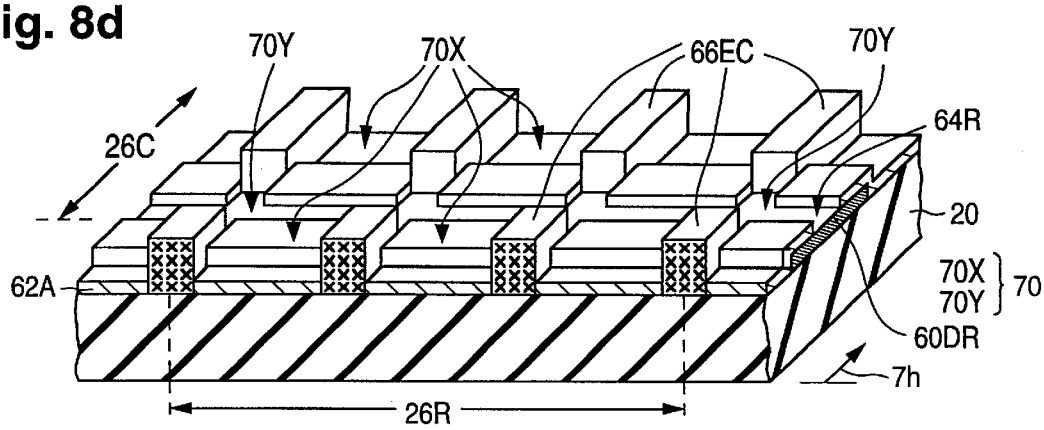

A blanket layer 62 of a patternable masking material is deposited on top of the structure as indicated in FIG. 7*d*. Blanket layer 62 has the same characteristics as blanket layer 22 in the process of FIGS. 3 and 4 (and thus also the same characteristics as blanket layer 22 in the process of FIGS. 1 and 2) and is formed in the same way as layer 22. Using a photoresist mask (not shown), layer 62 is patterned as depicted in FIGS. 7*e* and 8*d*, typically with the etchant employed to pattern layer 22. The photoresist mask could, for example, have largely the same plan-view shape as the photoresist mask employed in patterning layer 22.

The remainder of blanket layer 62 consists of equal-width rectangular mask portions 62A laterally separated by open space 64 as depicted in FIG. 8*b*. Mask portions 62A corresponds to mask portions 22A and typically have plan-view dimensions similar to those of mask portions 22A in the process of FIGS. 3 and 4. As with mask portions 22A, mask portions 62A serve as a sacrificial masking layer in defining the plan-view shape of the black matrix.

Open space 64 consists of equal-width row openings 64R and equal-width column openings 62C that intersect row openings 64R. Openings 64R and 62C respectively correspond to, and have similar dimensions to, openings 24R and 24C in the process of FIGS. 3 and 4. Each row opening 64R extends over a central segment of a corresponding one of black row strips 60DR. Permitting row openings 64R to overlie the central strip segments of black row strips 60DR eases alignment tolerances, thereby facilitating display fabrication.

Figure 7F:
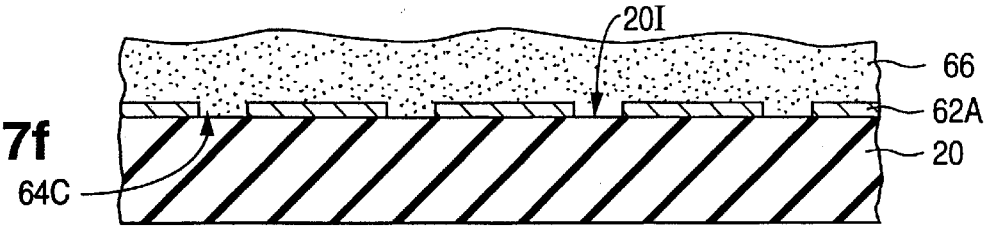
Figure 7G:
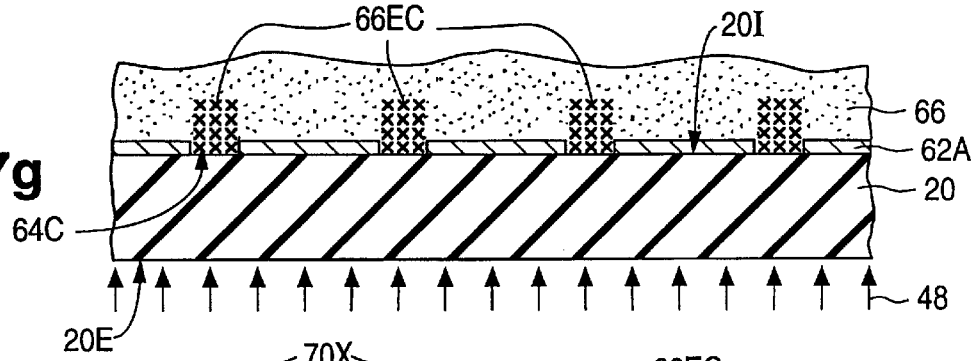

From this point on, the structure of FIGS. 7*e* and 8*b* is processed in largely the same manner as the structure of FIGS. 3*d* and 4*b* in the process of FIGS. 3 and 4. First, a primary blanket layer 66 of negative-tone actinic material is formed on top of the structure—i.e., on mask portions 62A and in open space 64. See FIG. 7*f*. Primary actinic layer 66, which corresponds to primary actinic layer 46 in the process of FIGS. 3 and 4, has the same characteristics, including thickness, as actinic layer 46 and typically consists of photo-polymerizable polyimide. The thickness of actinic layer 66 thus can vary appreciably from point to point as indicated in FIG. 7*f*.

Primary actinic layer 66 is to be transformed into column strips of the black matrix. The transformation process is initiated with the backside exposure step depicted in FIGS. 7*g* and 8*c*. To simplify the illustration, the variation in thickness of layer 66 is not shown in FIG. 8*c*.

Actinic layer 66 is selectively exposed to backside actinic radiation 48 through a mask formed with mask portions 62A and black row strips 60DR. The portion of backside radiation 48 not blocked by mask portions 62A and strips 60DR passes into column openings 62C and causes overlying exposed equal-width column strips 66EC of actinic layer 66 to change chemical structure. Item 66P in FIG. 8c indicates the general plan-view pattern of column strips 66EC.

Figure 7H:
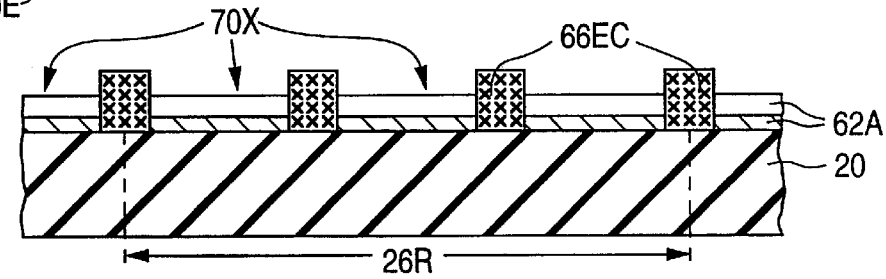
Figure 7I:
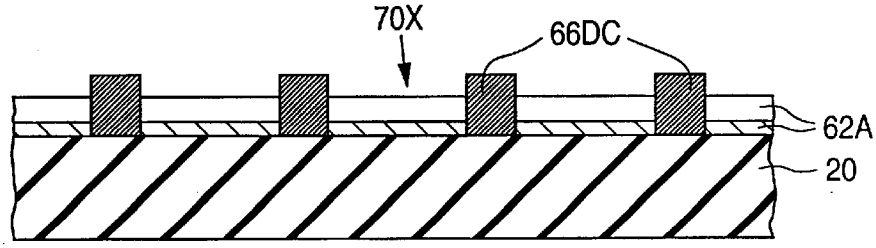

The unexposed material of primary layer 66 is removed with a developer to produce the structure generally shown in FIGS. 7*h* and 8*d*. Column strips 66EC correspond to, and have the same characteristics as, column strips 46EC. Each column strip 66EC thus consists of a group of column segments laterally separated in the column direction. With the backside exposure having been performed in a largely uniform manner across the area of faceplate 20, column strips 66EC have largely uniform width and length profiles. For simplicity in illustration, the rounding of the side-edge and upper-edge corners of strips 66EC is not shown in FIGS. 7*h* and 8*d*.

Open space 70, corresponding to open space 50 in the process of FIGS. 3 and 4, now laterally separates each segment of column strip 66EC from each other segment of that strip 66EC. Open space 70 consists of rectangular column openings 70X and row channels 70Y respectively corresponding to column openings 50X and row channels 50Y. Column openings 70X are situated to the longitudinal sides of column strips 66EC and uncover segments of mask portions 62A. Row channels 70Y are situated above central slotted segments of black row strips 60DR. In essence, channels 70Y are re-opened versions of row openings 64R and parts of column openings 62C.

Column strips 66EC are suitably blackened, normally by pyrolysis when strips 66EC consist of exposed (photo-polymerized) polymide, to form black matrix column strips 66DC corresponding to black column strips 46DC. See FIG. 7*i*. Black row strips 60DR and black column strips 66DC form the black matrix. Since primary actinic layer 66 was considerably thicker than auxiliary actinic layer 60, column strips 66DC extend considerably further above faceplate interior surface 20I than row strips 60DR.

Figure 7J:
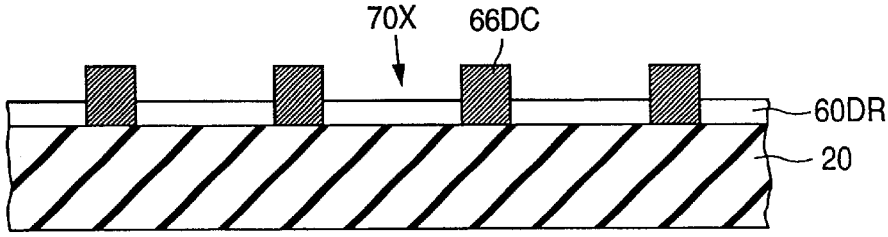
Figure 8E:
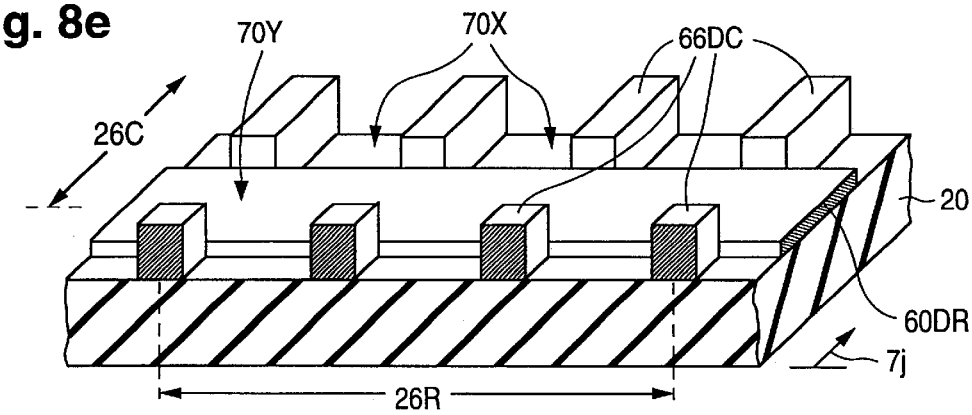

Mask portions 62A are removed to produce the structure shown in FIGS. 7*j* and 8*e*. All of the sacrificial masking layer is now gone. Also, column openings 70X now extend down to faceplate 20.

In contrast to the process of FIGS. 3 and 4 where segments (22B) of the sacrificial masking layer (22A)

remain at this stage of the fabrication process because the sacrificial masking layer is formed prior to forming the black row strips (40DR), formation of the sacrificial masking layer (62A) after forming the black row stripes (60DR) in the process of FIGS. 7 and 8 results in substantially all of the sacrificial masking layer being removed at the same fabrication stage. Aside from this difference, the structure of FIGS. 7*j* and 8*e* is largely identical to the structure of FIGS. 3*i* and 4*e*.

Figure 7K:
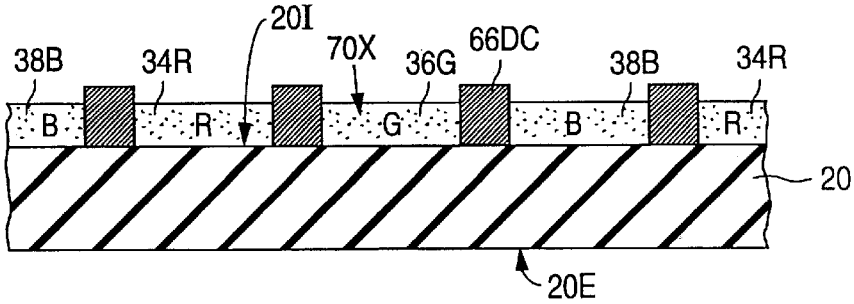
Figure 8F:
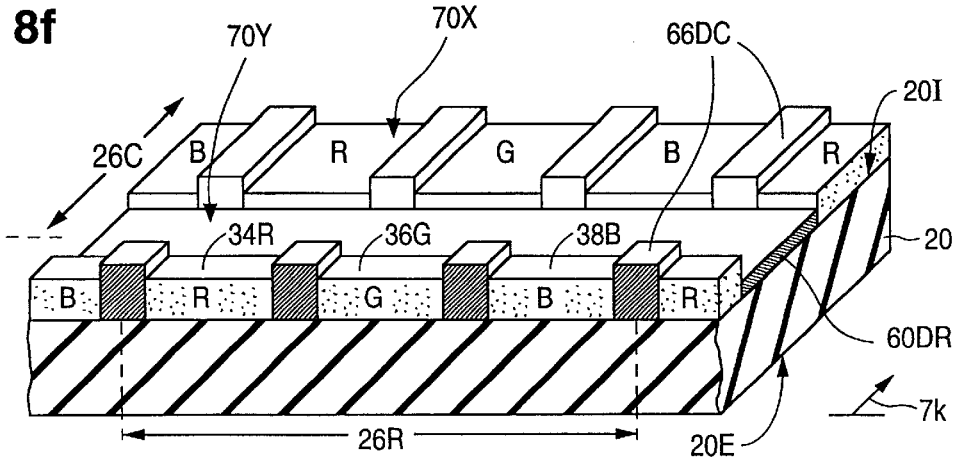

Each pixel 26 in FIGS. 7*j* and 8*e* contains three rectangular column openings 70X into which phosphors 34R, 36G, and 38B are respectively introduced as depicted in FIGS. 7*k* and 8*f*. The phosphor introduction is performed according to the process of FIGS. 1 and 2. The black matrix formed with row strips 60DR and column strips 66DC laterally separates sub-pixels 34R, 36G, and 38B from one another.

A blanket electrically non-insulating light-reflective layer (not shown), corresponding to non-insulating light-reflective anode layer 52, is deposited on top of the structure to function as the anode for the flat-panel display. With the anode layer being sufficiently thin that the contours of the row channels are closely reflected in the upper surface of the anode layer, thin flat equal-width spacer walls (not shown) are inserted vertically into some or all of these channels in the anode layer. Black column strips 66DC protrude upwards sufficiently far beyond black row strips 60DR that the ends of the segments of column strips 66DC, as coated with the anode material, laterally constrain the spacer walls.

All of the advantages described above for the flat-panel display manufactured according to the process of FIGS. 3 and 4 apply to the flat-panel display manufactured according to the process of FIG. 7 and 8. In short, the spacer walls are largely not visible at the front of the display, the black matrix adheres strongly to faceplate 20, and the ratio of light-emitting area to total active area is high, thereby enhancing the display brightness.

The process variation of FIGS. 5 and 6 can be applied to the fabrication process of FIGS. 7 and 8. In this case, row strips 60ER are provided with slots (or notches) corresponding to slots 40S in row strips 40NR. After the row strip blackening operation is completed, black row strips 60DR have slots corresponding to slots 40S in black row strips 40IR. Consequently, the segments of column strips 66DC are shaped like the segments of column strips 56DC in FIG. 6*e*. Subsequent to forming the light-reflective anode layer, the so-modified anode-coated segments of column strips 66DC laterally constrain the spacer walls in the manner described above for the process variation of FIGS. 5 and 6 so as to substantially reduce the likelihood of having the spacer walls be visible on exterior faceplate surface 20E.

Figure 9A:
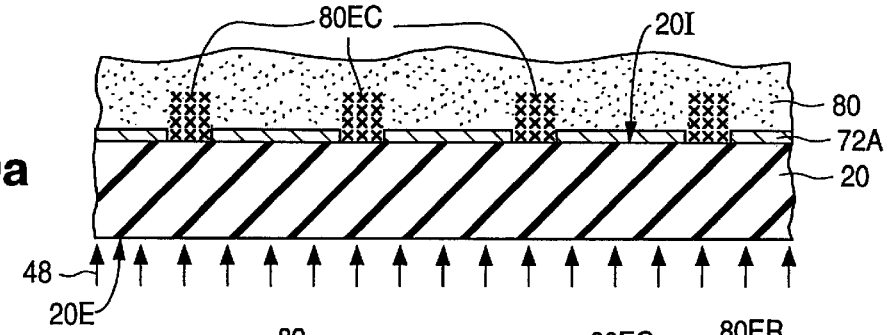
FIGS. 9*a*–9*f* are cross-sectional side views representing steps in a process that follows the invention's teachings for manufacturing a wall-securing black matrix, light-emissive elements, and a light-reflective anode of a faceplate structure for a flat-panel CRT display starting from the stage of FIG. 3*f* repeated here as FIG. 9*a* subject to changes in certain of the reference symbols.
Figure 9B:
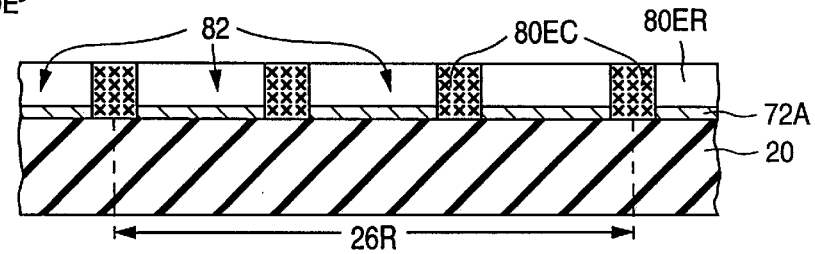
Figure 9C:
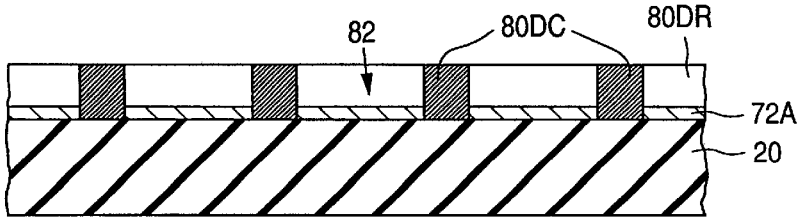
Figure 9D:
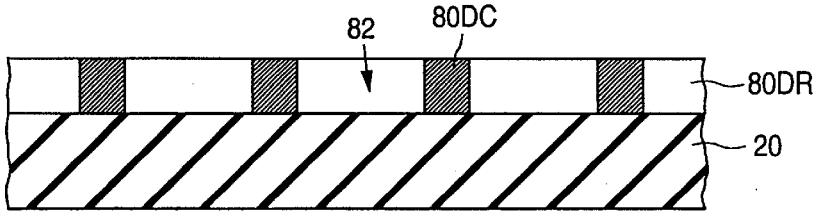
Figure 9E:
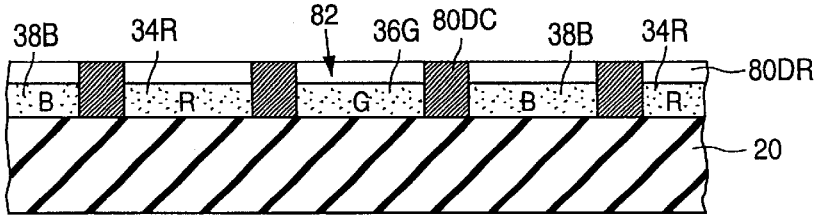
Figure 9F:
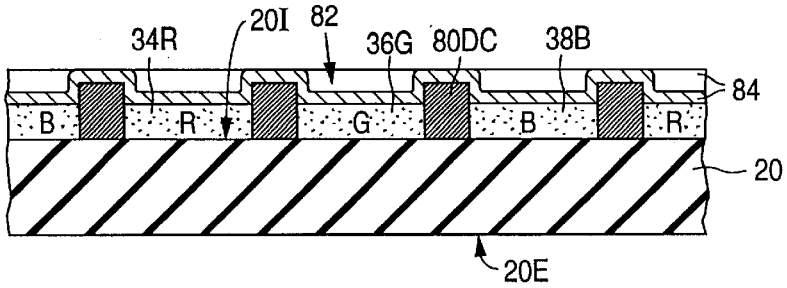
Figure 10A:
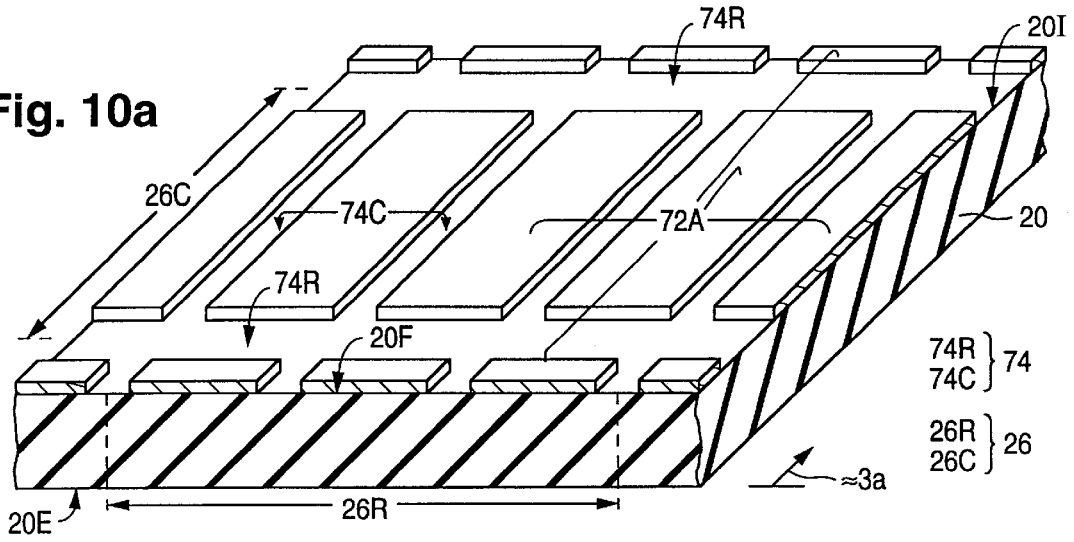
FIGS. 10*a*–10*g* are perspective views respectively corresponding to FIGS. 3*a*, 3*c*, 3*d*, 9*a*, 9*b*, 9*d*, and 9*e* in the overall process of FIGS. 3*a*–3*e* and 9*a*–9*f*. The correspondence between FIGS. 10*a*–10*c*, on one hand, and FIGS. 3*a*, 3*c*, and 3*d*, on the other hand, is subject to changes in certain of the reference symbols. The horizontal lines from which slanted arrows 3*a*, 3*c*, and 3*d* originate in FIGS. 10*a*–10*c* respectively indicate where the cross sections of FIGS. 3*a*, 3*c*, and 3*d* are taken in FIGS. 10*a*–10*c* subject to the specified reference symbol changes as indicated by the approximate signs before slanted arrows 3*a*, 3*c*, and 3*d*. The horizontal lines from which slanted arrows 9*a*, 9*b*, 9*d*, and 9*e* originate in FIGS. 10*d*–10*g* respectively indicate where the cross sections of FIGS. 9*a*, 9*b*, 9*d*, and 9*e* are taken in FIGS. 10*d*–10*g*.
Figure 10B:
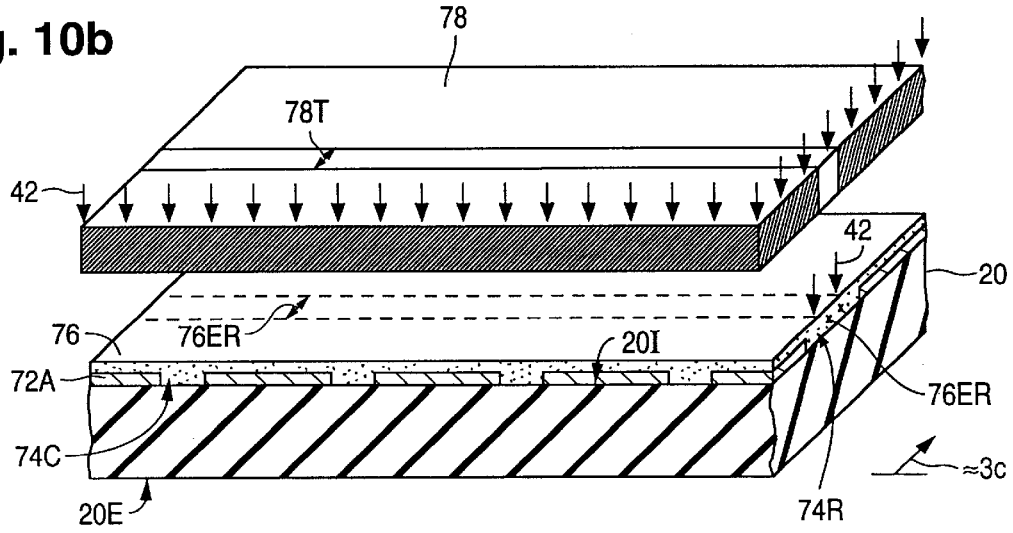
Figure 10C:
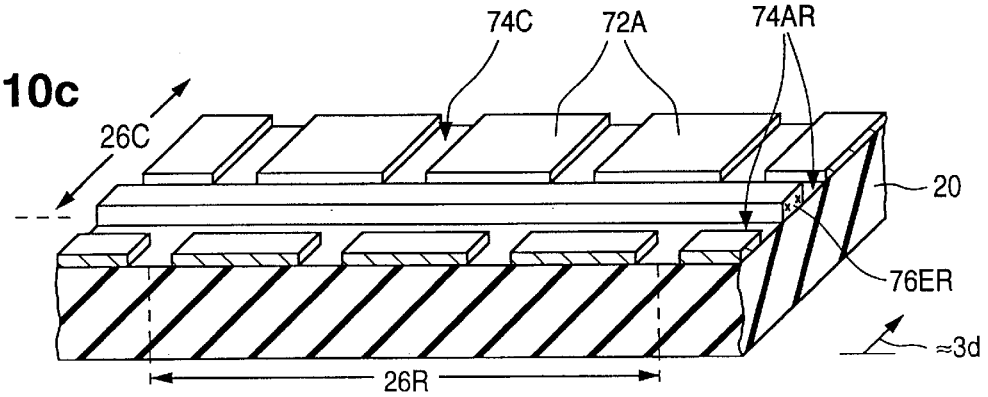

FIGS. 9*a*–9*e* (collectively "FIG. 9") and FIGS. 10*c*–10*g* (collectively "FIG. 10") illustrate how a black matrix and light-emissive elements for a faceplate structure of a color flat-panel CRT display are fabricated in accordance with the invention so as to provide the black matrix with wall-gripping features for securely holding spacer walls in place. Subject to changing certain of the reference symbols, FIGS. 3*a*–3*d* are employed in conjunction with FIGS. 10*a*–10*c* to illustrate the fabrication process of FIGS. 9 and 10. In so utilizing FIGS. 3*a*–3*d*, the reference symbol changes for one of FIGS. 3*a*–3*d* carry over to each later one of FIGS. 3*a*–3*d* even though those reference symbol changes are not further mentioned in the description below. FIGS. 10*a*–10*c* illustrate the structure at the stages respectively shown in FIGS. 3*a*, 3*c*, and 3*d* subject to the indicated reference symbol changes. FIGS. 10*d*–10*g* illustrate the structure at certain of the stages shown in FIG. 9.

The process of FIGS. 9 and 10 begins at the stage shown in FIGS. 3*a* and 10*a* subject to changing reference symbols "22A" and "24C" respectively to "72A" and "74C" in FIG. 3*a*. Items 72A are therefore portions of a sacrificial masking layer. When the actinic material employed in forming (part of) the black matrix is selectively exposed to actinic radiation in the form of UV light, mask portions 72A are normally opaque.

Rectangular mask portions 72A are laterally separated by open space 74 consisting of equal-width row openings 74R and equal-width column openings 74C. Mask portions 72A typically have the same width and same spacing in the row direction as mask portions 22A. Accordingly, column openings 74C are typically of the same width as column openings 24C in the process of FIGS. 1 and 2. However, mask portions 72A are typically shorter than mask portions 22A. With each pixel 26 being approximately square in the process of FIGS. 9 and 10, row openings 74R are typically wider than row openings 24R in the process of FIGS. 1 and 2.

An auxiliary blanket layer 76 of negative-tone actinic material is formed on top of mask portions 72A and into open space 74. See FIG. 3*b*, subject to changing reference symbol "40"to "76" (and making the other-indicated reference symbol changes). Auxiliary actinic layer 76 typically has the same general characteristics, including thickness, as auxiliary actinic layer 40 and normally consists of photo-polymerizable polyimide processed in the same way as the photo-polymerizable polyimide of layer 40. The thickness of actinic layer 76 can vary somewhat from point to point.

Auxiliary actinic layer 76 is to be transformed into row strips of the black matrix. The transformation process is initiated with the frontside exposure step depicted in FIGS. 3*c* and 10*b*, subject to changing reference symbol "44" to "78" in FIG. 3*c*. To simplify the illustration, the variation in thickness of actinic layer 76 is not shown in FIG. 10*b*.

The frontside exposure consists of selectively exposing actinic layer 76 to frontside actinic radiation 42 through a photomask 78 corresponding generally to photomask 44. The depth of exposure of frontside radiation 42 is greater than the maximum thickness of layer 76. As indicated in FIG. 10*b*, portions of radiation 42 pass through radiation-transparent mask area 78T and cause underlying equal-width exposed row strips 76ER of actinic layer 76 to change chemical structure. When layer 76 is formed with photo-polymerizable polyimide, radiation 42 is typically UV light that causes the exposed polyimide to polymerize. The frontside exposure with radiation 42 is typically performed in the same way as in the process of FIGS. 3 and 4.

Row strips 76ER extend in the row direction. Each row strip 76ER is centered width-wise on a corresponding one of row openings 74R. Row strips 76ER are narrower than row openings 74R. Consequently, each row strip 76ER fills only part of the width of corresponding row opening 74R.

From this point on, the structure of FIGS. 3*c* and 10*b* is processed in the same manner as the structure of FIGS. 3*c* and 4*a* in the process of FIGS. 3 and 4. However, the final structure is significantly different because the row strips are narrower than the row openings in the process of FIGS. 9 and 10 rather than being wider as occurs in the process of FIGS. 3 and 4.

Specifically, the unexposed material of auxiliary layer 76 is removed with a developer. FIGS. 3*d* and 10*c* depict the resultant structure, subject to changing reference symbol "40ER" to "76ER" in FIG. 3*d*. Since row strips 76ER are wider than, and respectively centered width-wise on, row openings 74R, the remainder of each row opening 74R forms a pair of channels 74AR that respectively extend along the longitudinal edges of corresponding row strip 76ER. For a typical example in which row openings 74R are approximately 90 μm in width while row strips 76ER are approximately 50 μm in width, each row channel 74AR is approximately 20 μm in width.

Figure 10D:
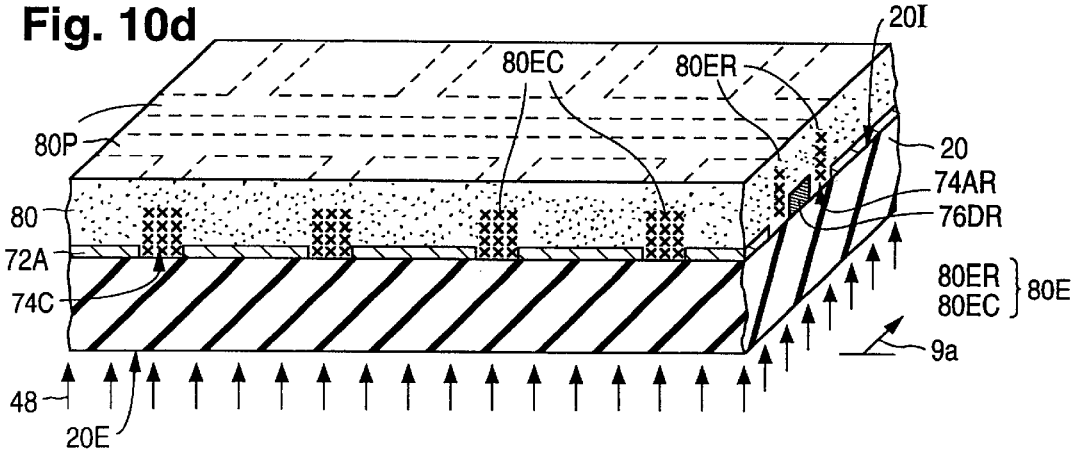

Row strips 76ER are normally blackened to form black matrix row strips 76DR, first shown in FIG. 10*d*. Pyrolysis is employed to blacken row strips 76ER when they consist of photo-polymerizable polyimide. Some shrinkage (not shown) is produced in black row strips 76DR as a result of the pyrolysis. The shrinkage affects the width of the channels in which spacer walls are later inserted and thus needs to be taken into account in choosing the spacer wall thickness relative to the original width of row strips 76ER. Black row strips 76DR, which generally correspond to black row strips 40DR in the process of FIGS. 3 and 4, are capable of blocking actinic radiation in the form of UV light.

A primary blanket layer 80 of negative-tone actinic material is formed on top of the structure. See FIGS. 9*a* and 10*d*. Primary actinic layer 80, which corresponds to primary actinic layer 46 in the process of FIGS. 3 and 4, has similar characteristics, including thickness, to actinic layer 46 and typically consists of photo-polymerizable polyimide. The thickness of actinic layer 80 can vary appreciably from point to point as indicated in FIG. 9*a*. To simplify the illustration, the variation in thickness of layer 80 is not shown in FIG. 10*d*.

Primary actinic layer 80 is to be transformed into black matrix column strips and black matrix row bars which, when coated with light-reflective anode material, can securely grip spacer walls. The transformation process is initiated with the backside exposure step depicted in FIGS. 9*a* and 10*d*. The backside exposure is performed in the same way as in the process of FIGS. 3 and 4.

The backside exposure consists of selectively exposing actinic layer 80 to backside actinic radiation 48 through a mask formed with mask portions 72A and black row strips 76DR. The portion of backside radiation 48 not blocked by mask portions 72A and strips 76DR passes into column openings 74C and row channels 74AR, and causes overlying exposed material 80E of primary actinic layer 80 to change chemical structure. The general plan-view pattern of exposed primary material 80E is indicated by item 80P in FIG. 10*d*. Exposed primary material 80E consists of equal-width row bars 80ER and equal-width column strips 80EC that merge into row bars 80ER. Row bars 80ER and column strips 80EC are respectively formed at the locations of row channels 74AR and column openings 74C. Since channels 74AR exist in pairs, row bars 80ER are present in pairs. Radiation 48 is typically UV light that causes the exposed actinic material to polymerize when it consists of photo-polymerizable polyimide.

The depth of exposure of backside radiation 48 is not significantly greater than the minimum thickness of primary layer 80. Unexposed portions of primary layer 80 are thereby situated at various locations above row bars 80ER and column strips 80EC. As in the process of FIGS. 3 and 4, the distance at which these unexposed actinic portions are located above faceplate 20 is greater than the exposure depth of radiation 48. FIGS. 9 and 10 illustrate the typical situation in which the exposure depth of radiation 48 is less than the minimum thickness of layer 80 so that unexposed portions of layer 80 overlie all of row bars 80ER and column strips 80EC.

Importantly, substantially no unexposed (or underexposed) actinic material of primary layer 80 lies between faceplate 20, on one hand, and bars 80ER and strips 80EC, on the other hand. With the highest density of polymer cross-links, and thus the greatest extent of polymerization, occurring in bars 80ER and strips 80EC along interior faceplate surface 20I, bars 80ER and strips 80EC adhere strongly to faceplate 20.

Figure 10E:
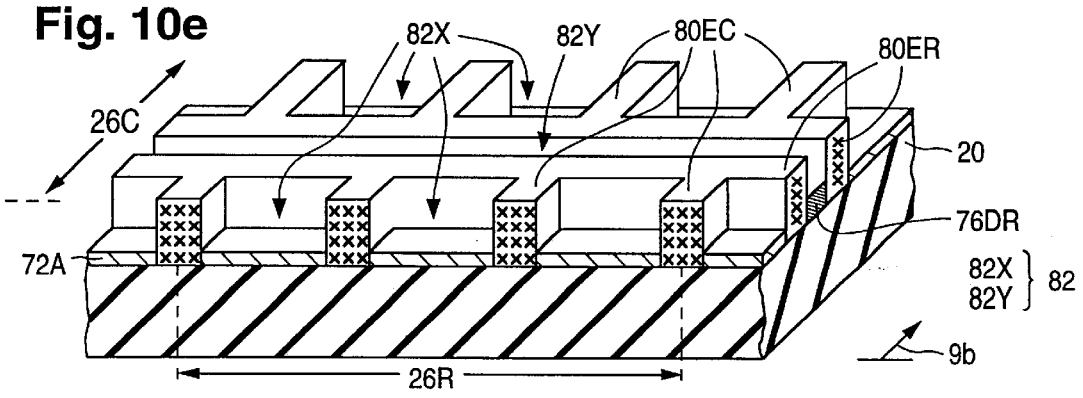

The unexposed material of primary layer 80 is removed with a developer to produce the structure generally depicted in FIGS. 9*b* and 10*e*. The likelihood of having any material of row bars 80ER or column strips 80EC separate from faceplate 20 during the development step is very low. The width profiles of bars 80ER and strips 80EC are actually in the rough shape of upright isosceles trapezoids. For simplicity in illustration, FIGS. 9*b* and 10*e* illustrate the width profiles of bars 80ER and strips 80EC as rectangles.

Open space 82, consisting of rectangular column openings 82X and row channels 82Y, laterally separates the portions of exposed actinic material 80E. Specifically, column openings 82X are situated to the longitudinal sides of column strips 80EC and uncover mask portions 72A. Row channels 82Y are situated above row strips 76ER. Each row channel 82Y separates the two row bars 80ER in a corresponding one of the pairs of bars 80ER. Due to the way in which the exposure steps are performed, each pair of row bars 80ER have longitudinal sides that meet the opposite longitudinal sides of intervening row strip 76ER to form overlying channel 82Y. Since bars 80ER have width profiles generally in the shape of upright isosceles trapezoids, each row opening 82Y has a width profile generally in the shape of an inverted isosceles trapezoid.

With column strips 80EC and row bars 80ER typically not being dark enough for black matrix usage, strips 80EC and bars 80ER are blackened to respectively form black matrix column strips 80DC and black matrix row bars 80DR of black matrix portion 80D. See FIG. 9*c*. When strips 80EC and bars 80ER are formed with photo-polymerizable polyimide, the blackening is typically done by pyrolysis in the manner described above. Strips 80EC and bars 80ER shrink during the pyrolysis. The shrinkage, not shown in the drawings, causes the upward isosceles trapezoidal shape of the width profiles of strips 80EC and bars 80ER to be accentuated as they are transformed into black strips 80DC and black bars 80DR.

In a typical example where row channels 74AR and row strips 76ER were respectively 90 and 50 μm in width, shrinkage during the earlier pyrolysis operation leads to an original bottom width of somewhat greater than 20 μm for each of row bars 80ER. The top side of each row bar 80ER typically shrinks 10 μm during the pyrolysis in which row bars 80ER are converted into black row bars 80DR. Accordingly, the width of the top of each row channel 82Y typically increases 10 μm from somewhat greater than 50 μm to somewhat greater than 60 μm.

Black row strips 76DR, black row bars 80DR, and black column strips 80DC form the black matrix. Each row strip 76DR in combination with the adjacent pair of row bars 80DR forms a composite black matrix row strip 76DR/80DR. Inasmuch as actinic layer 80 was considerably thicker than actinic layer 76, row bars 80DR and column strips 80DC extend considerably further above faceplate interior surface 20I than row strips 76DR. Each pair of row bars 80DR, as separated by one row channel 82Y that extends down to corresponding row strip 76DR, provides a wall-gripping feature in the black matrix.

Figure 10F:
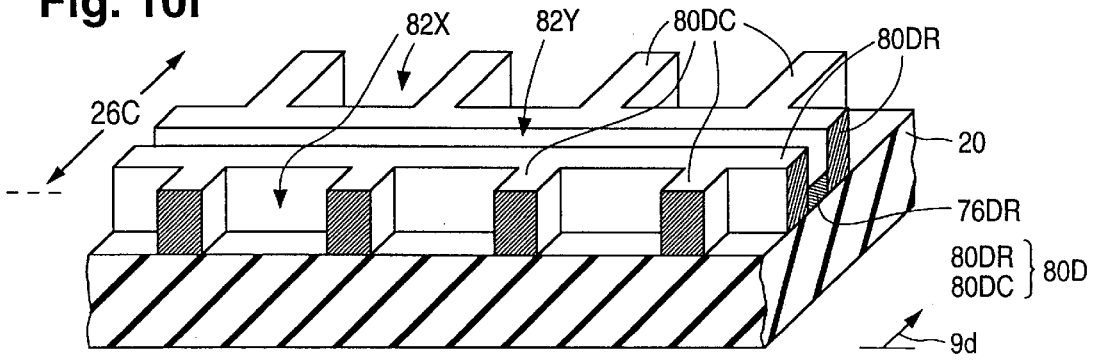

Mask portions 72A are removed as shown in FIGS. 9*d* and 10*f*. All of the sacrificial masking layer formed with mask portions 72A is thus now gone. In removing mask portions 72A, column openings 82X are extended down to faceplate 20.

Figure 10G:
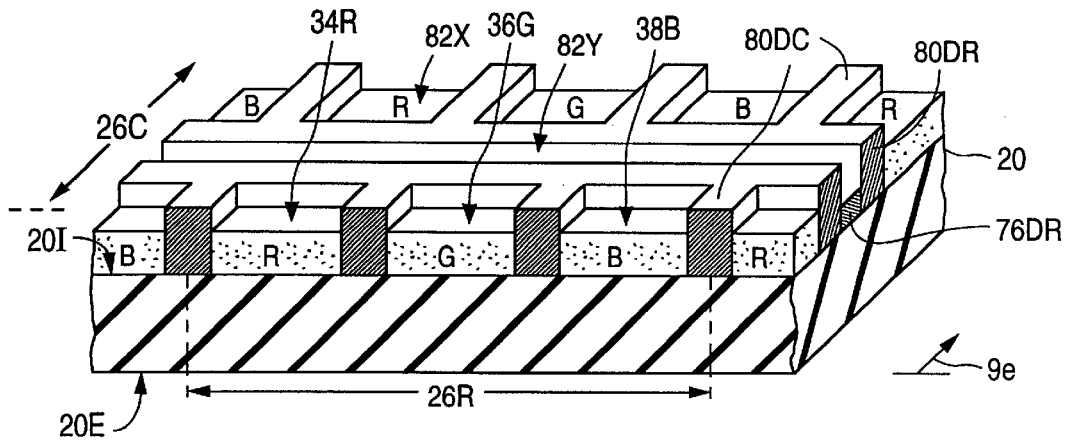

Each pixel 26 in FIGS. 9*d* and 10*f* contains three column openings 82X into which phosphors 34R, 36G, and 38B are respectively introduced according to the process of FIGS. 1 and 2. The resultant structure is shown in FIGS. 9*e* and 10*g*. The black matrix formed with row strips 76DR, row bars 80DR, and column strips 80DC laterally separates sub-pixels 34R, 36G, and 38B from one another in each pixel 26 and from sub-pixels 34R, 36G, and 38B in other pixels 26.

A blanket electrically non-insulating light-reflective layer 84 corresponding to light-reflective anode layer 52 is deposited on top of the structure. See FIG. 9*f*. Details on the formation of light-reflective anode layer 84 are given further below. Anode layer 84 is sufficiently thin that the contours of row channels 82Y are closely reflected in the upper surface of layer 84 so as to produce corresponding row channels in the upper anode surface. Accordingly, wall grippers corresponding to the wall-gripping features provided by the pairs of row bars 80DR, as separated by row channels 82Y, in the black matrix are produced in the upper surface of layer 84.

Thin flat equal-width spacer walls (not shown) are inserted vertically into some or all of these row channels formed in the upper surface of anode layer 84. The two sidewalls of each wall-gripping channel extend along the full length of the portion of the edge of the spacer wall inserted into the channel so as to securely hold the spacer wall in place. Since row channels 82Y have width profiles roughly in the shape of inverted isosceles trapezoids, the wall-gripping channels in the anode surface are slightly wider at the top than at the bottom. This facilitates insertion of the spacer walls into the wall-gripping channels in the upper anode surface.

The spacer wall thickness is less than the thickness of composite row strips 76DR/80DR. Specifically, the spacer wall thickness is typically slightly less than the bottom width of row channels 82Y. When inserted into the row channels present in anode layer 84, the spacer walls are fully shadowed by composite row strips 76DR/80DR in looking at exterior surface 20E of faceplate 20 from the direction generally perpendicular to exterior surface 20E. This is true even if one of row bars 80DR in each pair of bars 80DR is wider (in the column direction) than the other row bar 80DR. The process of FIGS. 9 and 10 thus provides a black matrix which strongly adheres to faceplate 20 and which securely holds spacer walls in such a way that they are largely not visible on the exterior viewing area of the flat-panel CRT display.

The ability of a feature to laterally constrain the movement of a spacer wall depends, among other things, on the relative height of the constraining feature—i.e., the vertical distance from the top of the constraining feature to the surface that an edge of the wall contacts in the constraining feature. As the relative height of the constraining feature increases, the vertical surface area that laterally constrains the wall increases so as to present increasing resistance to lateral movement of the wall. In addition, it becomes more difficult for the wall to slip out of the constraining feature. Consequently, the ability of a feature to laterally constrain a wall generally increases as the relative height of the constraining feature increases.

When a wall-constraining feature consists of a basic wall-constraining feature covered by one or more relatively thin layers of approximately constant is thickness, the relative height of the constraining feature is essentially the relative height of the basic constraining feature. Also, when the height of the top of the constraining feature can be controlled independently of the height of the surface that the edge of the wall contacts in the constraining feature, the ability of the feature to laterally constrain the wall improves as the height of the top of the constraining feature increases.

Both of the preceding considerations apply to flat-panel displays manufactured according to the processes of FIGS. 3–10 where the anode layers (e.g., 52 or 84) cover basic features established in the black matrices for laterally constraining spacer walls and where the heights of black column strips 46DC, 56DC, and 66DC and black row bars 80DR constitute the heights of the tops of the constraining features and are respectively independently controllable from the heights of black row strips 40DR, 40IR, 60DR, and 76DR over which the edges of the spacer walls are placed. Hence, increasing the height of column strips 46DC, 56DC, and 66 DC and row bars 80DR improves the ability to laterally constrain spacer walls.

The heights of black column strips 46DC, 56DC, and 66DC and black row bars 80DR are controlled by the backside exposure process and by the original respective thicknesses of actinic layers 46, 56, 66, and 80. By arranging for actinic layers 46, 56, 66, and 80 to be relatively thick but not thick enough to be fully penetrated by backside actinic radiation 48, relatively great heights can be respectively achieved for column strips 46DC, 56DC, and 66DC and row bars 80DR while simultaneously enabling them to be strong and adhere well to faceplate 20. Accordingly, the processes of FIGS. 3–10 provide excellent features for constraining the movement of spacer walls.

A black matrix of increased height is advantageous regardless of whether it does, or does not, have features for constraining spacer walls. The percentage of scattered electrons that can degrade the image presentation through phenomena such as charging the spacer walls and striking the wrong pixels decreases with increasing black matrix height. As with the processes of FIGS. 3–10, the process of FIGS. 1 and 2 readily enables black strips 28DR and 28DC to be formed at relatively great heights. Consequently, the processes of FIGS. 1–10 result in better image presentation.

A tall black matrix that reduces undesired effects of electron scattering and contains features for strongly constraining spacer walls can be achieved with processes akin to those of FIGS. 3–10 when the backside radiation fully penetrates the actinic layer from which the tops of the constraining features are created. Likewise, a tall black matrix that reduces undesired electron-scattering effects can be achieved in a process akin to that of FIGS. 1 and 2 when the backside radiation fully passes through the actinic layer from which the black matrix is created.

Figure 11A:
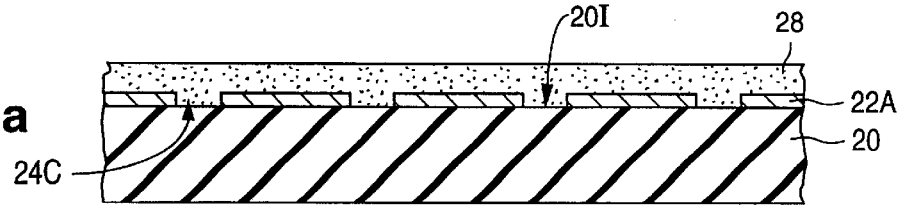
FIGS. 11*a* and 11*b* are cross-sectional side views representing steps that can be substituted for the steps of FIGS. 1*d* and 1*e* according to the invention.
Figure 11B:
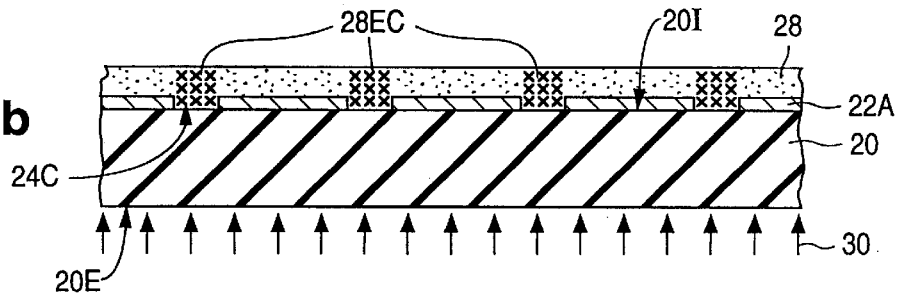
Figure 12A:
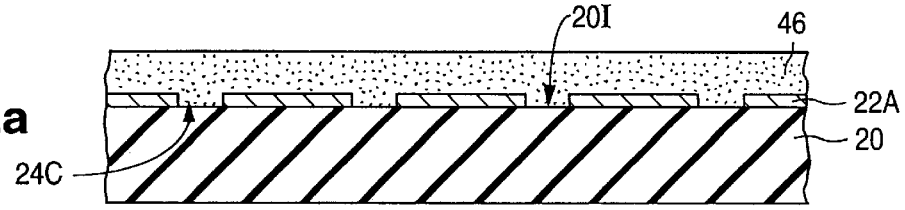
FIGS. 12*a* and 12*b* are cross-sectional side views representing steps that can be substituted for the steps of FIGS. 3*e* and 3*f* according to the invention.
Figure 12B:
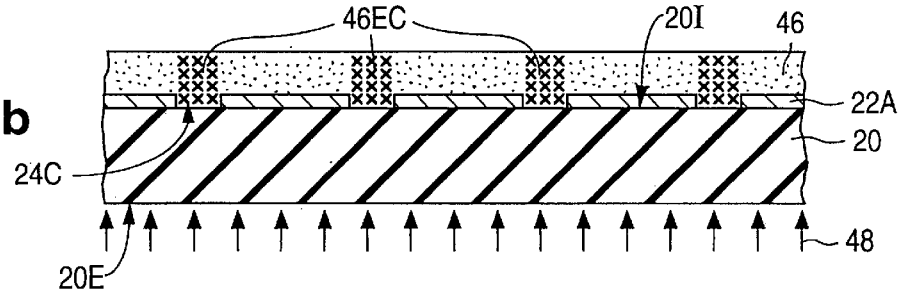
Figure 13A:
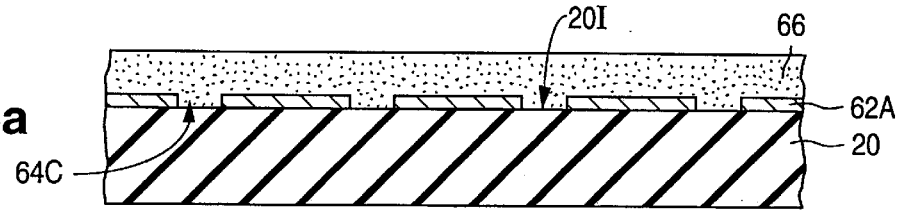
FIGS. 13*a* and 13*b* are cross-sectional side views representing steps that can be substituted for the steps of FIGS. 7*f* and 7*g* according to the invention.
Figure 13B:
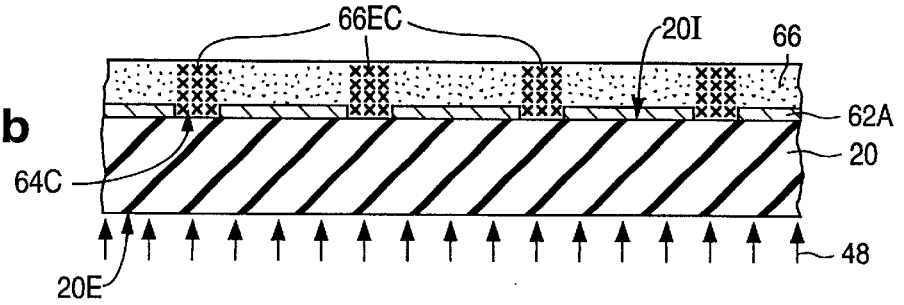
Figure 14:
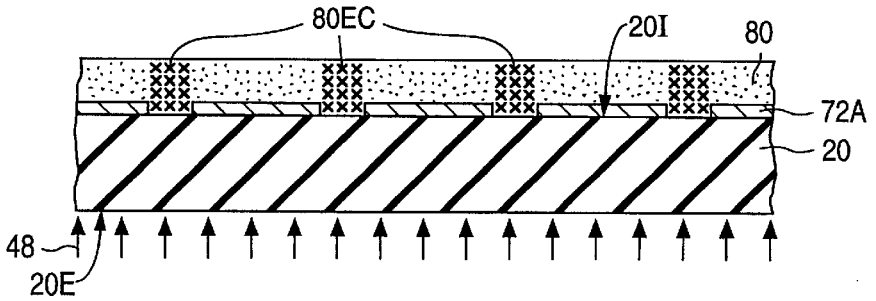
FIG. 14 is a cross-sectional view representing a step that can be substituted for the step of FIG. 9*a* according to the invention.

FIGS. 11*a* and 11*b* (collectively "FIG. 11") present steps that replace the steps of FIGS. 1*d* and 1*e* in a variation of the process of FIGS. 1 and 2 for which backside actinic radiation 30 fully penetrates the unshielded material of actinic layer 28. FIGS. 12*a* and 12*b* (collectively "FIG. 12") present steps that replace the steps of FIGS. 3*e* and 3*f* in a variation of the process of FIGS. 3 and 4 for which backside actinic radiation 48 fully penetrates the unshielded material of actinic layer 46. Subject to changing reference symbols "46" and "46EC" respectively to "56" and "56EC" in accordance with the reference symbol changes described above for enabling FIGS. 3*a*–3*k* to be utilized in illustrating the process of FIGS. 5 and 6, a similar variation to the process of FIGS. 5 and 6 is presented with the assistance of FIG. 12 when backside radiation 48 fully penetrates the unshielded material of actinic layer 56. FIGS. 13*a* and 13*b* (collectively "FIG. 13") present steps that replace the steps of FIGS. 7*f* and 7*g* in a variation of the process of FIGS. 7 and 8 for which radiation 48 fully penetrates the unshielded material of actinic layer 66. Finally, FIG. 14 presents a step that replaces the step of FIG. 9*a* in a variation of the process of FIGS. 9 and 10 for which radiation 48 fully penetrates the unshielded material of actinic layer 80.

Penetration of the backside radiation (30 or 48 ) fully through the actinic layer (28, 46, 56, 66, or 80) can be achieved by decreasing the thickness of the actinic layer, by increasing the depth of exposure of the backside radiation by suitably modifying the exposure conditions, or by a combination of decreasing the actinic layer thickness and increasing the backside radiation's depth of exposure. For example, in the variation of FIG. 12, the average thickness of actinic layer 46 or 56 remains at 50–200 $\mu$m, typically 100 $\mu$m. In the case of Olin OCG7020 polyimide and a 100-$\mu$m thickness for layer 46 or 56, the backside exposure with radiation 48 when it consists of UV light is performed at an exposure dosage in excess of 300 mJ/cm$^2$ and a UV wavelength of 405 nm so as to increase the depth of exposure of radiation 48. Accordingly, radiation 48 fully penetrates actinic layer 46 or 56.

In the process variations of FIGS. 11–14, the depth of exposure of the backside radiation typically exceeds the actinic layer thickness by such an amount that the width profiles of unblackened strips 28ER, 28EC, 46EC, 56EC, 66EC, and 80EC and bars 80ER are generally shaped like rectangles with rounded upper-edge and side-edge corners. That is, the sides of strips 28ER, 28EC, 46EC, 56EC, 66EC, and 80EC and bars 80ER are not slanted significantly inward so as to produce upright isosceles trapezoidal width profiles. Likewise, the length profiles of the segments of column strips 46EC, 56EC, and 66EC are generally shaped like rectangles with rounded upper-edge and side-edge corners.

Figure 15:
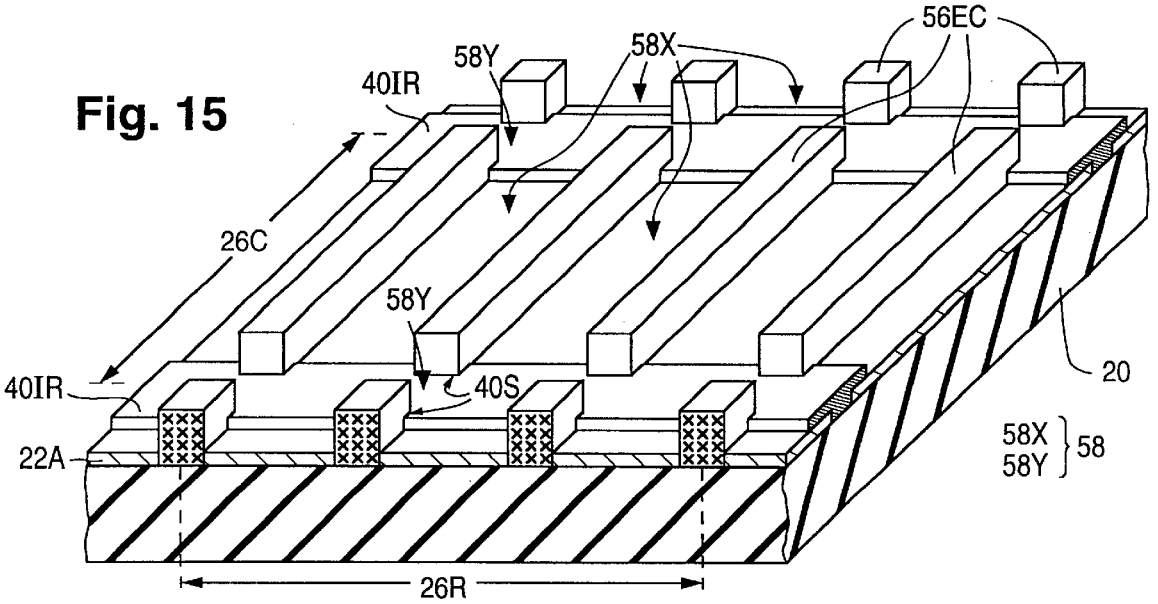
FIG. 15 is a perspective view representing a step that can be substituted for the step of FIG. 6*d* according to the invention.

FIG. 15 presents a step that replaces the step of FIG. 6*d* when the variation of FIG. 12 is applied to the process of FIGS. 5 and 6. FIG. 15 specifically illustrates the general rectangular shape of the length profiles for the segments of column strips 56EC when they are produced according to the process variation of FIG. 12.

As discussed above, it is generally advantageous for the segments of black column strips 56DC to have length profiles roughly in the shape of upright isosceles trapezoids. Insertion of spacer walls into the open regions between the ends of consecutive segments of column strips 56DC is facilitated. Even though unblackened column strips 56EC may not be produced with upright isosceles trapezoidal length profiles in the process variation of FIGS. 12 and 15, shrinkage during the blackening operation performed on strips 56EC normally causes the segments of black column strips 56DC to have length profiles roughly in the shape of upright isosceles trapezoids. Accordingly, the desired shape for the length profiles of the black column-strip segments is achieved in the process variation of FIGS. 12 and 15.

As discussed below, it is generally advantageous for the strips of a black matrix to have width profiles roughly in the shape of upright isosceles trapezoids. Although unblackened strips 28ER, 28EC, 46EC, 56EC, 66EC, and 80EC and bars 80ER may not be produced with upright isosceles trapezoidal width profiles in the process variations of FIGS. 11–15, shrinkage (including thickness reduction) during the blackening operations performed on strips 28ER, 28EC, 46EC, 56EC, 66EC, and 80EC and bars 80ER respectively typically causes black strips 28DR, 28DC, 46DC, 56DC, 66DC, and 80DC and black bars 80DR to have width profiles roughly shaped like upright isosceles trapezoids. In particular, this occurs when the blackening operations are performed by pyrolitic procedures.

Figure 16A:
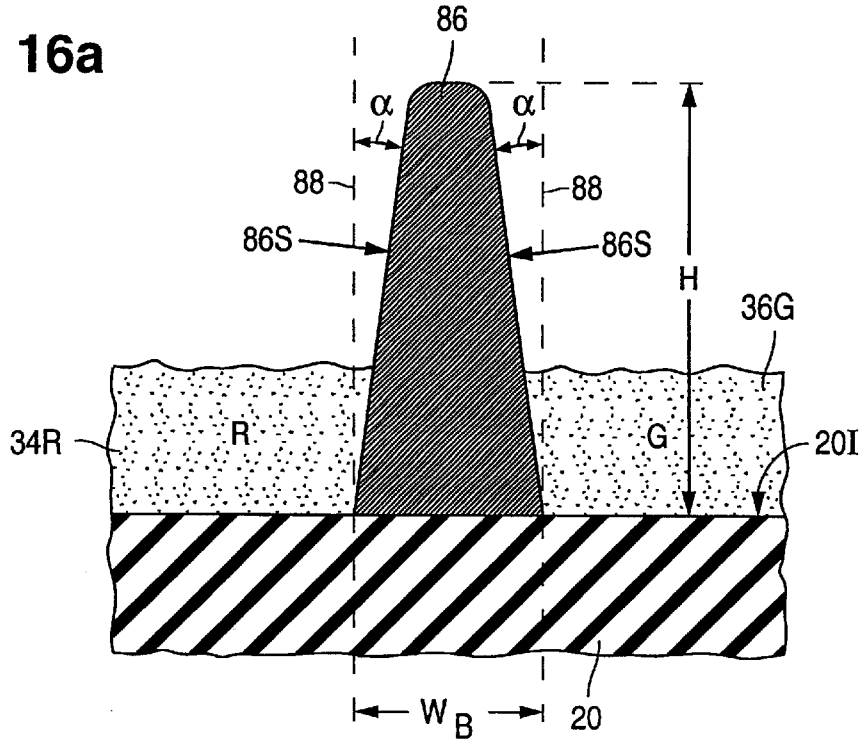
FIGS. 16*a* and 16*b* are cross-sectional side views of a portion of a faceplate structure configured according to the invention so as to have black matrix strips whose width profiles are roughly shaped like upright isosceles trapezoids.

FIG. 16*a* illustrates a simplified expanded cross-sectional view of a portion of a faceplate structure manufactured according to any of the processes of FIGS. 1–10, including the process variations of FIGS. 11–15. The view of FIG. 16*a* is centered around a black strip 86 created from an actinic layer selectively exposed to backside actinic radiation in accordance with the invention. The actinic layer employed in creating black strip 86 can be any one of actinic layers 28, 46, 56, 66, and 80, while the backside radiation is radiation 30 or 48. Black strip 86 thus generally represents any one of black strips 28DR, 28DC, 46DC, 56DC, 66DC, and 80DC and black bars 80DR. Black strip 86 is situated on faceplate 20 and adjoins two phosphor regions represented by exemplary phosphor regions 34R and 36G.

The cross section of FIGS. 16*a* is taken across the width of black strip 86 in order to illustrate the rough upright isosceles trapezoidal shape of the width profile of strip 86. Items 86S in FIG. 16*a* indicate the slanted lateral sides of strip 86. The upright isosceles trapezoidal width profile of strip 86 is characterized by a tilt angle $\alpha$ between either slanted side 86S and a line 88 running perpendicular to interior surface 20I of baseplate 20. Although the cross section of strip 86 is somewhat simplified in FIG. 16*a* and does not show the roughness and curvature actually present along lateral sides 86S, a good approximation to tilt angle $\alpha$ can be attained by averaging out the surface roughness and curvature along sides 86S.

For a flat-panel display manufactured according to any of the processes of FIGS. 1–10, including the process variations of FIGS. 11–15, tilt angle $\alpha$ is normally at least 2°, preferably 5° or more. The maximum possible value of angle $\alpha$ depends on the aspect ratio $H/W_B$ of black strip 86, where H is the height of strip 86, and $W_B$ is the width at the base of strip 86. For a given value of aspect ratio $H/W_B$, the maximum possible value of angle $\alpha$ occurs when the isosceles trapezoid degenerates into an isosceles triangle. At that point, $$\tan\alpha = \frac{W_B/2}{H} \tag{1}$$

Accordingly, the maximum possible value $\alpha_{MP}$ of tilt angle $\alpha$ as a function of aspect ratio $H/W_B$ is given as:

$$\alpha_{MP} = \tan^{-1}\left(\frac{W_B}{2H}\right) \tag{2}$$

It is typically desirable that aspect ratio $H/W_B$ be at least 1, preferably at least 2. When $H/W_B$ equals 1, $\alpha_{MP}$ is approximately 27°. At $H_B$ equals to 2, $\alpha_{MP}$ is approximately 14°. Having the width profile of black strip 86 degenerate into an isosceles triangle is normally undesirable. Consequently, the maximum acceptable value of tilt angle $\alpha$ is somewhat less than $\alpha_{MP}$ determined from Eq. 2.

A trade-off exists between tilt angle $\alpha$ and aspect ratio $H/W_B$. Increasing aspect ratio $H/W_B$ causes maximum possible tilt angle $\alpha_{MP}$ to decrease (in accordance with Eq. 2), and vice versa. Accordingly, increasing aspect ratio $H/W_B$ normally causes the maximum acceptable value of tilt angle $\alpha$ to decrease, and vice versa.

Figure 16B:
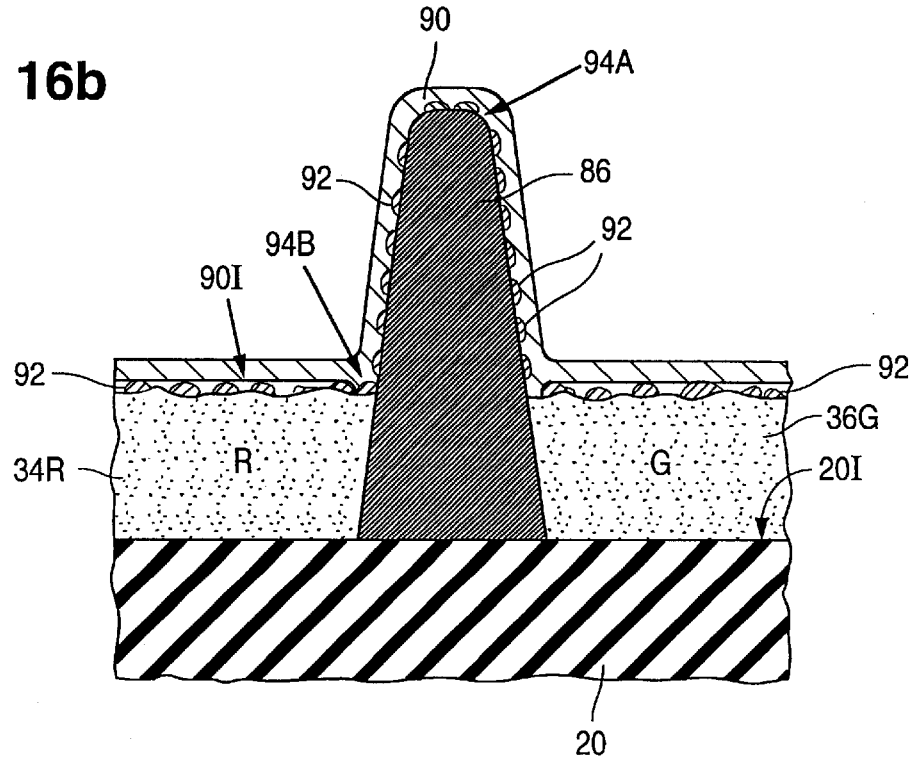

FIG. 16*b* illustrates how the structure of FIG. 16*a* appears after an electrically non-insulating light-reflective anode layer 90 is formed on top of the structure. Anode layer 90 can be any of the anode layers described above in connection with FIGS. 1–15, including anode layer 52 or 84. Item 90I indicates the interior surface of anode layer 90 in FIG. 16*b*. Anode layer 90 is created according to a procedure that enables interior surface 90I to be quite flat and have a high reflectance. When any of phosphor regions 34R, 36G, and 38B emit rear-directed light that strikes anode layer 90, the flat nature of interior surface 90I enables layer 90 to reflect much of the light back towards the front of the flat-panel display.

Anode layer 90 is typically formed in the following manner. A tank is filled with clean de-ionized water. The water overflows the edges of the tank in order to remove any surface particles that may have accumulated during the filling of the tank.

The partially finished faceplate structure represented by the structural portion shown in FIG. 16*a* is rinsed with a solvent and then with water in order to wet the upper surface of the structure. The partially finished structure is then placed into the tank with the phosphor side up so that the top of the structure is 2–3 cm below the water line. Lacquer is injected onto the surface of the water. The solvents in the lacquer evaporate, leaving a flat cross-linked polymeric film on the surface of the water.

The water is drained out of the tank. This allows the polymeric film to settle on top of the light-emissive material and the black matrix—i.e., phosphor regions 34R, 36G, and 38B and the black strips represented by black strip 86 in FIG. 16*a*. In settling on the light-emissive material, the polymeric film largely retains its flat outer shape. The film-covered partially finished faceplate structure is removed from the tank and dried.

Certain areas of the faceplate structure are not to be covered with anode layer 90. These areas are masked, and the partially finished structure is placed in a vacuum chamber. The chamber pressure is pumped down to a value in the range of $10^{-7}$–$10^{-6}$ torr. Aluminum is evaporated onto the unmasked areas of the structure, specifically onto the polymeric film overlying the light-emissive regions and the black matrix, to form anode layer 90. The aluminum thickness is 10–100 nm, typically 50 nm, as indicated above for anode layer 52. The chamber pressure is raised to room pressure after which the nearly finished faceplate structure is removed from the vacuum chamber.

The anode-covered faceplate structure is baked in air at 350–450° C. During the bake step, part of the polymeric lacquer film is removed from the faceplate structure. The remainder of the polymeric lacquer film is oxidized to become a binder that attaches anode layer 90 to the light-emissive regions and the black matrix. FIG. 16*b* illustrates the resultant largely finished faceplate structure. In FIG. 16*b*, the binder is represented by items 92 dispersed along interior anode surface 90I and along the interface between anode layer 90 and the black matrix represented by black strip 86.

Tenting is a phenomenon in which an anode layer in a flat-panel display is spaced apart from a black matrix at certain locations that would otherwise be part of the interface between the anode layer and the black matrix. Extensive tenting typically occurs along the upper-edges corners of the strips of the black matrix and along the areas where the light-emissive material meets the black matrix. Tenting is generally undesirable because it causes the pixel size to be effectively reduced, thereby resulting in a loss of brightness. In addition, flakes of non-adherent anode metal can be dislodged from the anode layer due to tenting. These metal flakes create reliability problems such as short circuits. The metal flakes can also obscure portions of the active area.

By creating black strip 86 so as to have a width profile roughly shaped like an upright isosceles trapezoid, instances of tenting along the interface between anode layer 90 and black strip 86 are reduced. In particular, the corners 94A at the upper edges of strip 86 are not as sharp as the upper-edge corners that occur with rectangular width profiles. This causes the fluid (water above) that wets black strip 86 during the formation of anode layer 90 to cover the top sides of strip 86 more uniformly. Accordingly, less tenting occurs at upper-edge corners 94A.

Also, the corners 94B where black strip 86 meets phosphor regions 34R, 36G, and 38B along interior anode surface 90I are not as sharp as the corners produced with rectangular width profiles. The wetting fluid thus has less tendency to accumulate in the vicinities of corners 94B. Tenting in the vicinities of corners 94B is similarly reduced. The reduction in tenting at corners 94A and in the vicinities of corners 94B enables anode layer 90 to be in contact with black strip 86 over a larger area. This leads to increased display brightness and alleviates the other problems mentioned above.

The brightness of a flat-panel CRT display varies directly with the number of electrons that strike the light-emissive regions. Compared to a rectangular width profile, the upright isosceles trapezoidal width profile of black strip 86 leaves more volume for phosphor regions 34R, 36G, and 38B. The number of electrons that strike regions 34R, 36G, and 38B is thus greater, also leading to increased display brightness. The net result is that forming black strips 28DR, 28DC, 46DC, 56DC, 66DC, and 80DC and black bars 80DR so as to have width profiles generally in the shape of upright isosceles trapezoids causes the performance of a flat-panel display manufactured according to the invention to be enhanced significantly.

Figure 17:
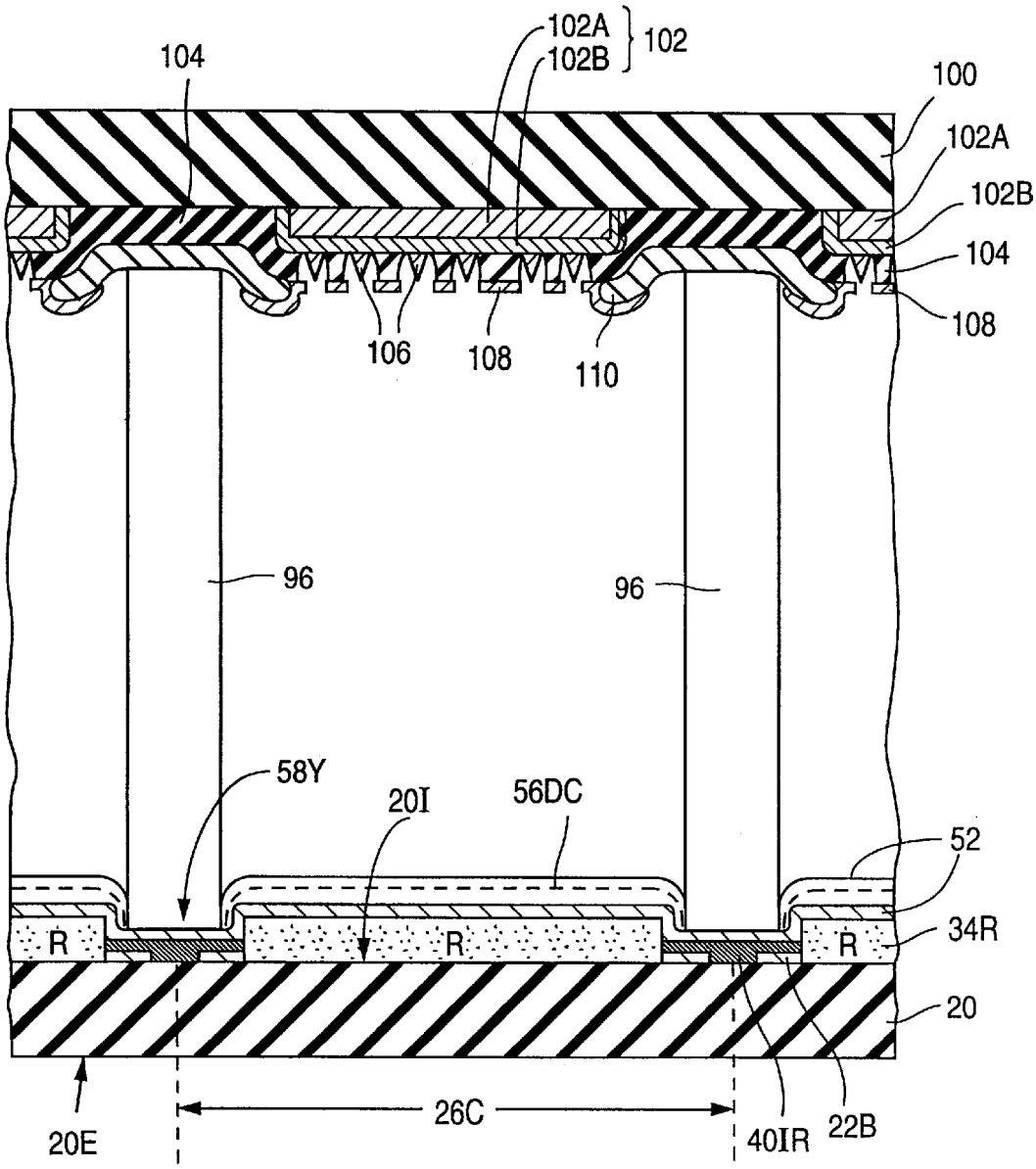
FIG. 17 is a cross-sectional side view of the core of a flat-panel CRT display that employs a faceplate structure having the spacer-constraining black matrix of FIG. 6*f*. The cross section of FIG. 17 is taken through a plane extending along the right-hand side of the structure shown in FIG. 6*f* and thus is perpendicular to the associated approximate view of FIG. 3*j*.
Figure 18:
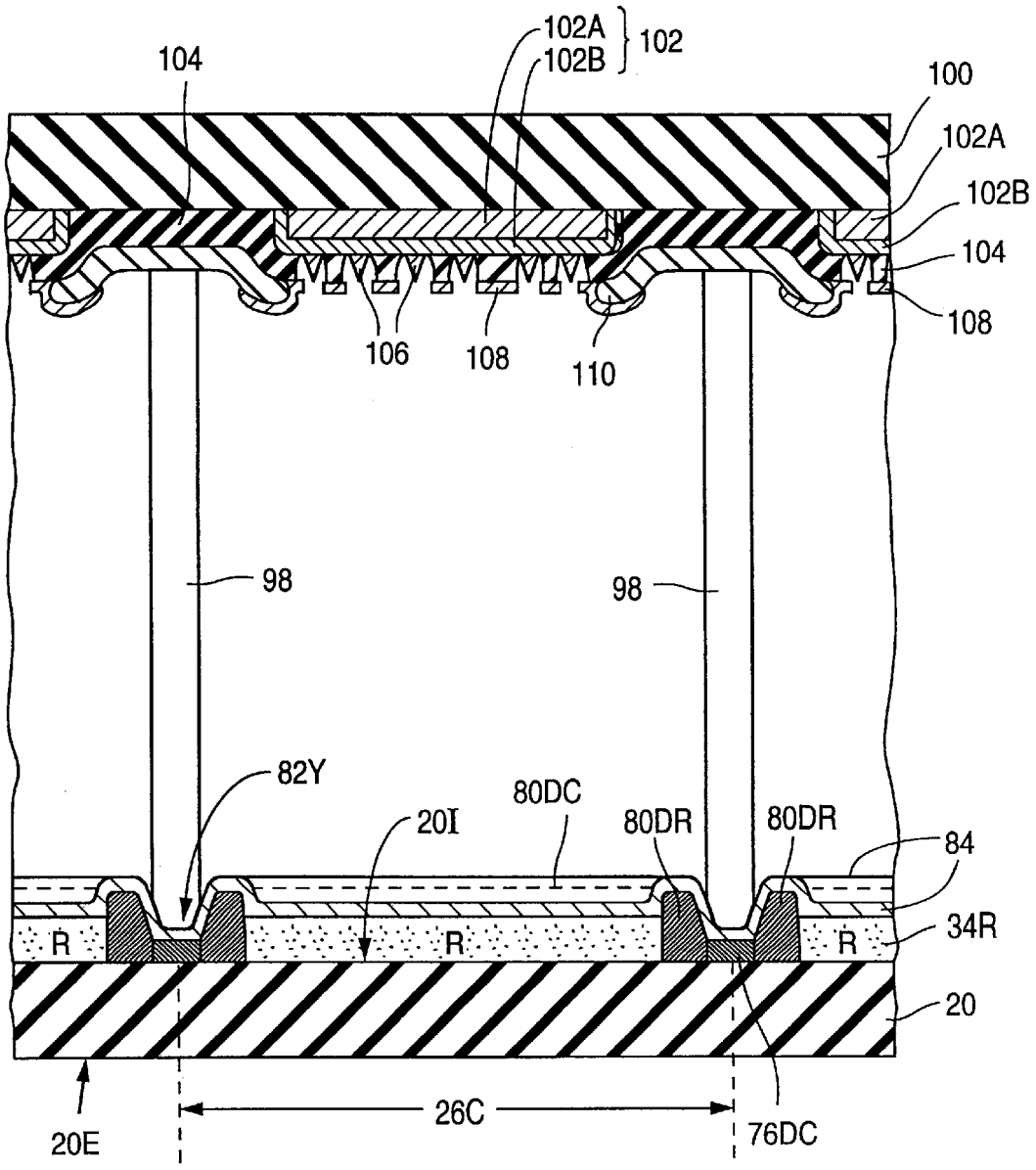
FIG. 18 is a cross-sectional side view of the core of a flat-panel CRT display that employs a faceplate structure having the spacer-securing black matrix of FIG. 10*g*. The cross section of FIG. 18 is taken through a plane extending along the right-hand side of the structure shown in FIG. 10*g* and thus is perpendicular to the associated view of FIG. 9*e*.

FIGS. 17 and 18 present examples for the general appearance of the core of a completed flat-panel CRT display when the faceplate structure is manufactured according to the invention so as to laterally constrain spacer walls. In particular, FIG. 17 shows how spacer walls 96 are laterally constrained by anode-coated black column stripes 56DC in a faceplate structure fabricated according to the process of FIGS. 5 and 6. FIG. 18 shows how spacer walls 98 are securely held by wall-gripping mechanisms formed with anode-coated black row bars 80DR in a faceplate structure manufactured according to the process of FIGS. 9 and 10.

As illustrated in FIGS. 17 and 18, spacer walls 96 or 98 also contact a baseplate structure of the flat-panel CRT display. The baseplate structure consists of an electrically insulating baseplate 100 and a gated cathode structure overlying baseplate 100. The cathode structure is formed with multiple electrically non-insulating emitter row electrodes 102, an inter-electrode dielectric layer 104, multiple electron-emissive elements 106, a patterned electrically non-insulating gate layer 108, and multiple electrically non-insulating column electrodes 110.

Row electrodes 102 in the cathode are situated on the interior surface of baseplate 100. In the illustrated example, each row electrode 102 consists of an electrically conductive, typically metallic, portion 102A and an overlying electrically resistive portion 102B. Dielectric layer 104 extends over the interior surface of baseplate 100 and also over row electrodes 102, specifically resistive portions 102B. Electron-emissive elements 106 are situated in openings in dielectric layer 104 and extend down to row electrodes 102. In FIGS. 17 and 18, electron-emissive elements 106 are illustrated as being generally of conical shape. Other shapes, such as filaments, can be employed for electron-emissive elements 106.

Gate layer 108 and column electrodes 110, all of which are normally formed with electrically conductive material such as metal, overlie dielectric layer 104. Each column electrode 110 contacts a portion of gate layer 108 in the same column of pixels as that column electrode 110. Although gate layer 108 partially overlies column electrodes 110 in the illustrated example, gate layer 108 can also partially underlie column electrodes 110. In any event, electron-emissive elements 106 are exposed through gate openings in layer 108.

The baseplate structure can be manufactured accordingly to a fabrication process that utilizes a charged-particle tracking technique such as that described in U.S. Pat. Nos. 5,462,467, 5,559,389, and 5,564,959. The baseplate structure can also be fabricated according to a process that uses a spherical particle technique of the type disclosed in Haven et al, U.S. patent application Ser. No. 08/660,536, filed Jun. 7, 1996, now allowed and Ludwig et al, U.S. patent application Ser. No. 08/660,538, filed Jun. 7, 1996, now U.S. Pat. No. 5,865,659. Further techniques suitable for manufacturing the baseplate structure are described in Porter et al, U.S. patent application Ser. No. 08/807,456, filed Feb. 28, 1997, now U.S. Pat. No. 5,914,150. The contents of these patents and patent applications are incorporated by reference herein.

The baseplate structure may include other components not shown in FIGS. 17 and 18. For example, focusing ridges can be provided over inter-electrode dielectric layer 104 to help control electron trajectories. The focusing ridges may also be employed to control the placement and location of the spacer walls in regards to the baseplate structure. Other techniques that can be utilized to control the placement and location of the spacer walls with respect to the baseplate structure and the outer wall which connects the faceplate structure to the baseplate structure are described in Fahlen et al, U.S. patent application Ser. No. 08/771,453, filed Dec. 20, 1996, likewise incorporated herein by reference.

A flat-panel CRT display containing a faceplate structure manufactured according to the invention operates in the following way. The anode is maintained at high positive potential relative to gate layer 108 and emitter row electrodes 102. When a suitable potential is applied between (a) a selected one of row electrodes 102 and (b) a selected one of column electrodes 110 in contact with a portion of gate layer 108, the so-selected gate portion extracts electrons from electron-emissive elements 106 at the intersection of the two selected electrodes and controls the magnitude of the resulting electron current. Desired levels of electron emission typically occur when the applied gate-to-cathode parallel-plate electric field reaches 20 volts/$\mu$m or less at a current density of 0.1 mA/cm$^2$ as measured at phosphor-coated faceplate 20 when phosphor regions 34R, 36G, and 38B are high-voltage phosphors.

The extracted electrons pass through the anode layer (e.g., 52 or 84) and selectively strike phosphor regions 34R, 36G, and 38B, causing them to emit light visible on exterior surface 20E of faceplate 20. Depending on which phosphor regions 34R, 36G, and 38B are target phosphors intended to be struck by the impinging electrons, the off-target electrons largely strike the black matrix laterally surrounding phosphor regions 34R, 36G, and 38B of pixels 26. The black matrix is black, non-reflective of light, and non-emissive of light when struck by electrons emitted by electron-emissive elements 106. Consequently, the off-target electrons do not cause any significant undesired mixing of colors.

Directional terms such as "top", "bottom", "upwards", and "down" have been employed in describing the present invention to establish a frame of reference by which the reader can more easily understand how the various parts of the invention fit together. In actual practice, the components of a light-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the light-reflective anode layer (e.g., 52 or 84 ) can be replaced with a transparent electrically non-insulating anode layer situated between baseplate 20, on one hand, and phosphor regions 34R, 36G, and 38B, on the other hand. In that case, the spacer walls are constrained directly by the black matrix rather than through the non-reflective anode layer described above. The transparent anode layer typically consists of indium-tin oxide.

More than two actinic layers can be employed in creating the black matrix. Conversely, the primary actinic layer can be subjected to two or more backside exposures, each additional backside exposure being performed through a suitable photomask placed below baseplate 20. As a result, the primary actinic layer is selectively exposed to at least two different heights above faceplate interior surface 20I.

The teachings of the invention can be employed to provide actinic material with openings having plan-view shapes other than rectangles (or squares). The spacer walls can be discontinuous—i.e., each wall can consist of two or more laterally separated wall sections. The internal spacers can have shapes other than vertical walls. As one example, the spacers can be shaped as pillars.

Other techniques can be employed to introduce phosphor material 34R, 36G, and 38B into column openings 32, 50X, 58X, 70X, and 82X. For example, the techniques disclosed in Haven et al, U.S. patent application Ser. No. 08/607,278, filed Feb. 22, 1996, can be employed for the phosphor introduction. The contents of Ser. No. 08/607,278 are incorporated by reference herein. In Ser. No. 08/607,278, red-emitting, green-emitting, and blue-emitting phosphor material is introduced into different sub-pixel openings after which all the phosphor is simultaneously cured by exposing the phosphor to backside UV light. Frontside UV exposure can alternatively be employed for curing the phosphor.

The invention can be applied to fabricating faceplate structures of flat-panel displays other than flat-panel CRT displays. Examples include plasma displays and liquid-crystal displays. Likewise, the principles of the invention can be applied to flat-panel devices other than displays. Various modifications and applications may thus be made by those skilled in the art without departing from the true scope and spirit of the invention as defined in the appended claims.

We claim:

1. A structure comprising:

a plate having a first surface and a second surface opposite the first surface;

a plurality of laterally separated light-emmissive regions situated over the plate's first surface; and a patterned dark region situated over the plate's first surface and laterally surrounding each light-emissive region, the dark region comprising multiple laterally separated first strips extending laterally generally in a first direction and multiple laterally separated second strips extending laterally generally in a second direction different from the first direction, the second strips extending further away from the plate's first surface than the first strips, each second strip comprising a plurality of strip segments, the second strips crossing the fit strips such that one segment of each second strip lies between each consecutive pair of the first strips.

2. A structure as in claim 1 further including a multiplicity of spacer walls, each situated over a different one of the first strips so as to be laterally constrained by the closest segments of the second strips.

3. A structure as in claim 2 further including an intermediate layer situated over the second strips and the under the spacer walls such that the segments of the second strips constrain the spacer walls through the intermediate layer.

4. A structure as in claim 2 wherein the segments of the second strips extend into slots in the first strips.

5. A structure as in claim 4 wherein each interior segment of each second strip has a length profile roughly shaped like an upright trapezoid.

6. A structure as in claim 2 further including cathode means for emitting electrons that strike the light-emitting regions and cause them to emit light that produces an image on the plate's second surface, the dark region being substantially non-emissive of light when struck by electrons emitted from the cathode means.

7. A structure as in claim 6 further including an electrically non-insulating anode layer situated over the plate's first surface for attracting electrons from the cathode means to the light-emitting regions.

8. A structure as in claim 7 wherein the anode layer is situated over the light-emissive regions and the second strips and under the spacer walls such that the second strips constrain the spacer walls through the anode layer.

9. A structure comprising:

a plate having a first surface and a second surface opposite the first surface;

a plurality of laterally separated light-emissive regions situated over the plate's first surface; and a patterned dark region situated over the plate's first surface and laterally surrounding each light-emissive region, the dark region comprising multiple dark portions, at least part of which are trapezoidally profiled strips, each having a width profile roughly shaped like an upright trapezoid relative to the plate's first surface.

10. A structure as in claim 9 wherein each trapezoid has a base, a top side located fully over the base, and a pair of opposing lateral sides, each slanted at a tilt angle of at least 2° relative to a line extending generally perpendicular to the plate's first surface.

11. A structure as in claim 10 wherein the tilt angle for each lateral side of each trapezoid is at least 5°.

12. A structure as in claim 10 wherein each trapezoid is approximately an isosceles trapezoid.

13. A structure as in claim 9 further including an electrically non-insulating anode layer situated over the light-emissive regions.

14. A structure as in claim 13 further including cathode means for emitting electrons that strike the light-emissive regions and cause them to emit light that produces an image on the plate's second surface, the dark region being substantially non-emissive of light when struck by electrons emitted from the cathode means.

15. A structure as in claim 9 wherein the trapezoidally profiled strips comprise:

laterally separated first strips extending laterally generally in a first direction; and laterally separated second strips extending laterally generally in a second direction different from the first direction and largely intersecting the first strips.

16. A structure as in claim 9 wherein:

the dark region further includes laterally separated first strips extending laterally generally in a first direction; and the trapezoidally profiled strips comprise laterally separated second strips extending laterally generally in a second direction different from the first direction and crossing the first strips.

17. A structure as in claim 16 wherein the second strips extend further away from the plate's first surface than the first strips, each second strip comprising a plurality of segments laterally separated by open regions overlying the first strips.

18. A structure as in claim 9 wherein:

the dark region further includes laterally separated first strips extending laterally generally in a first direction; and the trapezoidally profiled strips comprise pairs of laterally separated bars extending laterally generally in the first direction, the bars extending further away from the plate's first surface than the first strips, each of the pairs of bars having longitudinal sides that largely meet opposite longitudinal sides of a different one of the first strips so as to form a channel between that pair of bars.

19. A structure as in claim 1 wherein the dark region is largely black.

20. A structure as in claim 18 wherein the trapezoidally profiled strips further include laterally separated second strips extending generally in a second direction different form the first direction, each second strip comprising a plurality of laterally separated segments, each second strip situated between a consecutive pair of the pairs of bars.

21. A structure as in claim 20 wherein the second strips extend approximately as far from the plate's first surface as the bars.

22. A structure as in claim 9 wherein the dark region is largely black.

* * * * *